US011801200B2

(12) United States Patent
Shemesh et al.

(10) Patent No.: US 11,801,200 B2
(45) Date of Patent: Oct. 31, 2023

(54) VIAL ADAPTOR WITH HOUSING

(71) Applicant: SIMPLIVIA HEALTHCARE LTD., Kiryat Shmona (IL)

(72) Inventors: Eli Shemesh, Hod Hasaron (IL); Yaron Cina, Moshav Sharona (IL); Asaf Asherov, Pardes Hana (IL)

(73) Assignee: SIMPLIVIA HEALTHCARE LTD., Kiryat Shmona (IL)

( * ) Notice: Subject to any disclaimer, the term of this patent is extended or adjusted under 35 U.S.C. 154(b) by 730 days.

(21) Appl. No.: 16/184,663

(22) Filed: Nov. 8, 2018

(65) Prior Publication Data

US 2019/0142695 A1 May 16, 2019

(30) Foreign Application Priority Data

Nov. 10, 2017 (EP) ..... 17201214

(51) Int. Cl.
*A61J 1/14* (2006.01)
*A61J 1/20* (2006.01)

(52) U.S. Cl.
CPC ..... *A61J 1/2096* (2013.01); *A61J 1/1406* (2013.01); *A61J 1/2048* (2015.05); *A61J 1/2072* (2015.05); *A61J 1/201* (2015.05); *A61J 1/2055* (2015.05)

(58) Field of Classification Search
CPC ..... A61J 1/1406; A61J 1/201; A61J 1/2048; A61J 1/2055; A61J 1/2072; A61J 1/2096
See application file for complete search history.

(56) References Cited

U.S. PATENT DOCUMENTS

| | | | |
|---|---|---|---|
| 4,673,404 | A | 6/1987 | Gustavsson |
| 7,654,995 | B2 | 2/2010 | Warren |
| 7,743,799 | B2 | 6/2010 | Mosler |
| 7,883,499 | B2 | 2/2011 | Fangrow |
| 7,900,659 | B2 | 3/2011 | Whitley et al. |
| 8,029,747 | B2 | 10/2011 | Helmerson |
| 8,206,367 | B2 | 6/2012 | Warren |
| 8,657,803 | B2 | 2/2014 | Helmerson et al. |

(Continued)

FOREIGN PATENT DOCUMENTS

| | | |
|---|---|---|
| EP | 1951344 B1 | 5/2014 |
| EP | 2155142 B1 | 5/2016 |

(Continued)

OTHER PUBLICATIONS

International Search Report and Written Opinion dated Feb. 9, 2022, 2 Pages.

(Continued)

*Primary Examiner* — Kai H Weng
(74) *Attorney, Agent, or Firm* — BROWDY AND NEIMARK, PLLC

(57) ABSTRACT

A vial adaptor (1010) may comprise a body portion (1020). The body portion includes a vial connection port (1022), a syringe connection port (1024), an access passageway (1026) between the vial connection port and the syringe connection port, and a regulation passageway (1028). The vial adaptor may further comprise an expandable and/or contractible chamber (1040) impermeable to gas and/or liquid, the regulation passageway being between the vial connection port and the chamber, and an expandable housing (1050) casing the chamber.
Such a vial adaptor constitutes an improved vial adaptor.

13 Claims, 34 Drawing Sheets

(56) References Cited

U.S. PATENT DOCUMENTS

| | | | |
|---|---|---|---|
| 8,945,084 | B2 | 2/2015 | Warren |
| 9,005,179 | B2 | 4/2015 | Fangrow |
| 9,005,180 | B2 | 4/2015 | Seifert |
| 9,089,475 | B2 | 7/2015 | Fangrow |
| 9,101,717 | B2 | 8/2015 | Mansour et al. |
| 9,132,062 | B2 | 9/2015 | Fangrow |
| 9,615,997 | B2 | 4/2017 | Fangrow |
| 9,763,855 | B2 | 9/2017 | Fangrow |
| 9,895,291 | B2 | 2/2018 | Fangrow |
| 10,022,302 | B2 | 7/2018 | Warren |
| 10,071,020 | B2 | 9/2018 | Warren |
| 2008/0142388 | A1 | 6/2008 | Whitley et al. |
| 2008/0249498 | A1 | 10/2008 | Fangrow |
| 2008/0312634 | A1 | 12/2008 | Helmerson et al. |
| 2013/0228239 | A1 | 9/2013 | Cederschiöld |
| 2014/0276386 | A1 | 9/2014 | Mansour |
| 2015/0209229 | A1 | 7/2015 | Garfield et al. |
| 2015/0297456 | A1 | 10/2015 | Marici |
| 2015/0297461 | A1 | 10/2015 | Fangrow |
| 2015/0320641 | A1 | 11/2015 | Fangrow |
| 2016/0206511 | A1 | 7/2016 | Garfield |
| 2017/0079880 | A1* | 3/2017 | Guala ..... A61J 1/2055 |
| 2018/0125759 | A1 | 5/2018 | Fangrow |
| 2019/0060171 | A1 | 2/2019 | Lee |

FOREIGN PATENT DOCUMENTS

| | | | |
|---|---|---|---|
| JP | 2014-521491 | A | 8/2014 |
| JP | 2015-508700 | A | 3/2015 |
| JP | 2016-504155 | A | 2/2016 |
| JP | 2017-513611 | A | 6/2017 |
| RU | 2469696 | C2 | 12/2012 |
| WO | 2005/041846 | A2 | 5/2005 |
| WO | 2011/150037 | A1 | 12/2011 |
| WO | 2015118432 | A1 | 8/2015 |
| WO | 2017/132588 | A1 | 8/2017 |

OTHER PUBLICATIONS

Japanese Office Action dated Aug. 23, 2022, pp. 10 including English translation.

* cited by examiner

VIAL ADAPTOR WITH HOUSING

CROSS-REFERENCE TO RELATED APPLICATIONS

This application claims the benefit of European Patent Application No. 17201214.8, filed on Nov. 10, 2017, the disclosure of which is incorporated herein by reference in its entirety.

FIELD OF THE PRESENT DISCLOSURE

The invention relates to the field of devices and methods used for handling recipients in a medical context, and more particularly to vial adaptors.

BACKGROUND

A vial adaptor is a device configured for being connected to a vial, for example that contains a medical substance. A syringe may be connected to the vial adaptor, for example via a syringe adaptor. The assembly may be operated to establish fluid communication between the syringe and the vial, for example to allow transfer of liquid from the vial to the syringe.

Some known vial adaptors comprise an expandable and/or contractible chamber impermeable to gas and/or liquid. These known vial adaptors are configured for fluid communication between the vial and the chamber. When fluid is communicated between the syringe and the vial, the vial adaptor may accordingly communicate fluid between the vial and the chamber. Such fluid communication between the vial and the chamber may at least reduce (i.e. prevent or reduce) fluid communication between the vial and ambient air (i.e. air of the working environment, which may be cleaned and/or sterilized). For example, when liquid is transferred from the vial to the syringe, gas contained in the chamber may accordingly be transferred from the chamber to the vial so as to regulate pressure inside the vial, with at least reduced gas communication between the vial and ambient air.

Within this context, there is a need to provide an improved vial adaptor.

SUMMARY OF THE PRESENT DISCLOSURE

It is therefore provided a vial adaptor which comprises a body portion and an expandable and/or contractible chamber impermeable to gas and/or liquid. The body portion includes a vial connection port, a syringe connection port, an access passageway between the vial connection port and the syringe connection port, and a regulation passageway between the vial connection port and the chamber. The access passageway is configured for enabling fluid communication between the vial connection port and the syringe connection port. The regulation passageway is configured for enabling fluid communication between the vial connection port and the chamber.

According to a first aspect, the vial adaptor may also comprise an expandable housing casing the chamber. The housing provides a protection to the chamber. The expandability of the housing provides space optimization capability to the vial adaptor.

In examples of the first aspect, the vial adaptor may present any one or any combination of the following features:

the chamber is configured for imparting expansion to the housing;

the housing has a contracted state and an expanded state, the housing being less voluminous in the contracted state than in the expanded state, the housing casing the chamber both in the contracted state and in the expanded state;

the housing is further contractible;

the chamber comprises at least a flexible and/or elastic portion, the flexible and/or elastic portion optionally comprising at least one sheet;

the flexible and/or elastic portion comprises two sheets welded together;

the two sheets each have an annulus shape;

the two sheets are welded together at respective external edges;

the housing comprises at least two portions configured for sliding one with respect to the other when the housing expands;

the housing is telescopic;

the vial connection port defines a vial connection axis, the housing and/or the chamber surrounding the vial connection axis;

the housing and/or the chamber surrounds at least a section of the body portion;

wherein the vial connection port defines a vial connection axis, the section of the body portion that the housing and/or the chamber surrounds extending along the vial connection axis;

the housing defines a toroid inside space and/or the chamber defines a toroid inside space;

the vial adaptor is configured for the housing to expand and/or contract uniformly around the vial connection axis, and/or for the chamber to expand and/or contract uniformly around the vial connection axis;

the vial connection port defines a vial connection axis, the vial adaptor being configured for the housing to expand and/or contract along a direction at least substantially parallel to the vial connection axis, and/or for the chamber to expand and/or contract along a direction at least substantially parallel to the vial connection axis;

the vial adaptor is configured, when connected to a vial, for the housing to expand in an orientation toward the vial, and/or for the chamber to expand in an orientation toward the vial;

the body portion is assembled to one or more other components of the vial adaptor via press-fitting and/or snapping;

the chamber is assembled to one or more other components of the vial adaptor via welding;

the housing (50) comprises a cover (56) and a bowl (52), the cover being snapped to the bowl;

the vial adaptor further comprises a coupling portion which includes a regulation port, the vial adaptor comprising a fluid path between the regulation port and an extremity of the regulation passageway, the vial adaptor comprising another fluid path between the regulation port and the chamber;

the coupling portion forms a passage, the central section of the body portion being inserted in the passage;

the extremity of the regulation passageway is formed on a central section of the body portion separate from the coupling portion, the extremity of the regulation passageway being for example defined by an opening formed on said central section;

the coupling portion comprises a sleeve portion which forms the passage, the vial connection port being arranged at one end of the sleeve portion and the syringe connection port being arranged at the other end of the sleeve portion;

the chamber is welded at least partly to the coupling portion and/or at a zone of the vial adaptor peripheral to the sleeve portion;

the extremity of the regulation passageway is formed on a wall of the body portion, the vial adaptor comprising a sealing member arranged against said wall and providing airtightness of the fluid communication between the regulation port and the extremity of the regulation passageway;

the sealing member comprises elastic material;

the vial adaptor further comprises a filter arranged between the regulation passageway and the chamber;

the vial adaptor comprises a duct member arranged between the chamber and an extremity of the regulation passageway, the diameter of at least a portion of the duct member being smaller than the diameter of the extremity of the regulation passageway;

the duct member is arranged between the extremity of the regulation passageway and the regulation port;

the diameter of at least a portion of the duct member is smaller than the diameter of the regulation port;

the duct member is integrally formed with the sealing member; and/or the vial adaptor further comprises a regulation compartment between the regulation passageway and the chamber.

According to a second aspect, the chamber may comprise at least a flexible and/or elastic portion which comprises two sheets welded together. This provides a chamber relatively easy to manufacture.

According to a third aspect, the vial connection port may define a vial connection axis and the chamber may surround the vial connection axis. The vial adaptor may be further configured, when connected to a vial, for the chamber to expand in an orientation toward the vial. This provides a vial adaptor stable during use, notably during expansion of the chamber.

According to a fourth aspect, the vial adaptor may comprise a coupling portion which includes a regulation port. The vial adaptor may comprise a fluid path between the regulation port and an extremity of the regulation passageway. The vial adaptor may further comprise another fluid path between the regulation port and the chamber. This provides a vial adaptor relatively easy to manufacture and safe to use.

According to a fifth aspect, the vial adaptor may be provided in a sealed package and with a positive volume of (e.g. cleaned and/or sterilized) gas contained in the chamber. This provides a vial adaptor ready for use with a vial having content in fluid form, for example as a liquid.

In examples of these additional aspects, the vial adaptor may comprise no housing casing the chamber. In alternative examples, the vial adaptor may comprise a housing casing the chamber. The housing may be non-expandable. The volume of the housing may be fixed and/or sufficient to authorize expansion of the chamber during use of the vial adaptor. Alternatively, the housing may be expandable, thus of variable volume. When the housing is expandable, the housing may optionally further present any related feature or combination of features of any example of the first aspect. In all cases, the vial adaptor may optionally present any other feature or combination of features of any example of the first aspect.

According to a sixth aspect, the vial adaptor may comprise a shield of variable size which protects the chamber but does not case the chamber, for example a partial skirt. The shield may in examples be made of rigid and/or semi-rigid material. This provides a protection to the chamber. The variability of the size of the shield provides space optimization capability to the vial adaptor. The vial adaptor may optionally present any other feature or combination of features of any example of the other aspects.

It is further provided a kit comprising the vial adaptor according to any one of the aspects. The kit may further comprise a syringe adaptor and/or a syringe. The syringe adaptor may be configured to cooperate with the vial adaptor. The syringe adaptor may for example be configured to be connected to the vial adaptor. The syringe may enable fluid mixing.

It is further provided a method of using the vial adaptor according to any one of the aspects. The method comprises providing at least the vial adaptor, a vial with content in fluid form or in solid form and a syringe. The method also comprises connecting the vial adaptor to the vial and to the syringe, and then reconstituting and/or extracting a solution in the vial.

It is further provided a method of manufacturing the vial adaptor according to any one of the aspects. The method comprises providing at least the body portion and the chamber, and assembling the body portion to the chamber such that the regulation passageway is configured for establishing fluid communication between the vial connection port and the chamber. The method may then comprise assembling a housing if any.

BRIEF DESCRIPTION OF THE DRAWINGS

Non-limiting examples will now be described in reference to the accompanying drawings, where.

DETAILED DESCRIPTION

The following discusses examples of the vial adaptor according to the first aspect. The vial adaptor according to any other aspect may optionally also present any feature or combination of features of any of these discussed examples.

Figure 1:
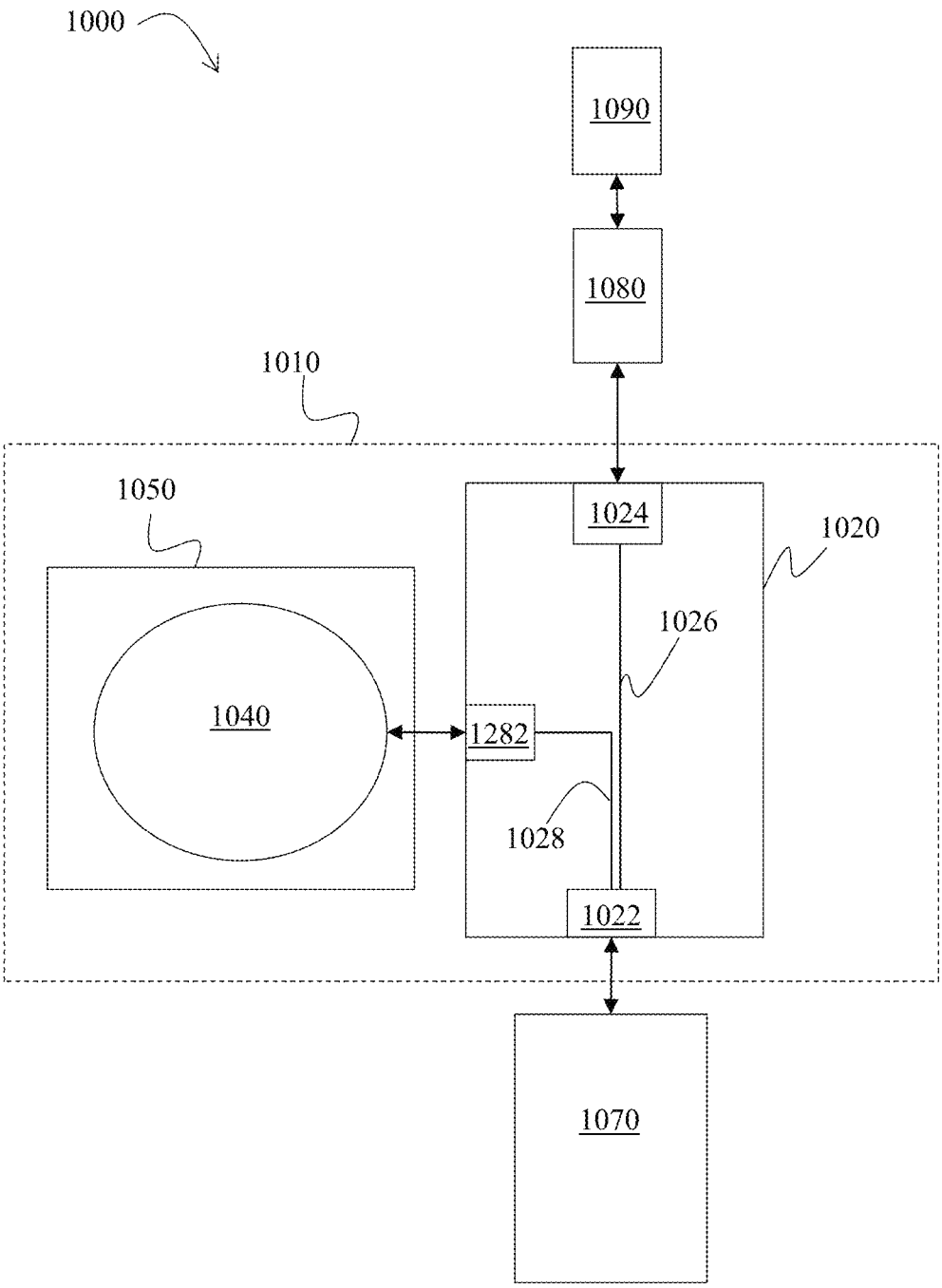
FIG. 1 illustrates schematically an example of an assembly comprising the vial adaptor.

FIG. 1 illustrates schematically an assembly 1000 comprising vial adaptor 1010.

The vial adaptor 1010 comprises a body portion 1020. The body portion 1020 includes a vial connection port 1022, a syringe connection port 1024, an access passageway 1026, and a regulation passageway 1028. The access passageway 1026 is between the vial connection port 1022 and the syringe connection port 1024. This means that the access passageway 1026 is configured for establishing or enabling fluid communication between the vial connection port 1022 and the syringe connection port 1024, or in other words for providing a fluid path between the vial connection port 1022 and the syringe connection port 1024. The access passageway 1026 may form the fluid path, or a conduct in which a component forming the fluid path may be inserted (such as a hollow needle of a syringe adaptor 1080). The vial adaptor 1010 also comprises an expandable and/or contractible chamber 1040 which is impermeable to gas and/or liquid. The regulation passageway 1028 is between the vial connection port 1022 and the chamber 1040. This means that the regulation passageway 1028 is configured for establishing or enabling fluid communication between the vial connection port 1022 and the chamber 1040, or in other words for providing a fluid path between the vial connection port 1022 and the chamber 1040. The vial adaptor 1010 also comprises an expandable housing 1050 which cases the chamber 1040. This provides an improved vial adaptor.

Notably, the vial connection port 1022 allows connection of the vial adaptor 1010 to a vial 1070, and the syringe connection port 1024 allows connection of a syringe 1090 to the vial adaptor 1010. The access passageway 1026 allows fluid communication between the syringe 1090 and the vial 1070. The vial adaptor 1010 thereby forms an intermediate component between the syringe 1090 and the vial 1070 which allows avoiding direct access to the vial 1070 with a manually-handled syringe having a protuberant needle. The vial adaptor 1010 thereby at least reduces pricking risks. Also, once connected to the vial 1070, the vial adaptor 1010 may be left in place.

The regulation passageway 1028 is configured to provide a fluid path thereby allowing establishing fluid communication between the vial 1070 (via the vial connection port 1022) and the chamber 1040, when the vial 1070 is connected to the vial connection port 1022 (as represented on FIG. 1). During fluid withdrawal from the vial 1070 or fluid insertion into the vial 1070 (e.g. during powder drug reconstitution) and/or at time of piercing a septum of the vial 1070, fluid communication (in particular gaseous exchange) can therefore occur between the vial 1070 and the chamber 1040. In fact, fluid withdrawal or insertion or said septum piercing may impact pressure inside the vial 1070 (i.e. tending to increase or decrease said pressure). Therefore, establishment of fluid communication between the vial 1070 and the chamber 1040 allows regulating pressure inside the vial 1070 by compensating such impact. This is performed with no or marginal fluid communication between the vial 1070 and ambient air, unlike vial adaptors having no such chamber. The vial adaptor 1010 thereby increases safety of use, by at least reducing aerosoling and/or leaking into ambient air of the content of the vial 1070 and/or syringe 1090, and/or contamination by ambient air of said content of the vial 1070 and/or syringe 1090.

Moreover, the vial adaptor 1010 comprises a housing 1050 which cases the chamber 1040 and thereby offers a protection to the chamber 1040. Such protection at least reduces risks of damage of the chamber 1040 (such as piercing and/or explosion) and/or consequences thereof (such as aerosoling and/or leaking into ambient air of the content of the chamber 1040 and/or contamination by ambient air of the content of the vial 1070 and/or syringe 1090 via contamination of the content of the chamber 1040). The housing 1050 thereby yet increases safety of use.

Furthermore, the housing 1050 is expandable such that its volume can be adapted to the volume of the chamber 1040. This allows optimizing space, for example by contracting (i.e. compacting) the housing 1050 and thereby compacting the vial adaptor 1010 when needed, thus making the vial adaptor 1010 relatively little cumbersome. The vial adaptor 1010 thus allows an increase in safety of use at a relatively low cost in terms of space or cumbersomeness. Such space optimization is particularly useful for an optimized storage and/or transportation of the housing 1050 and/or vial adaptor 1010, for example in a batch thereof. The volume variability of the housing 1050 also makes the vial adaptor 1010 relatively easy to operate to a user, since for example the vial adaptor 1010 may be relatively easy to manipulate when compacted.

The body portion 1020 of the vial adaptor may comprise or consist of an assembly of several integrally formed components or of a single integrally formed component which define(s) the general shape of the body portion 1020, and/or one or more additional components integrated to said integrally formed component(s). The integrally formed component(s) may be made of rigid and/or semi-rigid material, for example plastic. The integrally formed component(s) may be molded, for example injection-molded.

The syringe connection port 1024 is a structure of the body portion adapted for connection of a syringe 1090 (such as a luer fitted syringe) so as to allow fluid communication between the syringe 1090 and the vial 1070 via the access passageway 1026 upon operation of the syringe 1090. The connection of the syringe 1090 to the syringe connection port 1024 may be performed in an at least substantially airtight manner, such that there is no or only little leak to the outside and/or no or only little contamination from the outside when fluid communicates between the syringe 1090 and the vial 1070. The syringe connection port 1024 may be configured for an indirect connection and/or a direct connection. In an indirect connection case (represented on FIG. 1), the syringe 1090 is connected to the vial adaptor 1010 via an intermediate component mounted on the vial adaptor 1010, such as a syringe adaptor 1080. In a direct connection case (not represented), the syringe 1090 directly accesses the vial adaptor 1010 with no intermediate component. The same syringe connection port 1024 may be configured for both the direct type of connection and the indirect type of connection.

The syringe connection port 1024 may for example comprise an opening formed on the body portion 1020 and defining an upper extremity of the access passageway 1026 (relative to the vial 1070 considered supported on a horizontal plane). The body portion 1020 may integrate a septum which seals said upper extremity of the access passageway 1026. The body portion 1020 may comprise a casing which maintains firmly the septum so as to close airtightly said upper extremity of the access passageway 1026. The septum may for example comprise an elastomeric material. The elastomeric material may be configured for deforming when punctured by a hollow needle of the syringe adaptor 1080 or of the syringe in such a way that the hollow needle can pierce through the septum and the elastomeric material forms an at least substantially airtight seal around the needle. The elastomeric material may be resilient i.e. further configured for deforming back to its initial shape when the hollow needle is withdrawn, so as to again at least substantially seal the upper extremity of the access passageway 1026. The elastomeric material may for example comprise rubber, such as silicone rubber and/or butyl rubber. Alternatively or additionally, the body portion 1020 may comprise a detachable cap which may be mounted on the syringe connection port 1024 so as to close the upper extremity of the access passageway 1026. The detachable cap may in examples seal the upper extremity of the access passageway 1026. The detachable cap may be detached upon need to connect a syringe 1090 to the syringe connection port 1024. The detachable cap may be fully removable or alternatively stay maintained to the syringe connection port 1024 after detaching, for example via a hinge connecting the detachable cap to the vial adaptor 1010.

In examples, the opening defining the upper extremity of the access passageway 1026 may be formed at the tip of a tubular member of the body portion 1020. The interior of the tubular member may thereby constitute part of the access passageway 1026. In examples, the tubular member may optionally be of a generally cylindrical shape. The syringe connection port 1024 may be configured for releasably connecting to a syringe adaptor 1080. The syringe adaptor 1080 may comprise a syringe adaptor body generally shaped as a sleeve. The syringe connection port 1024 may for example be configured for said tubular member to be inserted in said sleeve. For example, said tubular member may be slid inside the sleeve via an open end of said sleeve. The syringe adaptor 1080 may comprise a hollow needle extending inside the sleeve from a base element closing the other end of the sleeve. The nozzle of a syringe 1090 may be mounted on a syringe mounting port of the syringe adaptor 1080 in fluid communication with the hollow needle. The syringe mounting port may be formed on a side of the base element opposite to a side from which the needle extends. The syringe mounting port may be configured for the direct mounting of a nozzle of the syringe 1090. The nozzle of the syringe 1090 may be of a non-needle type, for example of a luer type, and/or formed in a non-metallic material, for example in plastic. The syringe adaptor 1080 may thus allow using components which do not present any protuberant metallic needle.

In such examples, the syringe adaptor 1080 may optionally further comprise a cork arranged in the sleeve so as to enclose a space inside the sleeve that comprises the hollow needle. The cork may isolate the needle. The cork may close the needle aperture (so that a user cannot push the syringe plunger when the syringe adaptor 1080 is not connected). The cork may in examples be a (e.g. single and/or massive) septum. The cork may in examples comprise two septa enclosing a volume of air (the aperture of the needle in the rest position is at a location within the cork—in particular in the middle "air" portion). Other examples of a cork may include a distal disk septum and a sleeve septum which closes the needle aperture or distal disk septum only. Such cork improves safety of use.

The cork may comprise a septum. The septum of the syringe adaptor may present any feature or combination of features of any example of the septum of the vial adaptor 1010. The cork may be mobile and configured to slide inside the sleeve upon the tubular member of the vial adaptor being itself slid inside the sleeve. The tubular member may reach the cork and impart sliding to the cork, such that the hollow needle of the syringe adaptor 1080 comes out of the enclosed space through the septum of the syringe adaptor 1080, said hollow needle then further piercing the septum of the vial adaptor 1010 as the cork and the tubular member continue to be slid inside the sleeve. The tip of the hollow needle may initially be planted inside the septum before the syringe adaptor 1080 is mounted on the vial adaptor 1010. The tip of the hollow needle may alternatively initially be arranged inside the enclosed space. This at least reduces contamination risks of said tip of the hollow needle. The syringe adaptor 1080 may further comprise a spring element configured for the cork to slide in the sleeve back to its initial position when the syringe adaptor 1080 is dismounted from the vial adaptor 1010. The spring element may be a compressible spring linking the cork and the base element, thereby biasing the cork distally.

In examples, the syringe connection port 1024 (e.g. the tubular member) may optionally comprise a structure configured for the mounting of the syringe adaptor 1080 thereon to be performed via attachment, for example via snapping. Such structure may comprise recess(es)—or respectively clamp(s)—configured for cooperating with corresponding clamp(s)—or respectively recess(es)—of the syringe adaptor 1080. The syringe adaptor 1080 may comprise handles configured to control said clamp(s) or recess(es) of the syringe adaptor so as to perform unsnapping, e.g. manually.

The vial connection port 1022 is a structure of the body portion adapted for connection to the vial 1070. Upon connection to the vial, fluid communication between the vial 1070 and the syringe 1090 via the access passageway 1026 and between the vial 1070 and the chamber 1040 via the regulation passageway 1028 may be enabled. The connection of the vial connection port 1022 to the vial 1070 may be performed in an at least substantially airtight manner, such that there is no or only little leak to the outside and/or no or only little contamination from the outside when fluid communicates between the vial 1070 and the syringe 1090 and/or between the vial 1070 and the chamber 1040.

The vial connection port 1022 may be configured for connection of the vial adaptor 1010 to any one or more types of vial. A vial is a recipient or bottle containing or configured for containing any type of medical substance. The vial adaptor 1010 may be configured for use with any one or more types of vial, for example with vials containing drugs used in chemotherapies, such as vials containing an anticancer medication. The materials and processes used for manufacturing the vial adaptor 1010 may thereby be appropriate for such use. The vial 1070 may be provided with the substance contained in fluid form (e.g. as a liquid), or in a soluble solid form (e.g. as a powder). A vial may comprise a vial neck configured for mounting a vial connection port of a vial adaptor thereon, and a container portion configured for containing the substance.

The vial neck may as known comprise a cap mounted on a container neck arranged at one extremity of the container portion. The container neck may be integrally formed with the container portion. The container neck and/or the container portion may be made of a rigid or semi-rigid material, for example glass or plastic. The container portion may present a tubular shape. The container neck and/or the vial neck may present a tubular shape. The container neck may comprise an opening sealed with the cap. The cap may integrate a septum. The cap may for example comprise a casing. The casing may comprise a skirt portion configured for mounting and airtightly attaching the cap on the container neck and a substantially plane portion defining the top of the cap and presenting an aperture filled by the septum. The casing may maintain firmly the septum so as to close airtightly the aperture. The aperture and correspondingly the septum may present a generally disk shape and/or be located at the center of the top of the cap. The casing may be made of a rigid or semi-rigid material, for example metal (such as aluminum) or plastic. The skirt portion may present a shape complementary to the container neck, for example a tubular shape. The skirt portion may comprise a thread configured for screwing the cap on a corresponding thread of the container neck. Alternatively, the skirt portion may be configured for crimping the container neck airtightly. The container neck may for example comprise a circumferential bead forming a peripheral protuberance and the skirt portion may be metallic (e.g. in aluminum) and crimped on the bead.

The cap may further comprise a removable cover configured for protecting the septum and detachable before use of the vial.

The vial connection port 1022 may be configured for a direct connection and/or an indirect connection. In the direct connection case (represented on FIG. 1), the vial connection port 1022 may be mounted directly on the vial 1070. This simplifies the assembly. In the indirect connection case (not represented), the connection may be performed for example via an intermediate element mounted on the vial 1070, such as a vial converter. This allows using the same vial adaptor 1010 for connection to different types of vials. The vial converter may be mounted on the vial neck. A vial converter may notably allow using the same vial adaptor for different vial neck diameters, including diameters out of the range of a direct mounting of the vial connection port. A same vial connection port may be configured for both the direct type of connection and the indirect type of connection.

The vial connection port 1022 may define a vial connection axis. The mounting of the vial adaptor 1010 on a vial neck or on a vial converter may include a relative translational movement between the vial adaptor 1010 and the vial neck along said vial connection axis. The vial connection axis may be an axis along which the vial neck extends during the mounting, for example a central longitudinal and straight axis of the vial neck.

In examples, the vial connection port 1022 may optionally comprise a structure configured for the mounting on the vial 1070 or vial converter to be performed via attachment, for example via snapping. Such attachment structure may comprise clamp(s) and/or recess(es) configured for cooperating with corresponding structure of the vial or vial converter, for example the vial neck. The attachment and/or snapping may be performed by pressing the attachment structure of the vial adaptor 1010 onto the corresponding structure of the vial 1070 or vial converter along the vial connection axis.

The vial connection port 1022 may for example comprise a docking structure formed by the body portion 1020 of the vial adaptor 1010. The vial connection axis may be the central axis of the docking structure. The docking structure may present a shape adapted to the vial neck or vial converter, such that the vial neck or vial converter may be inserted inside the docking structure along the central axis of the docking structure, for example press-fitted inside the docking structure. The vial connection port 1022 may comprise one or more peripheral walls extending in a direction at least substantially parallel to the central axis of the docking structure and bounding the docking structure. The one or more peripheral walls may be configured for accommodating the vial neck or vial converter, for example as a skirt. The one or more peripheral walls may be configured for being fitted to the vial neck or vial converter. This allows the docking structure to encase the vial neck or vial converter and thus provides an easy and stable mounting of the vial adaptor. The docking structure may present a generally prism (e.g. cylindrical) shape. The vial connection port 1022 may in examples comprise a single peripheral wall delimiting the docking structure and presenting a rim delimiting entry of the docking structure. In alternative examples, the vial connection port 1022 may comprise several peripheral walls forming legs delimiting the docking structure.

The docking structure may present a diameter (i.e. largest dimension in a plane perpendicular to the central axis of the docking structure) higher than the diameter of the vial neck or vial converter. The diameter of the docking structure may for example be higher than the diameter of the cap of the vial 1070. The docking structure may be further shaped for the vial neck to be radially stable when inserted inside the docking structure. The docking structure may correspond to any standard provided for vials used in the medical industry.

The vial connection port 1022 may comprise a system for retaining the vial 1070 after connection to the vial, for example after insertion of the vial neck or vial converter inside the docking structure. The vial adaptor 1010 may be configured for connection of the vial connection port 1022 to the vial 1070 by pushing the vial adaptor 1010 onto the vial neck or vial converter such that the vial neck or vial converter is pressed and snapped inside the docking structure. One or more peripheral walls of the docking structure may for example comprise clamps extending inwardly toward the central axis of the docking structure. The diameter of the portion of the docking structure bounded by the clamps may be smaller than the diameter of the cap of the vial 1070 or top part of the vial converter. The one or more peripheral walls of the docking structure may present at least slight elasticity. The clamps may be configured for abutting the bottom edge of the skirt portion of the cap of the vial 1070 or top part of the vial converter after snapping, thereby acting as a system for retaining the vial 1070.

The vial connection port 1022 may comprise a piercing member having a tip configured for piercing the septum of the vial 1070 when the vial connection port 1022 is mounted on the vial neck. The septum of the vial may for example comprise an elastomeric material. The elastomeric material may be configured for deforming when punctured by the piercing member in such a way that the piercing member can pierce through the septum and the elastomeric material forms an at least substantially airtight seal around the piercing member. The elastomeric material may for example comprise rubber, such as silicone rubber and/or butyl rubber. The piercing member may have a length configured for the tip of the piercing member to go beyond the septum and be inside the vial when the vial connection port 1022 is mounted on the vial neck or vial converter.

When the vial connection port 1022 comprises a docking structure for insertion of the vial neck or vial converter inside the docking structure, the piercing member may for example extend in the docking structure in a direction parallel to the central axis of the docking structure, for example from the bottom face of the docking structure and toward the vial 1070. The piercing member may for example extend substantially from the center of the bottom face of the docking structure and/or substantially along the central axis of the docking structure.

The piercing member may comprise or consist of one or more spikes. The spike(s) may comprise a pointed tip. The spike(s) may be rigid or semi-rigid. The spike(s) may be integrally formed and/or in the same material as the body portion of the vial, for example in plastic. The piercing member may alternatively or additionally comprise one or more needles. The needle(s) may be metallic. The needle(s) may be integrated to the body portion 1020 of the vial adaptor 1010. In examples, the piercing member may comprise one or more (e.g. plastic) spikes (each) embedding (i.e. coating) one or more (e.g. metallic) needle(s). In other examples, the piercing member may comprise or consist of one or more uncoated needles. A needle may be relatively easy to manufacture, for example relative to a thin hollow spike.

Alternatively or additionally to such piercing member, the vial connection port 1022 may comprise one or more orifices configured for passage of a separate piercing component, such as a hollow needle. The one or more orifices may in examples be formed on a surface of the vial connection port 1022 facing the vial 1070, e.g. on the bottom face of the docking structure of the vial connection port 1022, and/or aside the piercing member if any.

The access passageway 1026 is a conduct structure enabling connection between the vial connection port 1022 and the syringe connection port 1024 so as to allow fluid communication between the vial 1070 and the syringe 1090. The regulation passageway 1028 is a conduct structure connected to the vial connection port 1022 and allowing establishment of fluid communication between the vial 1070 and the chamber 1040. The regulation passageway 1028 may for example connect airtightly the vial connection port 1022 to at least one opening 1282 formed on the body portion 1020, said opening 1282 defining a respective upper extremity 1282 of the regulation passageway 1028 (relative to the vial 1070 considered supported on a horizontal plane). The vial adaptor 1010 may be configured for establishment of fluid communication between said opening 1282 and the chamber 1040. The access passageway 1026 and the regulation passageway 1028 may be disconnected, i.e. without any fluid communication therebetween. The access passageway 1026 and/or the regulation passageway 1028 may each consist of one or more linear conducts (i.e. without any manifold), for example straight conducts.

In case the vial connection port 1022 comprises a piercing member configured to pierce the vial septum, the piercing member may integrate an extremity portion of the access passageway 1026 and/or an extremity portion of the regulation passageway 1028. Each such passageway (1026 and/or 1028) extremity portion may form a respective opening on the tip of the piercing member so as to allow fluid communication between the passageway and the vial when the piercing member has pierced the septum of the vial. The tip of the piercing member and thereby the openings may indeed be inside the vial at that time. In examples, the vial connection port 1022 may in examples comprise a piercing member which integrates only an extremity of the regulation passageway 1028. In particular configurations of such examples, the access passageway 1026 may form a conduct between the syringe connection port 1024 and an aforementioned orifice configured for passage of a separate piercing component. In such configurations, the vial adaptor 1010 may be configured for insertion of a hollow needle (e.g. of the syringe adaptor 1080) inside the access passageway 1026, the hollow needle coming out of said orifice so as to pierce the vial septum and access content of the vial 1070.

In examples, the piercing member may comprise a single spike integrally formed so as to comprise several lumens forming the respective portions of the access passageway and of the regulation passageway (and in examples only these two lumens). In other examples, the piercing member may comprise several spikes, one spike being integrally formed so as to comprise a lumen forming the extremity portion of the access passageway (and in examples only this one lumen), and another distinct spike being integrally formed so as to comprise a lumen forming the extremity portion of the regulation passageway. In other examples, the piercing member may comprise one or more spikes integrally formed so as to each embed one or more hollow needles, the inside of the hollow needles forming the passageway extremity portions. In yet other examples, the piercing member may consist of several uncoated hollow needles. In other examples, the piercing member may consist of a needle integrated in the vial adaptor 1010 and protruding out of the body portion 1020 into the skirt of the vial connection port 1022. The access passageway 1026 may comprise an orifice within the vial adaptor body portion 1020. Said lumen may be configured to guide a needle being removably insertable through the vial adaptor 1010 from the syringe adaptor 1080.

In examples, the body portion 1020 may comprise or consist of an extremity section forming the vial connection port 1022, another extremity section forming the syringe connection port 1024, and a central section between the two extremity sections. The body portion 1020 may present an elongate shape and its sections may extend along a (e.g. straight) central axis of the body portion 1020. The vial connection axis may be the central axis of the body portion 1020. One or more (e.g. all) sections of the body portion may present a generally prism (e.g. cylindrical) outer shape. Such examples of the body portion 1020 are relatively simple to manufacture and relatively compact.

In such examples, the vial connection port 1022 may comprise a docking structure as earlier-described. The central axis of the docking structure may be the central axis of the body portion 1020. The vial connection port 1022 may further comprise a piercing member as earlier-described, such as an integrally formed spike comprising several lumens or embedding several hollow metallic needles. The piercing member may extend at least substantially parallel to and/or along the central axis of the docking structure. The syringe connection port 1022 may comprise an opening as earlier-described. The opening may be formed on the tip of a tubular member of the body portion 1020 as earlier-described. The central axis of the opening and/or of the tubular member may be the central axis of the body portion 1020. The access passageway 1026 may be at least substantially straight. The access passageway 1026 may extend at least substantially along the central axis of the body portion 1020, for example between the opening of the syringe connection port 1024 and the tip of the piercing member. In the case of a docking structure and an opening, the docking structure and the opening may be oriented in opposite directions of the central axis of the body portion. The body portion 1020 thereby allows mounting the vial adaptor 1010 on a vial neck or vial converter by plugging the vial neck or vial converter inside the docking structure along the central axis of the body portion 1020, and (e.g. then) mounting the syringe adaptor 1080 on the syringe connection port 1024 along the same central axis of the body portion 1020. The syringe adaptor 1080 may be mounted on the syringe connection port 1024 after or before the syringe adaptor 1080 is assembled to a syringe 1090.

The regulation passageway 1028 may extend from the vial connection port 1022 to one or more openings 1282 formed on the body portion 1020 and each defining an upper extremity 1282 of the regulation passageway 1028 (relative to the vial 1070 considered supported on a horizontal plane). Each opening 1282 defining an extremity of the regulation passageway 1028 may be formed on a wall of the body portion 1020, for example on a (e.g. peripheral) wall of the central section. A first axial portion of the regulation passageway 1028 may for example extend from the tip of the piercing member at least substantially along the central axis of the body portion 1020 (and thus for example parallel to and/or aside a first portion of the access passageway 1026). The regulation passageway 1028 may further present one or more second radial portions in the central section each extending toward a (e.g. peripheral) wall of the central section. The access passageway 1026 may further comprise a second portion extending longitudinally in the central section to the syringe connection port 1024). The regulation passageway 1028 may for example present only one such second portion. The first portion and/or the second portion(s)

of the regulation passageway 1028 may be at least substantially linear. The second portion(s) of the regulation passageway 1028 may form an angle with the first portion of the regulation passageway 1026, for example an at least substantially right angle. Such examples of the body portion 1020 are relatively simple to manufacture and stable in use.

In such examples, the central section of the body portion 1020 and/or the syringe connection port 1024 section may present a diameter substantially equal or lower than the diameter of the vial connection port 1022 section. This allows keeping the body portion 1020 compact. Notably, the vial connection port 1022 section may present a diameter equal or higher than a minimal value required by the docking structure. The syringe connection port 1024 section may present a diameter of the order of the diameter of the central section. This allows inserting the body portion via the syringe connection port 1024 section inside a hollow portion of a coupling portion such as a sleeve portion, for example by press-fitting and/or snapping. The "diameter" of a section may refer to the length of the largest segment of said section contained in a plane perpendicular to the central axis of the body portion 1020. The body portion 1020 may thus generally present a shape which becomes more and more slender from the vial connection port 1022 toward the syringe connection port 1024.

In examples, the vial connection port 1022, the syringe connection port 1024, the access passageway 1026, the regulation passageway 1028, the syringe adaptor 1080, the syringe 1090, and/or the vial 1070 may optionally present any other feature or combination of features discussed in WO 2005/041846 A2 which is incorporated herein by reference in this respect, in particular with reference to the description of the syringe adaptor and vial adaptor on pages 20 to 24.

The chamber 1040 is configured to be in fluid communication with the vial via the regulation passageway 1028, for example through operation of the syringe 1090. The chamber 1040 thereby defines an inside space available for containing gas and/or liquid and for exchanging such gas and/or liquid with the vial 1070. The chamber 1040 may thereby be configured for the exchange to operate regulation of pressure inside the vial 1070 (e.g. equalization with ambient pressure) when adding and/or removing gas and/or liquid to and/or from the vial 1070 via the access passageway 1026, or when piercing a septum of the vial 1070.

The chamber 1040 is impermeable to gas and/or liquid. The chamber 1040 is thus capable of holding gas and/or liquid with at least substantially no leakage to the outside and/or no contamination from the outside, for example at least temporarily (e.g. for a minimal period of time). The minimal period of time may be higher than 7 days after manufacturing and seal-packaging the vial adaptor, for example 28 days. After the vial adaptor 1010 is removed from a sealed package, the minimal period of time may be shorter. The assembly of the syringe 1090, the vial adaptor 1010, and the vial 1070 (and optionally the syringe adaptor 1080 and/or vial converter) may form a closed fluid circulation system, i.e. with no or marginal fluid exchange with ambient air.

The chamber 1040 is expandable and contractible i.e. it has variable volume. The chamber volume is the volume of the inside space of the chamber 1040. The chamber is in other words configured for expanding and/or contracting (i.e. shrinking) to operate regulation of pressure inside the vial, for example upon the chamber 1040 being inflated and/or deflated. Thus, the chamber 1040 is configured for containing a variable volume of gas and/or liquid to operate said regulation, and for accordingly occupying more or less space depending on said volume of gas and/or liquid that the chamber 1040 contains. The space occupied by a physical object may be understood as the volume of the convex hull or of a concave hull of all 3D positions occupied by said physical object. The convex hull is the smallest convex set of 3D positions that comprises said all 3D positions occupied by said physical object. The concave hull may correspond to a predetermined concave hull determination scheme applied to said all 3D positions occupied by said physical object.

The housing 1050 is a structure of the vial adaptor 1010 casing the chamber 1040. The housing 1050 is distinct and separate from the chamber 1040. The housing 1050 is expandable. i.e. it has an increasable volume. The housing 1050 thereby defines an inside space available for being occupied by the chamber 1040. The housing volume is the volume of said inside space. In examples, substantially all the inside space of the housing 1050 is available for being occupied by the chamber 1040. The housing 1050 may comprise or consist of one or more portions made of rigid and/or semi-rigid material. The housing 1050 may for example comprise or consist of one or more components made of plastic, for example molded or injection-molded. The housing 1050 and the body portion 1020 of the vial adaptor 1010 may be separate components which are assembled. Alternatively, the housing 1050 may form at least a portion of the body portion 1020 and/or the body portion 1020 may form at least a portion of the housing 1050.

The housing 1050 shells the chamber 1040 during chamber volume variation. This means that during regular use of the vial adaptor, whichever the volume of the chamber (at least below a predetermined threshold), the housing 1050 envelopes the chamber 1040. By "enveloping", "shelling" or "casing", it may in examples be meant that the chamber is inside the housing. The housing 1050 thereby offers a protection barrier to the chamber 1040.

The housing 1050 is of variable volume. The housing 1050 is expandable. In examples the housing 1050 may also be contractible (i.e. compactable). The vial adaptor 1010 is accordingly expandable and/or compactable. Thus, the housing 1050 is configured for making available a variable volume of inside space to the chamber 1040, and for accordingly occupying more or less space depending on said volume of inside space made available to the chamber 1040, the vial adaptor 1010 accordingly occupying more or less space. This allows adapting the housing volume to required chamber volume. In other words, the housing volume may vary so that the housing 1050 always envelopes the chamber 1040 but stays as compact as possible. This may be applied to optimize space occupation of the vial adaptor 1010 with respect to the space occupied or needed to be occupied by the chamber 1040, as the space occupied by the vial adaptor 1010 corresponds to the space occupied by the housing 1050.

The housing volume varies from a minimal value to a maximal value (the maximal value being strictly higher than the minimal value). The maximal value of the housing volume may correspond to the predetermined threshold for the chamber volume. The housing 1050 may accordingly comprise a contracted state (i.e. compacted state) where the housing volume is equal to the minimal value, and an expanded state where the housing volume is equal to the maximal value. The housing 1050 may optionally comprise other intermediary states between the contracted state and the expanded state. The chamber 1040 may be configured to be expanded so as to occupy space of a volume higher than the minimal housing volume. When for any reason such expansion is required, the housing 1050 may accordingly expand from the contracted state to a different state, and the vial adaptor 1010 may accordingly expand and occupy more space. The chamber 1040 may be configured such that it is always possible to expand the chamber 1040 so as to occupy at least substantially all the inside space of the housing 1050. The maximal housing volume may correspond to a maximal volume contemplated for the chamber 1040.

The housing 1050 may comprise one or more apertures through which the inside space of the housing 1050 and thus the chamber 1040 is visible from the outside, at least at some point. The housing 1050 may for example form an expandable/contractible cage or basket enveloping the chamber 1040. The one or more apertures may simplify sterilization of vial adaptor 1010. In examples, the one or more apertures may be apparent in one or more states including the expanded state and/or excluding at least the contracted state.

Alternatively, the housing 1050 may comprise no such aperture and thereby always cover the chamber 1040. It is hereby meant that the inside space of the housing 1050 and thus the chamber 1040 is substantially never visible from the outside through an aperture. This provides a particularly high level of protection to the chamber 1040, since no portion of the chamber 1040 is ever accessible from the outside (at least directly or straightforwardly).

The housing 1050 may in examples be provided with a locking system to prevent volume variation of the housing 1050—which may for example be activated/deactivated manually.

One or more components of the housing 1050 may be made at least partly of a transparent material, for example a transparent plastic. This allows viewing the interior of the housing 1050 during use of the vial adaptor 1010, even in cases where the housing fully or substantially covers the chamber 1040.

The housing 1050 may comprise or consist of one or more housing units, each housing unit presenting a connected inside space. Each housing unit may be of variable volume and envelope a respective part of the chamber of variable volume. Volume variation of the housing unit(s) and respectively of the chamber part(s) may correspond to area variation of the outer surface of the housing unit(s) and respectively of the chamber part(s). Namely, when a housing unit and respectively a chamber unit is expanded (respectively contracted), the area of the outer surface of the housing unit and respectively of the chamber part correspondingly increases (respectively decreases).

The housing 1050 and/or the chamber 1040 may each comprise one or more moving portions (e.g. relative to the body portion), the movement of which corresponding to volume variation of the housing 1050 and/or the chamber 1040. The one or more moving portions of the housing 1050 may notably form a moving boundary between the inside space of the housing 1050 and ambient air, with no other structure and/or vent compartment between the inside space of the housing 1050 and ambient air.

The housing 1050 may comprise a system for exerting a force to retain the housing 1050 in the contracted state so that the housing 1050 does not expand upon mere action of gravity. The housing 1050 may additionally or alternatively comprise a system for exerting a force to impart contracting to the housing 1050 when there is no opposed resistance such that the housing 1050 naturally comes back to the contracted state, for example when the chamber 1040 is shrunk. Such a system may for example comprise a spring. The force may be low enough not to prevent or be a disturbance to expansion of the chamber 1040 when needed. Alternatively, the housing 1050 may comprise no such system to impart contracting to the housing 1050, such that once the housing 1050 expands to a non-contracted state, the housing 1050 may stay in said non-contracted state even if the chamber 1040 is shrunk. In examples the housing 1050 may be held such that action of gravity puts the housing 1050 back to the contracted state In other examples, the housing 1050 may comprise a mechanism preventing said action of gravity such that the housing 1050 stays in the expanded state (e.g. unless the mechanism is manually deactivated).

The chamber 1040 may in examples be configured for imparting expansion to the housing 1050 (and thereby to the vial adaptor 1010). In other words, upon the chamber 1040 expanding, for example upon the chamber 1040 being inflated, the chamber may occupy substantially all the inside space of the housing 1050. The chamber 1040 may comprise, upon the chamber expanding, one or more moving portions (e.g. relative to the body portion 1020 and/or e.g. membranes such as sheets) which enter into contact each with a respective moving portion of the housing 1050 (e.g. relative to the body portion 1020 and/or e.g. walls of the housing 1050), and upon the chamber 1040 continuing to expand, each moving portion of the chamber 1040 may press said moving portion the housing 1050 outwardly. In examples, the whole chamber 1040 moves when it expands. The housing 1050 may be configured for expanding and for making the vial adaptor 1010 occupy more space upon such pressing. This means that the housing 1050 does not present a resistance forbidding such chamber-imparted expansion. This increases ergonomics of use of the vial adaptor, since the vial adaptor 1010 may be provided and connected to a vial in a compacted state, and then automatically expand upon use, without any manual intervention. Alternatively or additionally, the housing 1050 may be manually expandable.

Examples of use of the vial adaptor 1010 are now discussed.

Use of the vial adaptor 1010 may comprise initially providing the vial adaptor 1010 and a vial 1070, and then connecting the vial adaptor 1010 to the vial 1070 (optionally via a vial converter) in order to later operate a syringe 1090 and extract (i.e. draw) content from the vial 1070 into the syringe 1090 for administration to a patient, for example via perfusion and/or injection. The syringe 1090 may be provided and connected to the vial adaptor 1010 any time before its operation, optionally via a syringe adaptor 1080. At least at some point before the extraction, the vial 1070 may be filled with fluid content (e.g. liquid). The vial 1070 may be substantially fully filled with such fluid content. The vial 1070 may present a capacity higher than 1 mL, 10 mL or 20 mL and/or lower than 500 mL, 200 mL or 100 mL. The capacity may for example correspond to any standard provided for vials used in the medical industry, and for example be between 1 mL and 200 mL, e.g. equal to 50 mL. The extraction may be performed at a single time or alternatively at several times, depending on the medical application. The vial adaptor 1010 may be kept connected to the vial 1070 during the whole extraction process. In other words, the vial adaptor 1010 may stay connected to the vial 1070 until the whole content of the vial 1070 is extracted. This facilitates user operations.

The following discusses examples of how the vial adaptor 1010 and the vial 1070 are initially provided, before connection of the vial adaptor 1010 to the vial 1070.

The vial adaptor 1010 may be initially provided prepared for a vial 1070 having content in fluid form, for example as a liquid. The content of the vial 1070 may in such a case be ready for extraction. The vial adaptor 1010 may for example be initially provided with a positive volume of gas contained in the chamber 1040, for example the maximal volume of gas allowed by the initially provided state of the housing 1050. In other words, the vial adaptor 1010 may be provided with the chamber 1040 not shrunk, at least not completely. The gas initially contained in the chamber 1040 may be cleaned and/or sterilized gas, for example cleaned and/or sterilized air. This allows using the vial adaptor 1010 to extract the content of the vial 1070 directly, and notably without having to inject gas with the syringe 1090 to inflate the chamber 1040 in order to prepare for regulation. The initial presence of a positive volume of gas in the chamber 1040 thereby simplifies situations of direct use of the content of the vial 1010, by coming already prepared for pressure regulation.

The vial adaptor 1010 may alternatively or additionally be initially provided prepared for a vial 1070 having content in soluble solid form, for example as a powder. The content of the vial 1070 may in such a case require reconstitution before being used. In other words, the content of the vial 1070 may be in a state where addition to the vial 1070 of liquid with a syringe 1090 is needed in order to reconstitute a solution ready for use in the vial 1070. The vial adaptor 1010 may for example initially be provided with the housing in a state different from the expanded state, for example in the contracted state. Upon the reconstitution, the housing 1050 and the vial adaptor 1010 may expand as the chamber 1040 expands due to the reconstitution. The chamber 1040 being expanded after reconstitution, the content of the chamber 1040 then allows performing pressure regulation when later extracting reconstituted content from the vial 1070, such that the vial adaptor 1010 may be left connected to the vial 1070 after the reconstitution and used for such later extraction.

In examples where the vial adaptor 1010 is initially provided with a positive volume of gas contained in the chamber 1040, said volume may be equal or higher than the vial capacity. The chamber 1040 may be configured such that it is always possible to fully shrink the chamber 1040 (i.e. until the chamber volume is substantially zero). In such a case, the volume of gas initially contained in the chamber 1040 may be substantially equal to the vial capacity. This offers space optimization capability to the vial adaptor 1010. Notably, the vial adaptor 1010 may initially be provided in a state where the chamber 1040 fully occupies the inside space of the housing 1050. Such a state may be the contracted state. This optimizes space while allowing simplified direct use of the content of the vial 1070.

In examples where the vial adaptor 1010 is initially provided in a state different from the expanded state, for example in the compacted state, the vial adaptor 1010 may be configured for the chamber 1040 to receive during use (e.g. during reconstitution) a volume of gas equal or higher than the vial capacity (e.g. in addition to the volume of gas initially provided if any). This receivable volume of gas may be substantially equal to the vial capacity. This optimizes space while allowing reconstitution of vial content so as to fill the vial 1070 if needed.

In examples, the vial adaptor 1010 may be initially provided prepared for being used both with vials initially provided with content in fluid form and with vials initially provided with content in soluble solid form. The vial adaptor 1010 may initially be provided in the compacted state and with the maximal volume of cleaned and/or sterilized gas contained in the chamber 1040 allowed by the compacted state. Said volume of gas may be equal or higher than any predetermined vial capacity, for example corresponding to any standard provided for vials used in the medical industry (e.g. higher than 1 mL, 10 mL or 20 mL and/or lower than 500 mL, 200 mL or 100 mL, e.g. between 1 mL and 200 mL e.g. equal to 50 mL). The vial adaptor 1010 may be further configured for the housing volume to at least double when the housing 1050 is expanded, such that the chamber volume may also at least double. Such a vial adaptor 1010 may be used with both types of vials while optimizing space when initially provided. The compacted state may be such that the corresponding maximal chamber volume is lower than 1.5 or 1.1 times the vial capacity, and for example substantially equal to the vial capacity. Alternatively or additionally, the expanded state may be such that the corresponding maximal chamber volume is lower than 2.5 or 2.1 times the vial capacity, and for example substantially equal to twice the vial capacity. This allows yet optimizing space with respect to a predetermined vial capacity by not providing for unnecessarily large compacted and/or expanded state of the housing for said predetermined vial capacity.

The vial adaptor 1010 may be initially provided in a package, for example a sealed package. The vial adaptor 1010 and any gas contained in the chamber 1040 or in the package may be cleaned and/or sterilized before packaging. The vial adaptor 1010 may in such a case be removed from the package and connected to a vial 1070 for any of the above use examples.

A cleaned gas is a gas that has been filtered by a filter to remove particles and/or viable micro-organisms to such an extent that the gas is classified to be aseptic and accepted by the relevant authority and/or any standards. The degree of purity can be expressed in the largest particles allowed to pass the filter for a given flow rate of gas. In examples no or very few particles having a size exceeding 5 μm are allowed to be present in the cleaned gas. However, the allowed particle size is determined by the requirements in the current application. Some drug treatments require that substantially all particles having a size exceeding 0.15 μm are removed from the gas by the particulate air filter. As an example, a filter with the mesh size 0.2 μm can be used to remove substantially all particles and micro organisms of that size or larger. A sterilized gas is a gas that has been subjected to a sterilization method to remove viable micro-organisms. The sterilization method may be a standard method known in the art. For example, current regulations in Europe for medical devices to be designated "STERILE" may be found in standards "ETO:ISO 11135:2014" and "ETO/ECH:ISO 10993-7:2008". Other regulations may exist in other countries. The sterilization can be ethylene oxide sterilization, sterilization by irradiation, or (moist) heat sterilization or any other accepted method. The European standard requirements imply that the theoretical probability of there being a viable micro-organism present on/in the sterilized device shall be equal to or less than $1\times10^{-6}$. In the case a gas is sterilized, it is not always necessary to clean the gas according to the cleaning process as described above, although such cleaning and the sterilization can be combined. However, other methods can be used to remove particles from the gas if required or the sterilization process itself may be sufficient to bring the gas into a state where the gas is to be considered as both cleaned and sterilized.

In examples, the vial adaptor 1010 may be packaged (and thus come out when it is removed from the package) as discussed above, that is in a state different from the expanded state, for example in the compacted state, and/or with a positive volume of cleaned and/or gas contained in the chamber 1040, for example the maximal volume of gas allowed by the compacted state. The vial adaptor 1010 and/or the package may in examples further comprise a piece of information (e.g. an inscription, for example comprising text) indicating a vial capacity (and corresponding to the maximal vial capacity for which the vial adaptor 1010 is intended to be used). In such a case and as earlier-described, the volume of gas initially contained in the chamber 1040 may be substantially equal or higher than said indicated vial capacity and/or the vial adaptor 1010 may be configured for the chamber 1040 to receive during use (e.g. during reconstitution) a volume of gas substantially equal or higher than said indicated vial capacity. This makes operations of the vial adaptor 1010 for the user more ergonomic.

In examples, the vial connection port 1022 of the body portion 1020 may form a protuberance on the vial adaptor 1010 at least in states different from the expanded state, for example in the compacted state. The protuberance may extend along the vial connection axis. This simplifies connection to a vial 1070 when the vial adaptor 1010 is in such states. Alternatively, the vial connection port 1022 may never form such protuberance. This allows having the vial adaptor 1010 relatively more compact, notably in the compacted state.

Different examples of the vial adaptor are now discussed.

The chamber 1040 may comprise or consist of at least one flexible and/or elastic portion. Such a portion may be made of flexible and/or elastic material delimiting the chamber volume. The chamber 1040 may form an inflatable/deflatable balloon and/or comprise a foldable bladder or diaphragm delimiting an inflatable/deflatable volume. In such cases, the presence of the housing 1050 is particularly relevant, since the chamber 1040 is relatively fragile in such examples.

By "flexible" material it is hereby meant a material that can be deformed so as to be folded. The chamber 1040 may thus comprise at least one foldable portion, which is folded notably when the housing 1050 is in the compacted state. The foldable portion may be made of a foldable material. Contrary to a rigid or semi-rigid material, a flexible material may form a surface which may be significantly folded (i.e. not only slightly), for example at least above 10° or 45°. By "elastic" material it is hereby meant a material that can be deformed by application of a force and that tends to return to its original shape when application of the force stops. The flexible and/or elastic portion of the chamber 1040 may thus be deformed as the chamber 1040 expands or contracts in accordance with chamber volume variation.

The flexible and/or elastic portion may comprise at least one sheet. The sheet may comprise a single material layer or a laminate of several material layers. A sheet is relatively easy to manufacture. A sheet may notably be vacuum-formed. In other words, a sheet may be given a 3D surface shape by providing a—e.g. plastic—planar sheet and vacuum forming the sheet with an adequate mold (e.g. including placing the planar sheet above the mold in a vacuum former, heating the planar sheet, and/or pumping air), and then optionally performing one or more perforations on the sheet.

Furthermore, the chamber 1040 may be welded on one or more other components of the vial adaptor. The chamber 1040 may thus not be integrally formed with the other components, but assembled thereto afterwards. The welding ensures airtightness. In case the chamber 1040 comprises a sheet, such welding may be performed relatively easily at an edge of the sheet. The sheet may for example comprise at least one peripheral edge welded peripherally to another component including a peripheral zone appropriate for such welding (for example a peripheral edge such as a rim). The welding of an edge of a sheet to another object may be performed via an intermediary component, such as a stiffening component (e.g. a stiffening ring used for a circular peripheral edge of a sheet). The use of a sheet thereby yet facilitates the manufacturing of the vial adaptor 1010.

The flexible and/or elastic portion may in particular comprise or consist of two sheets welded together. The sheets may be welded at respective edges. This allows predefining an expansion direction to the chamber 1040 and avoids flipping operations in cases of one single sheet. In examples, the two sheets may each have a generally annulus shape (i.e. a two-dimensional manifold shape topologically equivalent to an annulus). Such annulus shapes are particularly easy to manufacture. The two sheets may also be sized such that they may be superposed with their respective external edges one on the other. This way, the two sheets may be welded at their respective external edges. The free internal edges of the two sheets may then be welded on one or more other parts of the vial adaptor 1010. The edges of the annulus shapes may be peripheral and/or present ring shapes. The welding of each such ring shapes may be performed via a stiffening ring. The space between the two sheets then constitutes the inside space of the chamber 1040. Such a manufacturing is relatively easy to perform.

The chamber 1040 may be generally configured to unfold, unroll, expand, contract, inflate, deflate, compress, and/or decompress. The chamber 1040 may comprise any one of a wide variety of flexible and/or expandable materials. In examples, the chamber 1040 may comprise polyester, polyethylene, polypropylene, saran, latex rubber, polyisoprene, silicone rubber, vinyl, polyurethane, or other materials. In examples, the chamber 1040 may comprise a material having a metal component to further inhibit fluid (including gas or air) leakage through the material of the bag, e.g., metalized biaxially-oriented polyethylene terephthalate (also known as PET and available under the trade name Mylar®. In examples, the chamber 1040 may comprise a laminate. For example, the chamber 1040 can be constructed of a layer of 0.36 Mil (7.8#) metalized (e.g., aluminum) PET film and a layer of 0.65 Mil (9.4#) linear low-density polyethylene. In examples, the chamber 1040 may comprise a material capable of forming a substantially airtight seal with any material it is welded on. In examples, the chamber 1040 may be transparent or substantially transparent. In other examples, the chamber 1040 may be opaque. In examples, the chamber 1040 may comprise a material that is generally impervious to liquid and air. In examples, the chamber 1040 may comprise a material that is inert with respect to the intended contents of the vial 1070. For example, the chamber 1040 may comprise a material that does not react with certain drugs used in chemotherapy. In examples, the chamber 1040 may comprise latex-free silicone having a durometer that is between about 10 and about 40. In examples, the chamber 1040 may comprise a coating. In examples, the chamber 1040 may comprise a coating that reduces the porosity of the chamber. In examples, the coating may be evaporated aluminum or gold. In examples, the coating includes a water soluble plastic configured to form a barrier to inhibit passage of gases thereacross. In examples, the coating may be applied to the outside of the chamber. In other examples, the coating may be applied to the inside of the chamber 1040. In examples, the coating may be applied to the inside and the outside of the chamber 1040. In examples, the coating is a polyolefin.

The housing 1050 may comprise at least two portions configured for sliding one with respect to the other, for example one over the other. The sliding may correspond to volume variation of the housing 1050. In other words, when the housing 1050 expands or contracts (i.e. is compacted), said at least two portions of the housing 1050 correspondingly slide one with respect to the other. Inversely, when said at least two portions of the housing 1050 slide one with respect to the other, the housing 1050 correspondingly expands or contracts. After connection of the vial adaptor 1010 to a vial 1070, one of the two sliding portions may in examples be fixed relative to the body portion 1020 and/or to the vial and the other one may move relative to the body portion 1020 and/or to the vial 1070 upon the sliding. The sliding may be translational and/or rotational. In particular examples, at least one face of one portion may be configured to slide against a corresponding face of the other portion. In examples, one of the faces may comprise one or more grooves configured for cooperating with corresponding one or more guides of the other face. Such a housing 1050 allows volume variation which optimizes space. The housing 1050 may alternatively comprise a flexible portion, e.g. forming a bellow.

The sliding may be performed according to two configurations. A first configuration may correspond to the housing 1050 expanding and a second configuration may correspond to the housing 1050 being compacted. When the housing 1050 is in a state different from the expanded state, expansion of the chamber 1040 may impart the first configuration of sliding to the housing 1050 toward (e.g. until) the expanded state. When the housing 1050 is in a state different from the contracted/compacted state and the chamber 1040 does not occupy substantially all the inside space of the housing 1050, the second configuration of sliding may be imparted to the housing 1050 toward (e.g. until) the contracted/compacted state, for example manually.

The housing 1050 may be telescopic (and thereby comprise at least two portions configured for telescopically sliding one with respect to the other). In other words, the housing 1050 may comprise telescopic units each comprising telescopic section. Each telescopic section fits another telescopic section such that the telescopic sections slide one with respect to the other, as earlier-described, for example one into the other. These two telescoping sections may be open on one end facing each other and define an inside space available to be occupied by the chamber. The telescopic movement thereby corresponds to expansion/compacting of the housing 1050. The two telescopic sections may be closed at the other end. The fitting may be performed via snapping.

In examples, the housing 1050 may comprise or consist of a cover and a bowl, the cover and the bowl each including a respective telescopic section cooperating together. In examples, the telescopic section of the bowl may be configured to slide into the telescopic section of the cover. The housing 1050 may thus present a compact shape. In examples, the cover may be fixed and the bowl may be mobile relative to the body portion 1020 and/or to the vial 1070. The bowl may be located between the cover and the vial after connection of the vial adaptor to a vial. The assembly may thus present a compact shape.

Examples of arrangement of the housing 1050 and/or of the chamber 1040 relative to the body portion 1020 are now discussed.

The housing 1050 and/or the chamber 1040 may surround the vial connection axis. This means that the housing 1050 and/or the chamber 1040 is formed all around the vial connection axis, such that the inside space of the housing 1050 and/or the inside space of the chamber 1040 completely loops around the vial connection axis. Yet in other words, the housing 1050 and/or the chamber 1040 are formed peripherally to a section of the vial connection axis. Optionally, the shape of at least one of the housing 1050, of the chamber 1040, of the inside space of the housing 1050, and/or of the inside space of the chamber 1040 may generally present a symmetry of revolution around the vial connection axis. In examples, the inside space of the housing 1050 and/or of the chamber 1040 may generally present a toroid shape. Alternatively or additionally, the shape of the housing 1050, of the chamber 1040, of the inside space of the housing 1050, and/or of the inside space of the chamber 1040 may generally present an axial symmetry relative to the vial connection axis. Such examples of arrangements provide a vial adaptor 1010 relatively easy to connect to a vial 1070 and an assembly relatively well-balanced once the connection is made, since the major weight of the vial adaptor is adequately allocated around the vial connection axis.

Alternatively or additionally, the housing 1050 and/or the chamber 1040 may surround at least a section of the body portion 1020. This means that the housing 1050 and/or the chamber 1040 is formed all around said section of the body portion 1020, such that the inside space of the housing 1050 and/or of the chamber 1040 completely loops around said section of the body portion 1020. Yet in other words, the housing 1050 and/or the chamber 1040 are formed peripherally to said section of the body portion 1020. Optionally, the shape of at least one of the housing 1050, of the chamber 1040, of the inside space of the housing 1050, and/or of the inside space of the chamber 1040 may generally present a symmetry of revolution around a central axis of said section of the body portion 1020. In examples, the inside space of the housing 1050 and/or the inside space of the chamber 1040 may generally present a toroid shape. Alternatively or additionally, the shape of the housing 1050, of the chamber 1040, of the inside space of the housing 1050, and/or of the inside space of the chamber 1040 may generally present an axial symmetry relative to the central axis. Such examples of arrangements provide a vial adaptor 1010 relatively compact, since the major weight of the vial adaptor 1010 is adequately allocated around a section of the body portion 1020.

Examples of how the housing 1050 and/or the chamber 1040 may achieve volume variation are now discussed.

The vial adaptor 1010 may be configured for the housing 1050 and/or the chamber 1040 to achieve volume variation uniformly around the vial connection axis. In other words, as the housing 1050 and/or the chamber 1040 achieve volume variation by expanding or contracting (i.e. being compacted/shrunk), volume increases or decreases generally uniformly around the vial connection axis. Yet in other words, the spatial distribution of volume increase or decrease generally presents a symmetry of revolution relative to the vial connection axis. In case the housing 1050 and/or the chamber 1040 presents a symmetry of revolution or an axial symmetry as mentioned above, the housing 1050 and/or the chamber 1040 may always present such symmetry, that is, at any state of the expansion or compacting/shrinking. If the housing inside space and/or the chamber inside space present a toroid shape, then the vial adaptor 1010 may be configured for the housing inside space and/or the chamber inside space to always present said toroid shape, that is whichever the value of the housing volume and/or the chamber volume.

Such uniform variation provides a vial adaptor 1010 relatively compact and always well-balanced, even during volume variation.

Alternatively or additionally, the vial adaptor 1010 may be configured for the housing 1050 and/or the chamber 1040 to achieve volume variation substantially longitudinally (i.e. along a straight direction), for example at least substantially parallel to the vial connection axis. In other words, the housing 1050 and/or the chamber 1040 are configured to be expanded or compacted/shrunk at least mostly along said direction. Notably, when the housing 1050 comprises portions configured for sliding one with respect to the other, at least two such portions (e.g. all) may be configured to achieve such relative sliding in said direction. In examples, with respect to a vial vertically held and the vial adaptor connected thereto, the vial adaptor 1010 may be vertically expandable, for example via vertical telescopic sliding. This provides a vial adaptor 1010 relatively stable and compact after connection to a vial 1070, even during volume variation, since angular protuberances relative to the vial connection axis are avoided.

Alternatively or additionally, the vial adaptor 1010 may be configured for the housing 1050 and/or the chamber 1040 to achieve expansion (fully) in an orientation toward the vial. Such orientation is downward when the vial 1070 is positioned vertically with its neck oriented upward, the vial 1070 for example standing on a horizontal support e.g. on a table or workplan, for example to reconstitute its content. In such a case, the vial adaptor 1010 may be configured for the housing 1050 and/or the chamber 1040 to achieve compacting/shrinkage again downward after the vial 1070 is later handled by a user and held upside down, for example to extract its content. In examples, with respect to a vial vertically held with its neck oriented upward and the vial adaptor connected thereto, the vial adaptor 1010 may be downwardly expandable, for example via downward telescopic sliding. Such a vial adaptor 1010 is thus well-balanced and particularly ergonomic at all phases of its use, and the assembly with the vial stays compact and thus relatively easy to manipulate.

In examples, the housing 1050 and/or the chamber 1040 may surround a section of the body portion 1020 which extends along the vial connection axis, for example a central section of the body portion 1020. As earlier-described, the body portion 1020 may present an elongate shape and its sections may extend along a central axis of the body portion 1020 which also defines the vial connection axis. In such a case, the housing 1050 and/or the chamber 1040 may surround at least a section of the body portion 1020 as earlier-described, and for example be peripheral at least to the central section of the body portion 1020. Optionally, the inside space of the housing 1050 and/or the inside space of the chamber 1040 may generally present a toroid shape, e.g. substantially always. The vial adaptor 1010 may further comprise a central passage extending along a central axis and at least a section of the body portion (for example comprising the central section) may be arranged in the central passage, i.e. inserted or lodged therein along the central axis, e.g. press-fitted and/or snapped therein. The housing 1050 may consist of a bowl and a cover. The bowl and the cover may each comprise a respective telescopic section extending along the vial connection axis and surrounding the vial connection axis. Expansion of the housing 1050 and/or of the chamber 1040 may be performed toward the vial 1070. This provides a particularly compact and ergonomic vial adaptor 1010, for example presenting a general compact revolution shape formed around the body portion 1020 and expandable longitudinally in the direction of the body portion 1020 toward the vial 1070.

In such examples, the inside space of the telescopic sections may form the inside space of the housing 1050. The telescopic sections may each comprise a respective external wall defining a boundary between the inside space and ambient air. Optionally, one or both telescopic sections may further comprise a respective external wall defining a boundary between the inside space and the central passage. Alternatively, the inside space may be delimited by the body portion itself. The respective external walls may be configured for sliding one with respect to the other. The optional internal walls may be configured for sliding one with respect to the other. The telescopic sections may be configured for translational sliding one with respect to the other, parallel to the vial connection axis. In case one or both telescopic sections comprise internal walls, the central passage may be within the space delimited by said internal walls.

Examples of cooperation between the body portion 1020 and the housing 1050 and/or chamber 1040 are now discussed.

The body portion 1020 may be assembled in the vial adaptor 1010 via press-fitting and/or snapping. In case of a central passage, the body portion 1020 may be press-fitted and/or snapped inside the central passage, or alternatively press-fitted and/or snapped to another component and then inserted inside the central passage, for example again via press-fitting and/or snapping said other component. The body portion 1020 and the housing 1050 may thus be separate components (i.e. not integrally formed). Furthermore, when the housing 1050 comprises a cover and a bowl, the cover may be fitted and/or snapped to the bowl, for example the bowl being fitted inside the cover or inversely. Such snapping may be configured for still allowing sliding of the bowl with respect to the cover. The cover and the bowl may comprise respective telescopic sections configured for being snapped one with the other, and to slide one with respect to the other after the snapping. Snapping steps allow a simple manufacturing. The chamber 1040 may be assembled via welding, for example as earlier-described, so as to ensure airtightness.

The vial adaptor 1010 may comprise a coupling portion separate from a central section of the body portion 1020. The coupling portion is a structure of the vial adaptor 1010 (for example of the housing 1050) which allows assembly of the body portion 1020 in the vial adaptor 1010. The vial adaptor 1010 may comprise an opening formed on the central section and defining an upper extremity 1282 of the regulation passageway 1028 (relative to the vial 1070 considered supported on a horizontal plane). The coupling portion may in such a case include a regulation port, and the vial adaptor 1010 is configured for establishing fluid communication between the regulation port and the upper regulation passageway opening 1282 and between the regulation port and the chamber 1040 by providing respective fluid paths. The coupling portion may in examples be fully separate from the body portion 1020. In alternative examples, the coupling portion may be integrally formed with a portion of the body portion 1020 (not including the central section).

The coupling portion constitutes an intermediate portion between the regulation passageway 1028 and the chamber 1040. The coupling portion may notably be separate from at least a part of the body portion which may wholly integrate the access passageway 1026 and the regulation passageway 1028. Such a part is relatively complex to manufacture, due to the passageways requiring to be formed with special care.

Such manufacturing may thus be rather dedicated to such a part and not involve any coupling consideration.

The coupling portion may comprise or consist of a single integrally formed component or of several integrally formed components made of rigid and/or semi-rigid material. The coupling portion may for example comprise or consist of one or more components made of plastic, for example molded or injection-molded. The regulation port may be formed on a wall of the coupling portion made in such materials. The regulation port may in examples consist of one or more apertures of a diameter inferior to 5 mm.

In examples, the coupling portion may form a passage and the central section of the body portion may be inserted and/or fitted in the passage, for example via press-fitting and/or snapping. The central section may in examples be press-fitted and/or snapped into any one or more components of the coupling portion which form the passage. The coupling portion may notably include a sleeve portion which forms the passage (inside the sleeve) and the central section of the body portion 1020 may be inserted internal said sleeve portion. The vial connection port 1022 and the syringe connection port 1024 may be arranged at opposite ends of the sleeve portion. The body portion 1020 may be elongated and inserted inside the sleeve portion via the syringe connection port 1022 as earlier-mentioned, for example until press-fitting and/or snapping such that the central section of the body portion 1020 is maintained inside the sleeve portion. The central section may in examples be press-fitted and/or snapped into the sleeve portion. Such insertion may occur during manufacturing after the sleeve portion is formed. The central section of the body portion 1020 may be surrounded by the sleeve portion after the assembly. The sleeve portion and the body portion 1020 may in examples be of a general prism (e.g. cylindrical) shape.

The chamber 1040 may be welded at a zone of the vial adaptor 1010 peripheral to the body portion 1020. This allows a relatively uniform inflating/deflating of the chamber 1040 around the central axis of the body portion 1020. The chamber 1040 may in examples comprise two peripheral edges each welded at a respective zone of the vial adaptor peripheral to the body portion 1020. The two peripheral welding zones may form between them a peripheral chamber gate (e.g. presenting an annulus shape). The chamber gate being peripheral to the body portion 1020, gas passes all around the body portion 1020 through the chamber gate in the chamber 1040 which surrounds the body portion 1020, so as to allow a uniform inflating/deflating.

In case the vial adaptor 1010 comprises a coupling portion including a sleeve portion, the chamber 1040 may be welded at a zone peripheral to the sleeve portion so as to surround the sleeve portion. In examples, the chamber 1040 may be welded at least partly on the coupling portion. In other examples, the chamber 1040 may be welded to other components (for example the cover) at a zone peripheral to the sleeve portion.

A first peripheral edge of the chamber 1040 may for example be welded on the coupling portion, and a second peripheral edge of the chamber 1040 may be welded on the coupling portion or at any other zone of the housing 1050, for example on any zone of the cover.

In case a first peripheral edge of the chamber 1040 is welded on a peripheral wall of the coupling portion, said peripheral wall may in examples form the internal wall of the telescopic section of the cover. In particular, the vial adaptor 1010 may comprise a vent passage between an edge of the internal wall and the cover. In examples of such a case, the first peripheral edge of the chamber 1040 may be welded on such vent-passage-delimiting edge of the internal wall of the cover. This maximizes occupancy of the inside space of the housing 1050 by the chamber 1040.

The second peripheral edge of the chamber 1040 may be welded at another zone of the coupling portion, for example at a zone (such as an edge) of the coupling portion integrally formed or welded to the sleeve portion or at any zone of the housing integrally formed to the sleeve portion. This allows avoiding any welding of a component of the coupling portion to the housing 1050. In alternative examples, the second peripheral edge may be welded at a zone of the housing 1050 separate from the sleeve portion, in such a case the vial adaptor 1010 may comprise a welding between the sleeve portion to the housing 1050 to ensure airtightness.

The regulation port of the coupling portion and the upper regulation passageway opening 1282 of the regulation passageway 1028 may in examples face each other. In cases where the coupling portion comprises a sleeve portion and the body portion is elongated and inserted inside the sleeve portion, the chamber 1040 may be peripheral to said sleeve portion and thus to the body portion 1020. The regulation port may be formed on an internal wall of the sleeve portion in cooperation with a peripheral wall of the body portion 1020, for example a peripheral wall of the central section of the body portion 1020. The upper regulation passageway opening 1282 may be formed on said peripheral wall and/or facing the regulation port.

The vial adaptor 1010 may in examples further comprise one or more filters arranged between the regulation passageway and the chamber 1040. One or more filters may be located anywhere between the regulation passageway and the chamber 1040, for example at the upper regulation passageway opening 1282, at the regulation port, and/or at another port formed on the housing and in fluid communication with the chamber. A filter may be arranged against any such opening or port, for example on the chamber side. The filter may allow cleaning air communicated between the chamber 1040 and the regulation passageway 1028 and/or at least reducing passage of liquid.

In examples, the filter may be chemically or mechanically held in position, e.g., by adhesive or a snap ring, or welded. Certain examples of the vial adaptor 1010 include a plurality of filters. In some examples, the filter is a hydrophobic membrane, which is generally configured to allow gases to pass therethrough, but to inhibit or prevent passage of liquids therethrough. In some examples, gases (e.g., sterilized air) are able to pass through the filter so as to move between the via and the bag, but liquid from the vial is blocked by the filter. Examples of the adaptor with the filter can therefore reduce the likelihood of liquid spilling from the vial even if the vial adaptor is detached. In examples, the filter can remove particles and/or contaminants from the gas that passes through the filter. For example, in examples, the filter may be configured to remove nearly all or about 99.9% of airborne particles 0.3 micrometers in diameter. In some examples, the filter may be configured to remove microbes. In examples, the filter comprises nylon, polypropylene, polyvinylidene fluoride, polytetrafluoroethylene, or other plastics. In some examples, the filter includes activated carbon, e.g., activated charcoal. In certain configurations, the filter comprises a mat of regularly or randomly arranged fibers, e.g., fiberglass. In some arrangements, the filter comprises Gortex® material or Teflon® material.

The upper regulation passageway opening 1282 may be formed on a wall of the body portion 1020, for example a peripheral wall of the central section of the body portion 1020. The vial adaptor 1010 may comprise a sealing member arranged against said wall and providing airtightness of the fluid communication between the regulation port of the coupling portion and the upper regulation passageway opening 1282. The wall of the body portion 1020 and the coupling portion are formed on separate components or formed by separate components. The body portion 1020 may for example comprise or consist of one or more components all separate from the coupling portion 1020. In such a case, the body portion 1020 and the coupling portion may be assembled such that fluid communication between the regulation port of the coupling portion and the upper regulation passageway opening 1282 is airtight. The sealing member provides a simple way of doing that in terms of manufacturing, notably compared to welding operations such as welding the walls of the body portion and of the coupling portion to create a sealed passage between them, such welding being particularly complex in such difficulty accessible zone. The sealing member may comprise or consist of one or more integrally formed components separate from the rest of the assembly and/or assembled to the rest of the assembly without any mechanical connection and/or without any welding.

The wall on which the regulation passageway opening 1282 is formed may cooperate with the coupling portion, and for example present a shape complementary to the coupling portion (e.g. the central section being fitted internal a sleeve portion of the coupling portion). The sealing member may in such a case be arranged against the wall and against the coupling portion. In case the coupling portion comprises a sleeve portion and the body portion 1020 is elongated and inserted (e.g. fitted) inside the sleeve portion, the sealing member may be sandwiched by the peripheral wall of the body portion 1020 and the internal face of the sleeve portion, or alternatively sandwiched by the peripheral wall of the body portion 1020, an edge of the sleeve portion and one or more other components.

The sealing member may comprise elastic material, such as an elastomeric material (e.g. rubber). The sealing member may in such examples be pressed against and by the peripheral wall of the body portion and one or more components of the vial adaptor. Such pressing ensures airtightness. The sealing member may be configured for creating an airtight interstitial space between the body portion 1020 and the coupling portion in fluid communication with the opening 1282 and the regulation port, the interstitial space being delimited airtightly by walls of components and pressed elastic material. The pressing thereby ensures airtightness of the interstitial space and thus allows the regulation passageway opening 1282 and the regulation port to be in airtight fluid communication.

The sealing member may comprise one or more rings. When the section of the body portion comprising the regulation passageway opening 1282 is of a generally cylindrical shape, said section of the body portion may be inserted easily in such ring(s) with an airtight fitting. The sealing member may comprise or consist of a rubber ring or of one or more O-rings for example a pair of O-rings, which may or may not be over-molded. The body portion may correspondingly comprise one or more grooves, for example grooves configured to lodging O-rings. In case the regulation passageway opening 1282 faces the regulation port, the sealing member may comprise O-rings arranged on both sides of the regulation passageway opening 1282. In case the sealing member comprises a rubber ring, said rubber ring may be arranged around the regulation passageway opening 1282 and comprise recesses and/or passages configured to direct fluid from the regulation passageway opening 1282 to the regulation port in cooperation with the components the rubber ring is pressed against.

The vial adaptor 1010 may comprise a duct member arranged between the regulation passageway opening 1282 and the regulation port. The duct member may comprise at least a portion the diameter of which is smaller than the diameter of the regulation passageway opening 1282 and/or of the regulation port. The duct member may thereby form a tool to reduce said diameter(s) of the regulation passageway opening and thus reduce fluid flow. This is performed at a relatively low cost in terms of manufacturing. The manufacturing of a relatively large regulation passageway opening and/or regulation port then reduced by the duct member may indeed be simpler than the initial manufacturing of relatively small regulation passageway opening 1282 and/or regulation port.

The duct member may in particular be arranged against and/or plugged inside the regulation passageway opening 1282 and reduce the diameter of said regulation passageway opening 1282. This allows decreasing the flow in the interstitial space and thereby reduces risks of failure of the sealing member and leaks.

In examples, the duct member may be integrally formed with the sealing member. The sealing member and the duct member may thus form a single piece. In particular, the sealing member may comprise a pair of over-molded O-rings, the over-molding connecting the two O-rings and also forming the duct member between the O-rings. This simplifies the assembly of the vial adaptor 1010, as the over-molded O-rings may be assembled to the body portion 1020 in one single operation. In case of a rubber ring, passages in the rubber ring may act as such a duct member.

The vial adaptor 1010 may further comprise a regulation compartment between the regulation passageway 1028 and the chamber. The regulation compartment constitutes an intermediary room between the regulation passageway 1028 and the chamber 1040 where gas may circulate. This may increase uniformity of inflation/deflation of the chamber. The regulation compartment may be formed peripherally to the body portion. The regulation compartment may present a volume higher than the volume of the regulation passageway 1028. The regulation compartment may be formed between the regulation port and the chamber 1040, for example by the coupling portion and/or the housing 1050. The regulation compartment may for example present a toroid shape and/or surround the sleeve portion. The regulation compartment may in examples be formed between the chamber 1040 and the sleeve portion, for example between the sleeve portion and the internal wall of the telescopic section of the cover. The regulation compartment may in alternative examples be formed inside the cover.

The coupling portion may in examples comprise a coupling unit separate from at least part of the cover. The coupling unit may comprise an internal wall forming the sleeve portion and an external wall forming the internal wall of the telescopic section of the cover with a vent passage between an edge of the internal wall and the cover as earlier-explained. The sleeve portion and the external wall may in examples be substantially concentric and centered on the central axis of the body portion. A first peripheral edge of the chamber may for example be welded on the external wall of the coupling unit (for example on the vent-passage-delimiting edge) and a second peripheral edge of the chamber 1040 may be welded on the sleeve portion (for example on an edge of the sleeve portion). The chamber gate may present an annulus shape delimited by the two peripheral edges of the chamber 1040, which for example corresponds to the space delimited by the vent-passage-delimiting edge and by the edge of the sleeve portion. The regulation compartment may be formed between the sleeve portion, the external wall of the coupling unit, and another wall of the coupling unit connecting said sleeve portion and said external wall. Such a coupling unit allows a particularly easy manufacturing, as the chamber 1040 may be easily welded on the coupling unit, the assembly obtained being in examples afterwards assembled to the body portion and to the (rest of the) housing 1050, for example by fitting, press-fitting and/or snapping.

Figure 67:
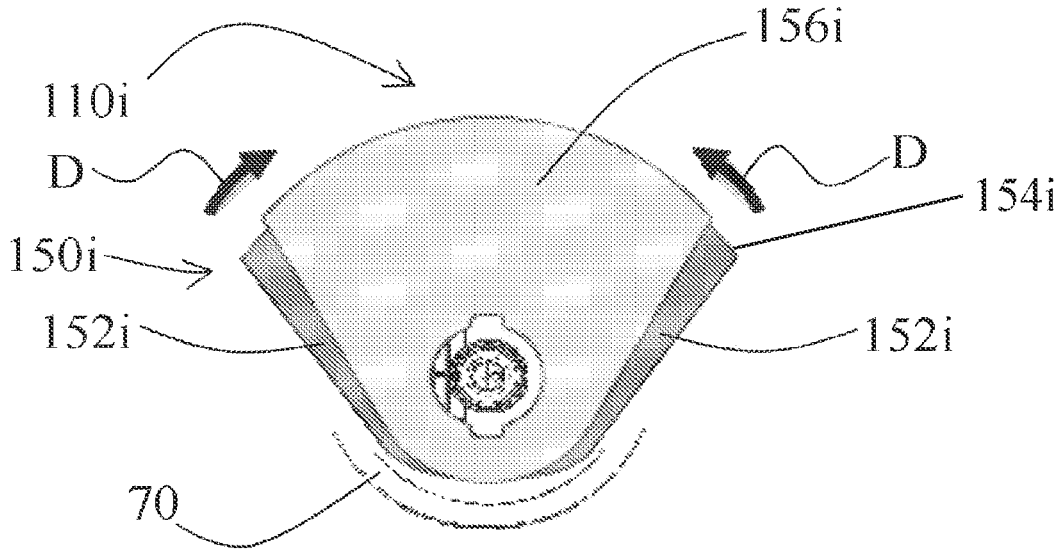

Examples of the vial adaptor are now discussed with reference to the FIGS. 2-67.

FIGS. 2-17 illustrate an example of a vial adaptor 10*b* and its components.

Figure 2:
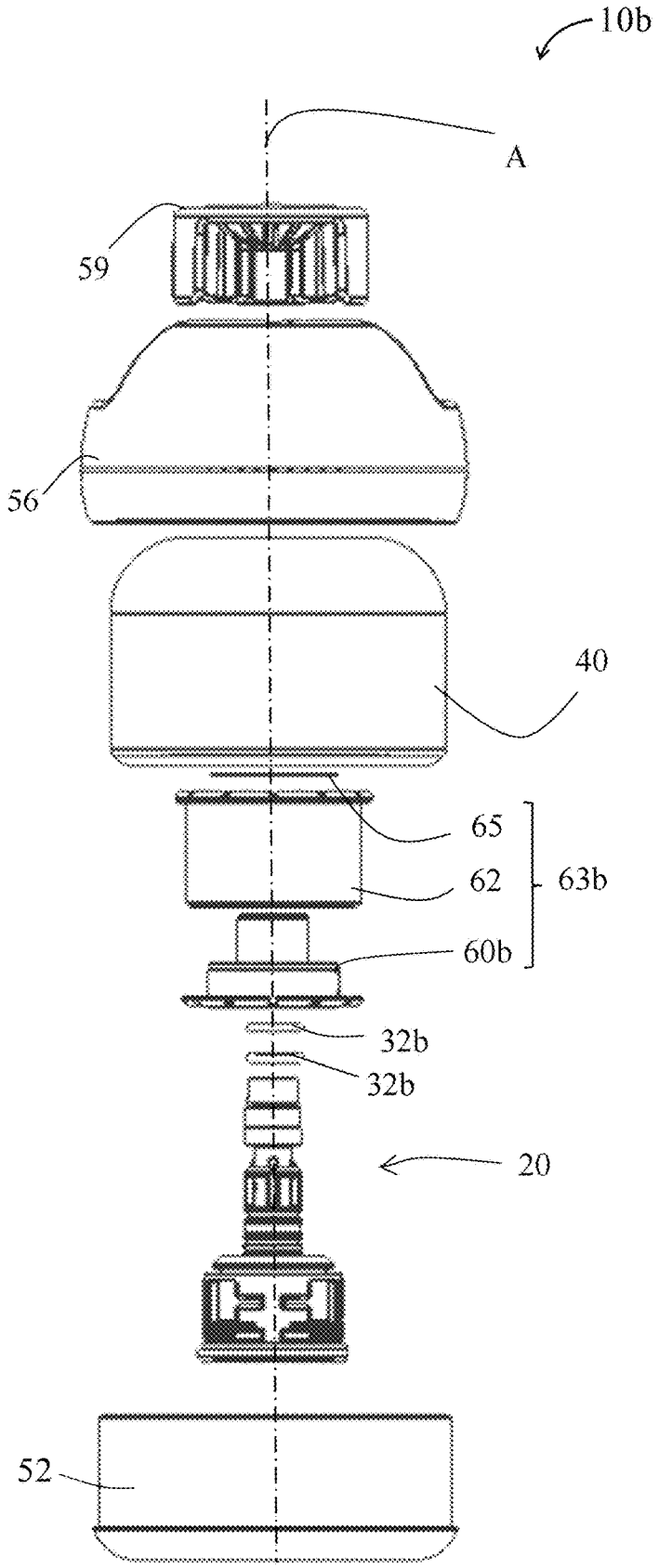
FIGS. 2-17 illustrate an example of the vial adaptor and components thereof.

With reference to FIG. 2, an exploded view of vial adaptor 10*b* along central axis A which defines the vial connection axis is shown. Vial adaptor 10*b* comprises a bowl 52, a body portion 20, O-rings 32*b* forming a sealing member to be arranged between a body-portion-coupling member 60*b* and body portion 20, a housing-coupling member 62, a filter 65 arranged inside housing-coupling member 62, a chamber 40, a cover 56 and a detachable cap 59. Chamber 40 is expandable and/or contractible, and impermeable to gas and/or liquid. Bowl 52, cover 56 cooperate with housing-coupling member 62 to form an expandable housing which is telescopic and configured for casing chamber 40. Each component may be provided preformed (e.g. molded, such as injection-molded) initially or at any time it is used during the manufacturing. The components are then assembled generally along axis A. In examples, all components may be assembled during manufacturing with few welding operations, except for example for chamber 40 and filter 65, and/or with few welding operations in zones difficult to access.

Still with reference to FIG. 2, body-portion-coupling member 60*b*, housing-coupling member 62 and filter 65 form a coupling unit 63*b* which serves as an intermediate structure between body portion 20 and chamber 40. Coupling unit 63*b* unit is fully separate from body portion 20. Also, body-portion-coupling member 60*b* and housing-coupling member 62 are separate components. The following discussions may however also apply to alternative examples where portions of the coupling unit are integrally formed with other components, for example where the housing-coupling member is integrally formed with the cover of the housing, and/or where the body-portion-coupling member and the housing-coupling member are integrally formed.

FIGS. 3-6 illustrate bowl 52 and cover 56.

Figure 3:
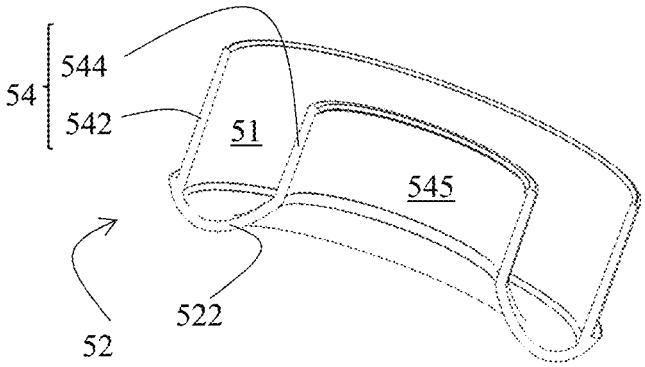
Figure 4:
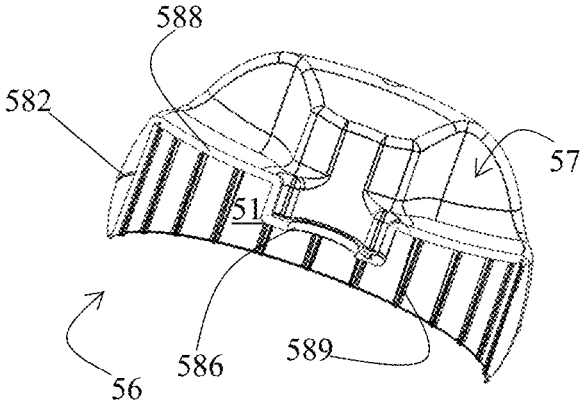

With reference to FIGS. 3-4, bowl 52 comprises a telescopic section 54 comprising peripheral internal wall 544 (configured to slide with respect to a peripheral external wall 584 of housing-coupling member 62). Bowl 52 also comprises peripheral external wall 542 configured for sliding with respect to peripheral external wall 582 of cover 56. Bowl 52 further comprises bottom section 522 and cover 56 comprises top section 588 so as to close inside space 51 of the housing and fully cover chamber 40. Top section 588 comprises an edge 586. Cover 56 comprises longitudinal guides 589 formed on the inner face of external wall 582 and configured for cooperating with non-represented grooves formed on the external face of the external wall 542 of bowl 52. Bowl 52 and cover 56 may be configured for being assembled together by snapping.

Figure 5:
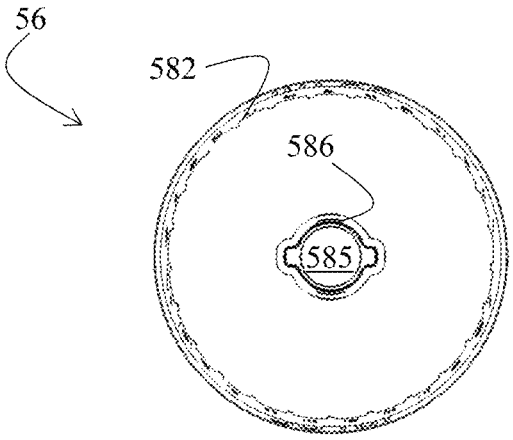
Figure 6:
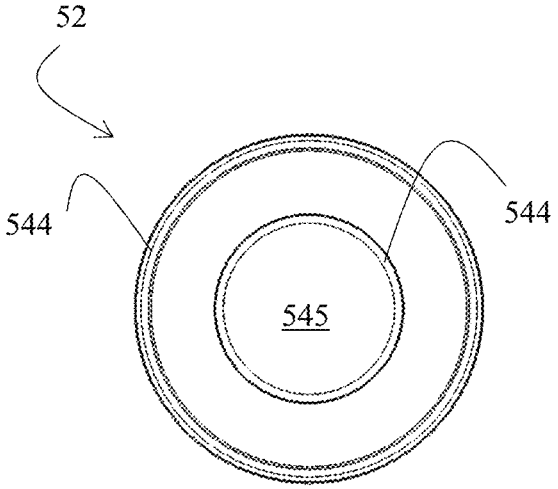

With reference to FIGS. 5-6, cover 56 forms a central passage 585 delimited by edge 586 and bowl 52 forms a central passage 545 delimited by internal wall 545. Central passages 545 and 585 are configured for lodging the assembly of body portion 20 and coupling unit 63*b*, for example by snapping.

Figure 7:
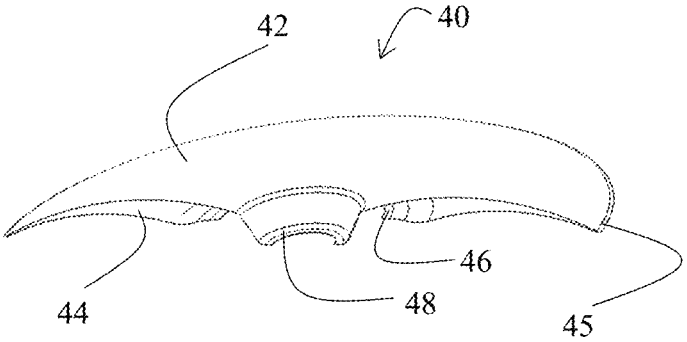

FIG. 7 illustrates a cross section view of chamber 40.

With reference to FIG. 7, chamber 40 comprises two annulus shaped flexible/foldable sheets 42 and 44 having external edges 45 and internal edges 46 and 48. Edges 45, 46 and 48 present ring shapes dimensioned to correspond to respective zones they are to be welded to. External edges 45 present the same dimensions and may be welded together.

FIGS. 8-11 illustrate body portion 20.

Figure 8:
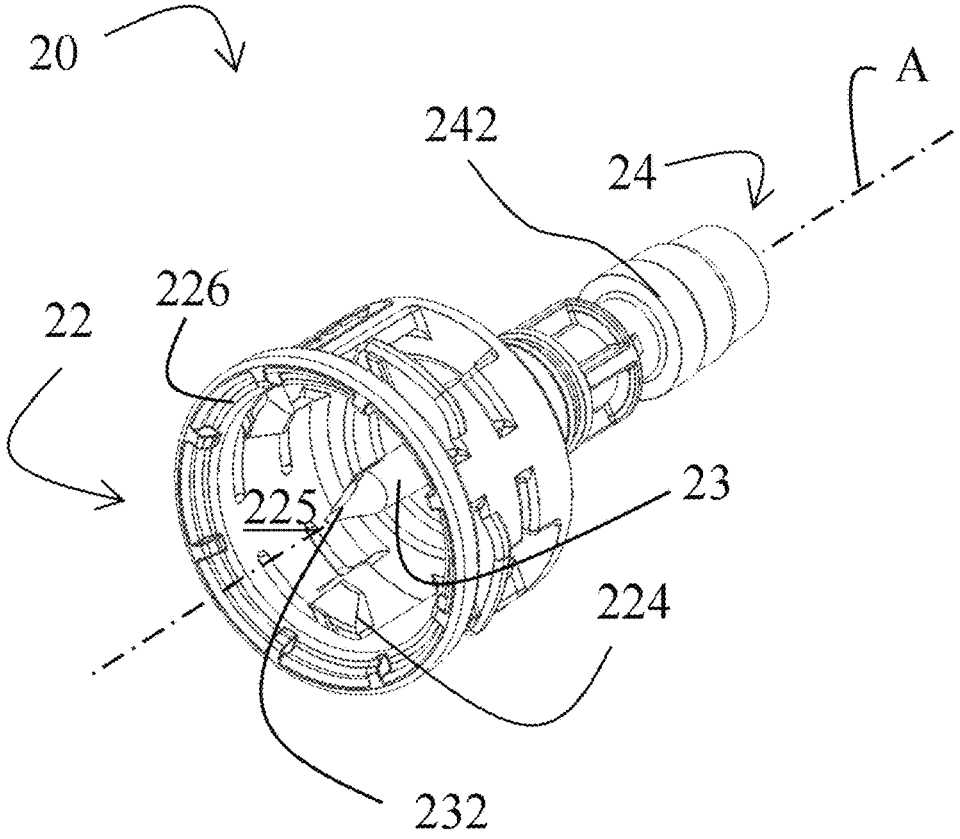
Figure 9:
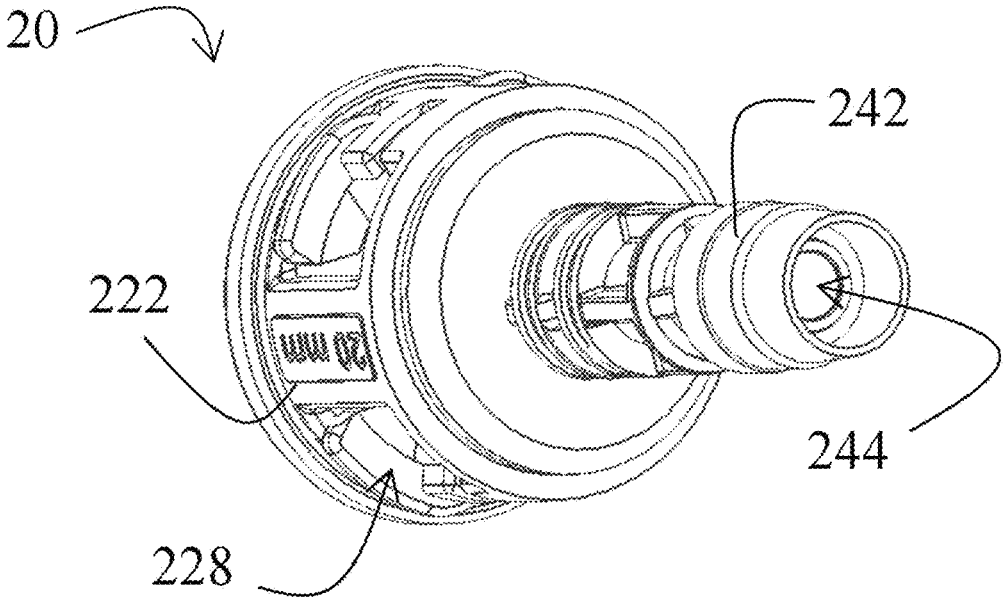

With reference to FIGS. 8-9, body portion 20 comprises a vial connection port 22 and a syringe connection port 24. Vial connection port 22 comprises a docking structure 225 centred on central axis A of body portion 20. Vial connection port 22 further comprises an integrally formed spike 23 extending along axis A. Spike 23 comprises a pointed tip 232 for piercing a vial septum. Syringe connection port 24 comprises an opening 244. Opening 244 is formed on the tip of a tubular member 242 of body portion 20 centered on axis A. Docking structure 225 and opening 244 are oriented in opposite directions of axis A. Body portion 20 thereby allows mounting vial adaptor 10*b* on a vial neck or vial converter by plugging the vial neck or vial converter inside docking structure 225 of vial connection port 22 along axis A so as to pierce a septum of the vial with spike 23, and (e.g. then) mounting a syringe adaptor on syringe connection port 24 again along axis A.

Still with reference to FIGS. 8-9, vial connection port 22 comprises a peripheral wall 222 extending substantially parallel to axis A. Wall 222 delimits docking structure 225 and presents a rim 226 delimiting entry of docking structure 225. Docking structure 225 presents a generally cylindrical shape. Wall 222 comprises clamps 224 extending inwardly toward axis A and configured for attaching and/or snapping the vial neck or vial converter inside docking structure 225. Wall 222 further presents radially traversing recesses 228 which facilitate the snapping. Other configurations may be contemplated. For example, the body portion may comprise several peripheral walls forming legs delimiting the docking structure and no rim.

Figure 10:
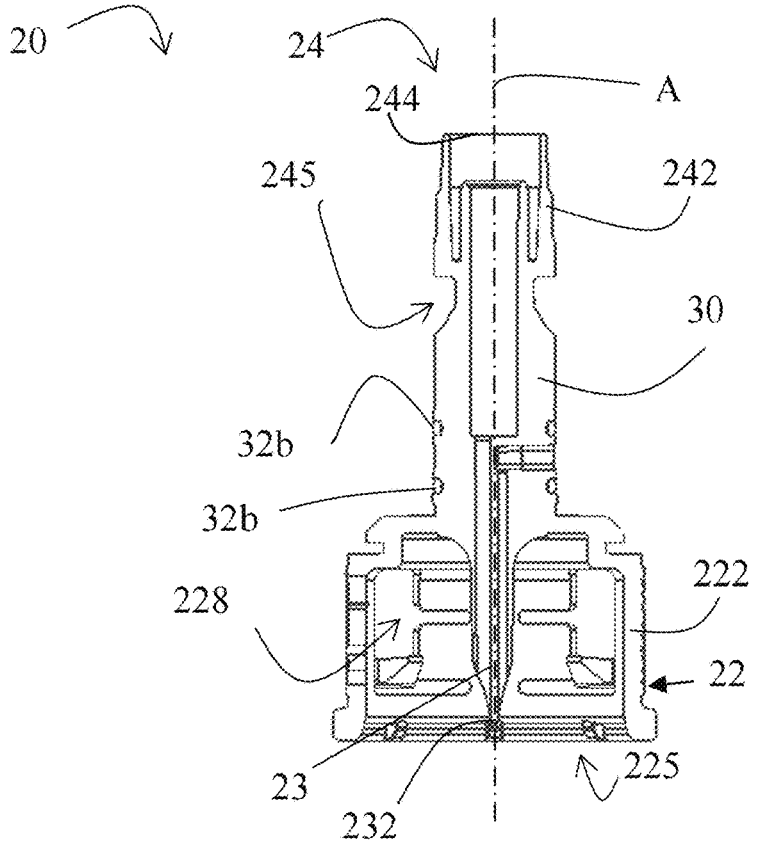
Figure 11:
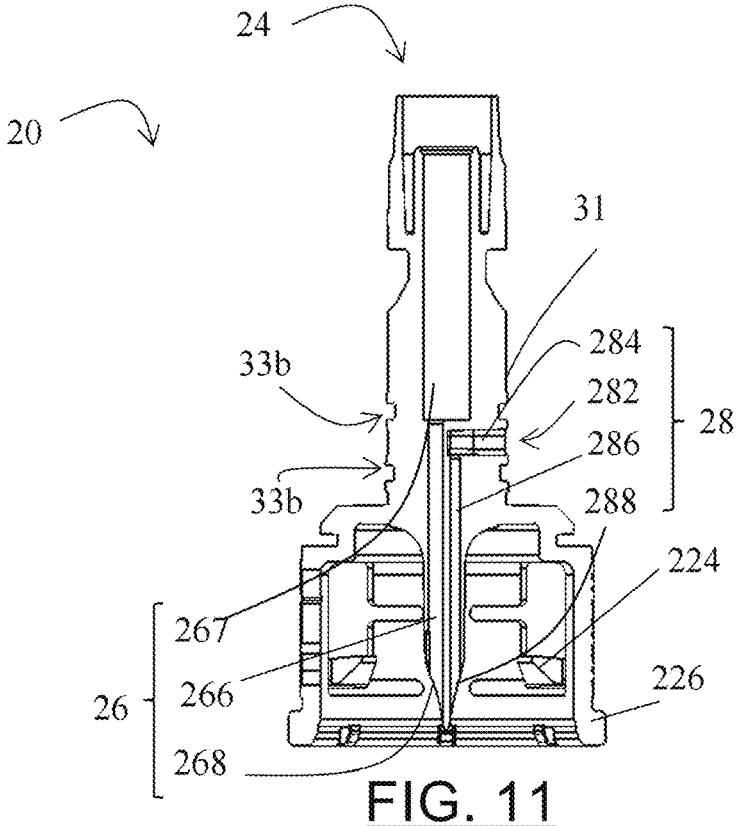

With reference to FIGS. 10-11, spike 23 comprises several lumens forming an access passageway 26 and a regulation passageway 28. Opening 244 is formed on the tip of tubular member 242 of body portion 20 centered on axis A and defines an extremity of access passageway 26. Access passageway 26 is substantially straight and extends substantially along axis A between opening 244 of syringe connection port 24 and tip 232 of spike 23. Spike 23 integrates an extremity portion of access passageway 26 and an extremity portion of regulation passageway 28. Regulation passageway 28 forms a respective opening 288 on tip 232 of spike 23 and access passageway 26 forms a respective opening 268 on tip 232 of spike 23, so as to allow fluid communication between the passageways 26 and 28 and the vial when spike 23 has pierced the septum of the vial. Regulation passageway 28 extends from vial connection port 22 to one regulation passageway opening 282 formed on a peripheral wall 31 of central section 30 of body portion 20. Opening 282 defines an extremity of the regulation passageway. A first straight portion 286 of regulation passageway 28 extends from tip 232 of spike 23 substantially along axis A and aside a first straight portion 266 of access passageway 26. Regulation passageway 286 further presents a second portion 284 in the central section 30 extending toward wall 31 of central section 30, while access passageway 26 continues with a second straight portion 267 along axis A until syringe connection port 24. Second portion 284 forms a substantially right angle with first portion 286.

Still with reference to FIGS. 10-11, body portion 20 consists of three sections: an extremity section forming vial connection port 22, another extremity section forming syringe connection port 24, and a central section 30 in-between. Body portion 20 presents an elongate shape and its sections extend along a straight central axis A which defines the vial connection axis. All sections of body portion 20 present a generally prism (e.g. cylindrical) outer shape. Body portion 20 is thus relatively simple to manufacture and relatively compact. Central section 30 and syringe connection port 24 section present a diameter lower than the diameter of vial connection port 22 section. Body portion 20 is thus compact and generally presents an elongated shape which becomes more and more slender from vial connection port 22 toward syringe connection port 24. This allows slide-insertion of tubular member 242 inside a sleeve portion of body-portion-coupling member 60*b*.

Still with reference to FIGS. 10-11, body portion 20 further comprises peripheral grooves 33*b* configured each for lodging a respective one of a pair of O-rings 32*b*. O-rings 32*b* constitute a sealing member that provides airtightness of the fluid communication between a regulation port and regulation passageway opening 282.

Figure 12:
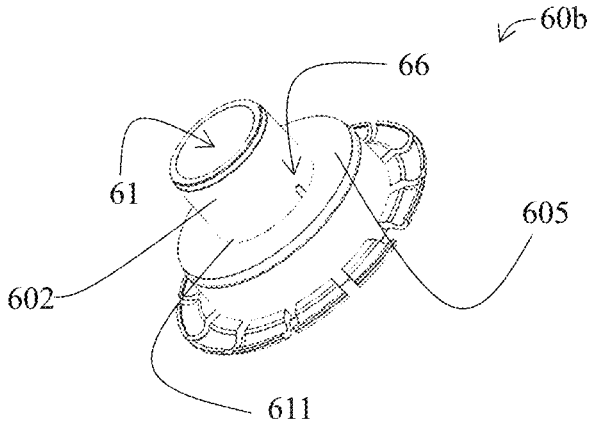
Figure 13:
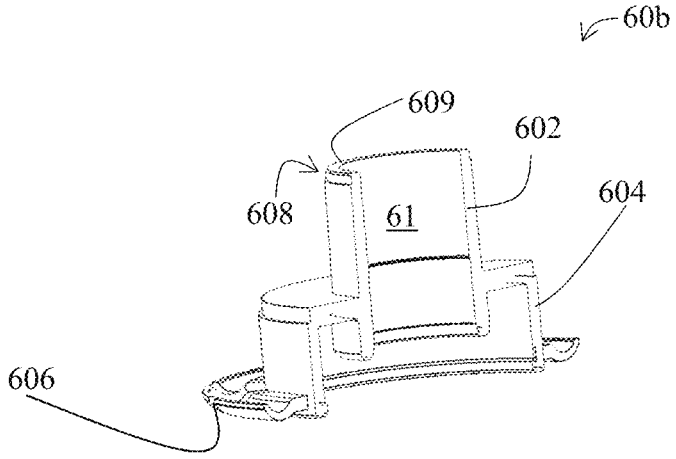

FIGS. 12-13 illustrate body-portion-coupling member 60*b*.

With reference to FIG. 12, body-portion-coupling member 60*b* forms a central passage 61 of a generally cylindrical shape for central section 30 of body portion 20 of a generally cylindrical shape to be inserted and fitted (e.g. press-fitted and/or snapped) in central passage 61. Body-portion-coupling member 60*b* includes a sleeve portion 602 of a tubular shape which forms (i.e. delimits) central passage 61. Body-portion-coupling member 60*b* includes a regulation port 66 located on a peripheral ring corner 611 formed between plate 605 and sleeve portion 602. Regulation port 66 may be in fluid communication with regulation passageway 28 of body portion 20 on the central passage 61 side. For example, to establish fluid communication between the regulation passageway 28 and regulation port 66, a diameter of the central passage 61 may be configured to be superior (e.g. 10% larger) to a diameter of a central section 30 on which the regulation passageway may be formed.

With reference to FIG. 13, body-portion-coupling member 60*b* includes a rim edge 609 at which sleeve portion 602 ends. Sleeve portion 602 of coupling sleeve member 60*b* comprises a recess 608 at rim edge 609 for facilitated welding. Body-portion-coupling member 60*b* also includes peripheral flanges 606 extending outwardly and radially from a peripheral wall 604 of body-portion-coupling member 60*b* serving as a support.

Figure 14:
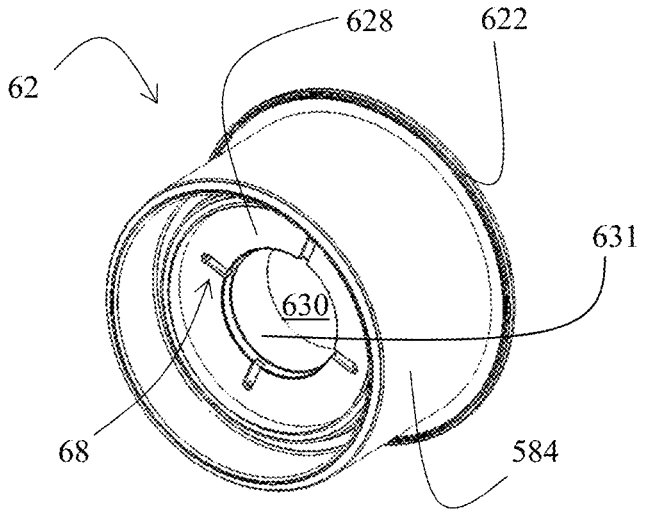
Figure 15:
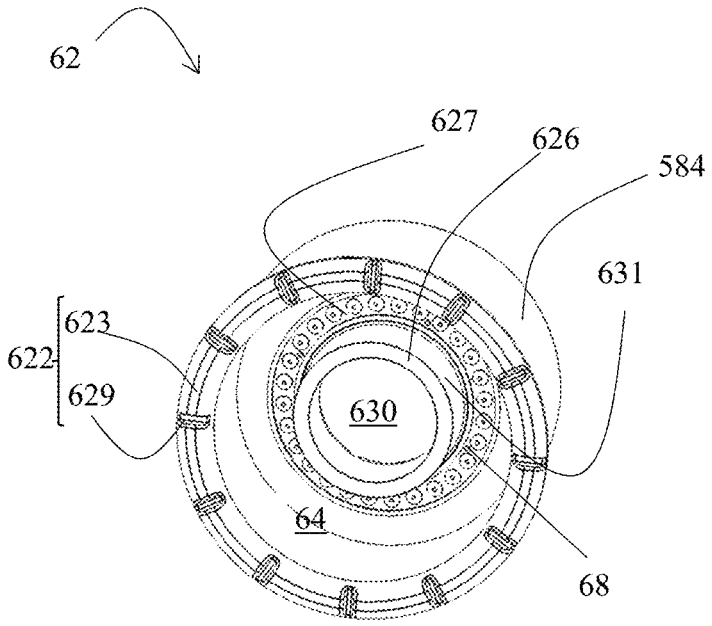

FIGS. 14-15 illustrate housing-coupling member 62. With reference to FIG. 14, housing-coupling member 62 includes a (internal) sleeve portion 631 of a tubular shape complementary to sleeve portion 602 of body-portion-coupling member 60*b*. Sleeve portion 631 forms a central passage 630 for insertion of sleeve portion 602 of body-portion-coupling member 60*b*. Housing-coupling member 62 further includes a peripheral external wall or (external) sleeve 584. Peripheral external wall 584 may be supported by peripheral flanges 606 of body-portion-coupling member 60*b* after assembly of body-portion-coupling member 60*b* and housing-coupling member 62. Housing-coupling member 62 also includes a plate 628 presenting an annulus shape and connecting sleeve portion 631 and external wall 584. Housing-coupling member 62 may thus present the structure of two concentric sleeves 584 and 631 joined by an internal annular plate 628. Plate 628 is configured for cooperating with plate 605 of body-portion-coupling member 60*b*, both plates presenting a complementary annulus shape.

Still with reference to FIG. 14, regulation port 66 is further in fluid communication with orifices 68 formed on plate 628. For example, a diameter of sleeve portion 631 of the housing-coupling member 32 may be configured to be superior (e.g. 10% larger) to a diameter of sleeve portion 602 of body-portion-coupling member 60*b* on which the regulation port 66 may be formed. The orifices 68 may each be formed in a recessed portion extending radially from the inner peripheral edge of a lower surface of plate 628 so that fluid can flow between said orifices and the interstitial space formed between said sleeve portions 631, 602. Orifices 68 lead to a regulation compartment 64 (see FIG. 15). As can be seen, orifices 68 are of the number of four and uniformly located around sleeve portion 602 so as to uniformly distribute fluid communication. Other configurations may be contemplated. Referring back to FIG. 12, in the configuration of the example, regulation port 66 is located on a peripheral ring corner 611 formed between plate 605 and sleeve portion 602. Other configurations may be contemplated.

With reference to FIG. 15, plate 628 presents on one side a fixation ring 627 which surrounds sleeve portion 602 and on which the orifices 68 are located. Fixation ring 627 facilitates fixation of filter 65 of coupling unit 63*b* presenting an annulus shape, for example by welding. Filter 65 provides an additional protection in case chamber 40 is accidentally disassembled. Also, filter 65 may at least reduce liquid passing to chamber 40 from the vial.

Still with reference to FIG. 15, the action of gravity tends to press sheet 42 on rim edge 622, and to press top section 588 of cover 56 on sheet 42 over rim edge 622. A vent passage formed below top section 588 of cover 56 and delimited by rim edge 622 may thereby be partly obstructed. In response to that, rim edge 622 comprises an alternation of crests 629 and slots 623 to create vent passages, so as to ensure a relatively good flow at the zone delimited by vent-passage-delimiting rim edge 622 at substantially all times.

Still with reference to FIG. 15, after the insertion of sleeve portion 602 into sleeve portion 631, sleeve portion 602 forms an internal wall of coupling unit 63*b* and external wall 584 forms an external wall of coupling unit 63*b*. Sleeve portion 602 and external wall 584 are substantially concentric and centered on a central axis, said central axis corresponding to central axis A of body portion 20 which is to be inserted inside sleeve portion 602 (see also FIG. 17). A regulation compartment 64 which presents a toroid shape centered on said central axis is formed between sleeve portion 631, external wall 584, and plate 628.

Figure 16:
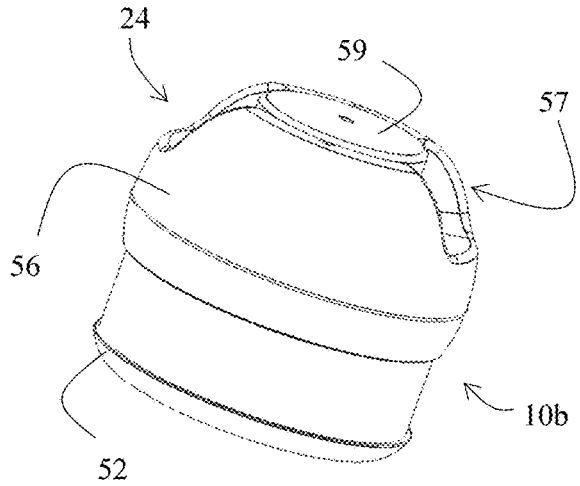
Figure 17:
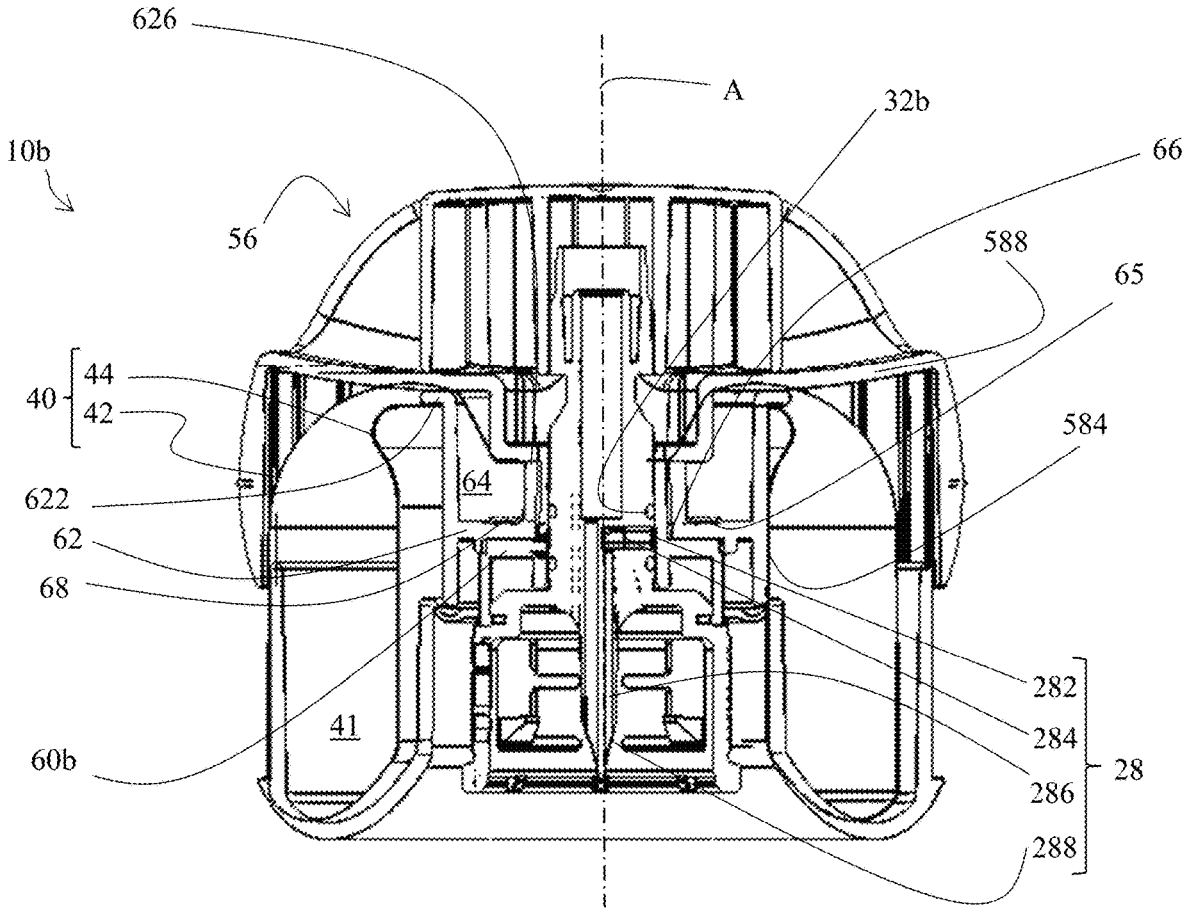

FIGS. 16-17 illustrate the assembly of all components of vial adaptor 10*b*.

With reference to FIG. 16, vial adaptor 10*b* is shown in perspective. Vial adaptor 10*b* comprises bowl 52 assembled to cover 56 and configured for sliding translationally and vertically into and out of cover 56. Vial adaptor 10*b* further comprises detachable cap 59 assembled to cover 56. Vial adaptor 10*b* comprises recesses 57 formed on the outer surface of cover 56 which allow a simple handling of detachable cap 59 for the user. Detachable cap 59 closes and may seal the opening of syringe connection port 24. Detachable cap 59 is in the example fully removable. In alternative examples, detachable cap 59 may stay connected to cover 56 via a hinge.

With reference to FIG. 17, fluid communication from the vial to chamber 40 is now explained. Fluid is communicated from chamber 40 to the vial the other way around. Gas in the vial first enters opening 288 of regulation passageway 28, and then follows first and second portions 286 and 284 of regulation passageway 28 so as to come out regulation passageway opening 282. Gas is then communicated airtightly to regulation port 66 thanks to sealing O-rings 32*b*. In some examples, regulation port 66 may be facing the regulation passageway opening 282. After that, gas circulates airtightly inside interstitial space formed between housing-coupling member 62 and body-portion-coupling member 60*b* and comes out from orifices 68 of housing-coupling member 62 through filter 65 so as to arrive in regulation compartment 64. Gas enters inside space 41 of chamber 40 in-between sheets 42 and 44 which pass in a circular vent passage formed above vent-passage-delimiting edge 622 of housing-coupling member 62 and below top section 588 of cover 56. As can be seen on the figure, regulation compartment 64 forms a toroid intermediary room between regulation port 66 and chamber 40. The symmetry of revolution around axis A of the distribution of orifices 68, of the shape of regulation compartment 64 and of the shape of the vent-passage formed between edge 622 and cover 56 allows a uniform inflating/deflating of chamber 40, which increases safety of use and at least reduces explosion risks.

Figure 18:
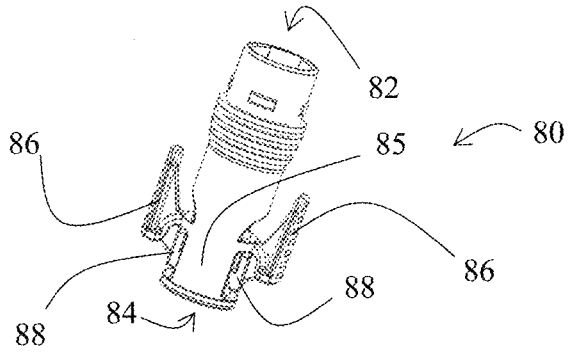
FIGS. 18-19 illustrate cooperation of an example of the vial adaptor with an example of the syringe adaptor.
Figure 19:
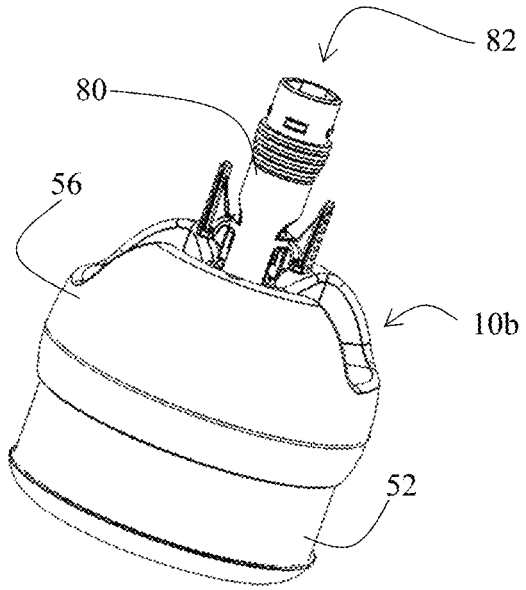

FIGS. 18-19 illustrate cooperation of vial adaptor 10*a* with a syringe adaptor 80.

FIG. 18 shows syringe adaptor 80 which may be mounted on syringe connection port 24 after detachable cap 59 is detached. Syringe adaptor 80 comprises an opened end 84 of a sleeve 85 configured for slide-insertion therein of tubular member 242 of syringe connection port 24. Syringe adaptor 80 further comprises syringe mounting port 82 configured for the direct mounting of a nozzle of a syringe. Syringe adaptor 80 further comprises clamps 88 configured for cooperating with a corresponding recess 245 of syringe connection port 24 such that the mounting of syringe adaptor 80 on syringe connection port 24 may be performed via snapping. Syringe adaptor 80 further comprises handles 86 configured to control clamps 88 so as to perform unsnapping.

FIG. 19 shows vial adaptor 10*b* with detachable cap 59 detached and syringe adaptor 80 mounted on syringe connection port 24.

FIGS. 20-27 illustrate operations of a vial adaptor 10*a-b*.

Figure 20:
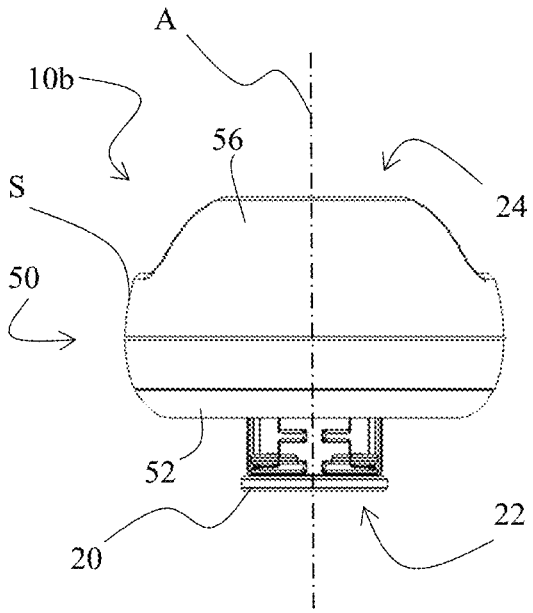
FIGS. 20-27 illustrate examples of operations of the vial adaptor.
Figure 21:
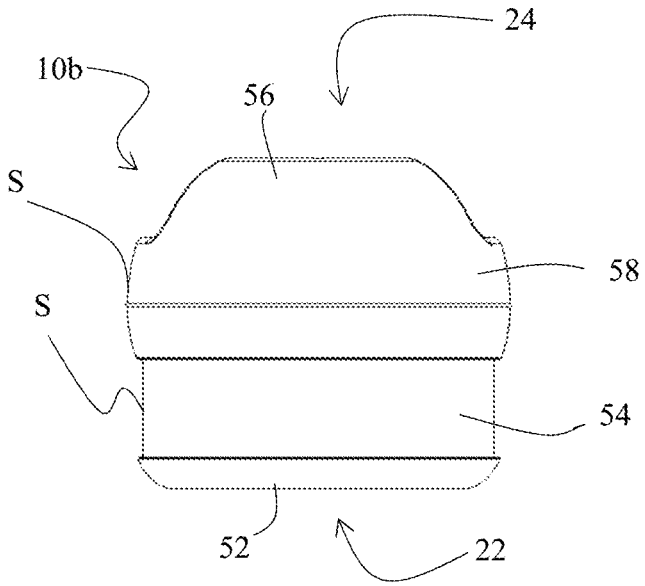

It is referred to FIGS. 20-21. FIG. 20 shows vial adaptor 10*b* in a compacted state and FIG. 21 shows vial adaptor 10*b* in an expanded state. As can be seen, housing 50 occupies more space in the expanded state than in the compacted state, or in other words, vial adaptor 10*b* is more voluminous in the expanded state than in the compacted state. This may be applied to optimize space occupation with respect to the inside space of housing 50 occupied or needed to be occupied by the chamber, while ensuring that housing 50 always envelopes and protects chamber during use of vial adaptor 10*b* and corresponding volume variation of the chamber. Housing 50 and/or vial adaptor 10*b* may notably be initially provided in the compacted state for an optimized storage and/or transportation of housing 50 and/or vial adaptor 10*b*, for example in a batch thereof. Then, upon requiring more space for the chamber to be expanded, housing 50 may be expanded such that vial adaptor reaches an expanded state. Also, vial adaptor 10*b* is easy to manipulate when compacted, for example for connection to a vial. In the example, expansion (respectively compacting) of housing 50 further involves increase (respectively decrease) of the area of the outer surface S of housing 50 and accordingly vial adaptor 10*a*.

Still with reference to FIGS. 20-21 in the example shown housing 50 consists of a single housing unit enveloping fully the chamber. The housing unit itself consists of two telescopic units: bowl 50 and cover 56 each having a respective telescopic section 54 resp. 58 defining an inside space available to be occupied by the chamber. Housing 50 always covers the chamber. Housing 50 could however be modified and present one or more apertures, for example formed on telescopic section 54, for example to facilitate sterilization. Furthermore, one or more components of housing 50 may be made at least partly of a transparent material, for example a transparent plastic, for example bowl 52 and/or cover 56. In the compacted state, vial connection port 22 of body portion 20 protrudes from the housing 50. This simplifies connection of vial adaptor 10*b* to a vial.

Figure 22:
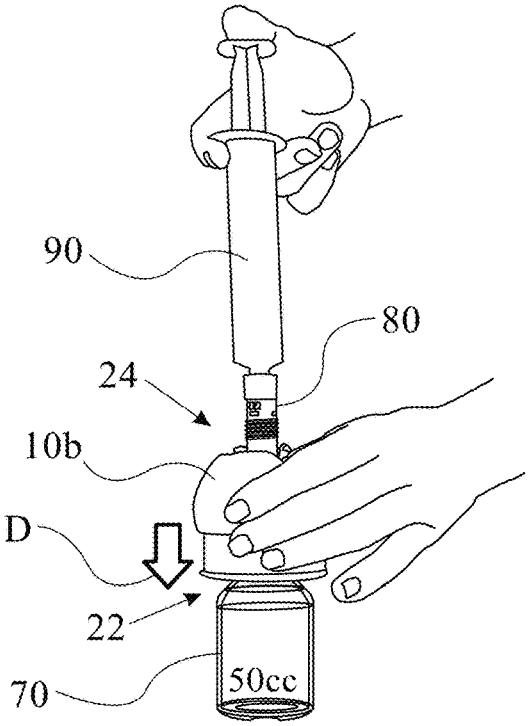

FIG. 22 illustrates uses of vial adaptor 10*b* by a human operator to reconstitute a powder drug in a vial 70.

Vial adaptor 10*b* may be provided in the compacted state, for example cleaned and/or sterilized, optionally in a sealed package. After removal from package, vial adaptor 10*b* may be connected to vial 70 by directly mounting vial connection port 22 on the neck of vial 70, for example still in the compacted state. As shown by the figures, vial adaptor 10*b* may be kept connected to vial 70 during the whole extraction process. A syringe 90 may be provided and connected to the syringe connection port 24 of vial adaptor 10*b* via a syringe adaptor 80.

Vial 70 may be provided having content in soluble solid form, for example as a powder, and which requires reconstitution before being used. Syringe 90 may be provided containing a liquid solution. A user may operate syringe 90 to fill vial 70 with the liquid, for example at least substantially fully. As illustrated on FIG. 22, this operation may be performed in a simple manner by initially positioning vial 70 vertically with the vial neck upward, for example with vial 70 standing on a horizontal support e.g. on a table or workplan. Upon the reconstitution, housing 50 and vial adaptor 10*b* are expanded as the chamber is expanded due to the reconstitution. As illustrated notably on FIG. 22, housing 50 and the chamber achieve expansion in a direction D oriented toward vial 70. FIG. 22 shows the end of the reconstitution process, where housing 50 is in the expanded state.

Figure 23:
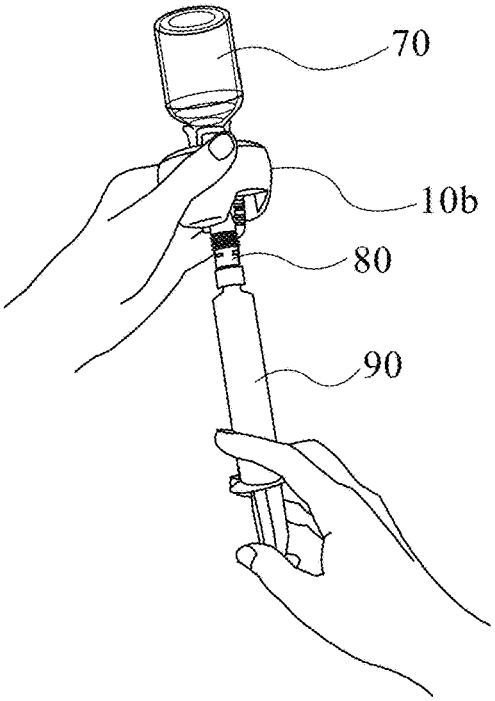

FIG. 23 illustrates uses of vial adaptor 10*b* by a human operator to extract liquid from a vial 70 into a syringe.

As illustrated on FIG. 23, the assembly may then be turned upside down and empty syringe 90 may be operated to extract the reconstituted solution from vial 70. The chamber being expanded after reconstitution, the content of the chamber then allows performing pressure regulation during such when extraction. FIG. 23 shows the end of the extraction process, where housing 50 is back in the compacted state.

Vial adaptor 10*b* may additionally be provided prepared for a vial having content in fluid form, for example as a liquid. In such a case, after the assembly is formed, the assembly may be turned directly (i.e. without any reconstitution step) upside down and empty syringe 90 may be operated to extract the solution from vial 70, as illustrated on FIG. 23. Vial adaptor 10*b* may for example be packaged with a positive volume of gas contained in the chamber. Such initially present gas allows pressure regulation internal vial 70 during the extraction. The gas initially contained in the chamber may be cleaned and/or sterilized gas, for example cleaned and/or sterilized air. The gas initially contained in the chamber may be the maximal volume of gas allowed by the compacted state and correspond to a maximal vial capacity with which vial adaptor 10*b* is intended to be used.

Vial adaptor 10*b* may thus be packaged prepared for being used both with vials initially provided with content in fluid form and with vials initially provided with content in soluble solid form. Vial adaptor 10*b* may be packaged in the compacted state and with the maximal volume of cleaned and/or sterilized gas contained in the chamber allowed by the compacted state. Vial adaptor 10*b* may be further configured for the housing volume to at least double when housing 50 is expanded, such that the chamber volume may also at least double.

FIGS. 24-27 illustrate different states of a vial adaptor 10*a* during use. Vial adaptor 10*a* is generally identical to vial adaptor 10*b*, except for chamber 40*a* of vial adaptor 10*a* which is different and welded differently from chamber 40*b* of vial adaptor 10*b*, and also except for coupling sleeve member 60*a* of vial adaptor 10*a* which is different from coupling sleeve member 60*b* of vial adaptor 10*b*.

FIGS. 24-27 show a vial adaptor 10*a* comprising a body portion 20, a chamber 40*a* of variable volume and impermeable to gas and/or liquid, and a housing 50 of variable volume and enveloping chamber 40*a*. Body portion 20 includes a vial connection port 22, a syringe connection port 24, an access passageway 26 configured for establishing fluid communication between vial connection port 22 and syringe connection port 24, and a regulation passageway 28 configured for establishing fluid communication between vial connection port 22 and chamber 40*a*. Chamber 40*a* is made of flexible and/or elastic material so as to be capable of expanding and contracting. Housing 50 is expandable, such that inside space 51 of housing 50 may be adapted to space occupied by chamber 40*a* at any time, so as to optimize space occupied by vial adaptor 10*a*.

Figure 24:
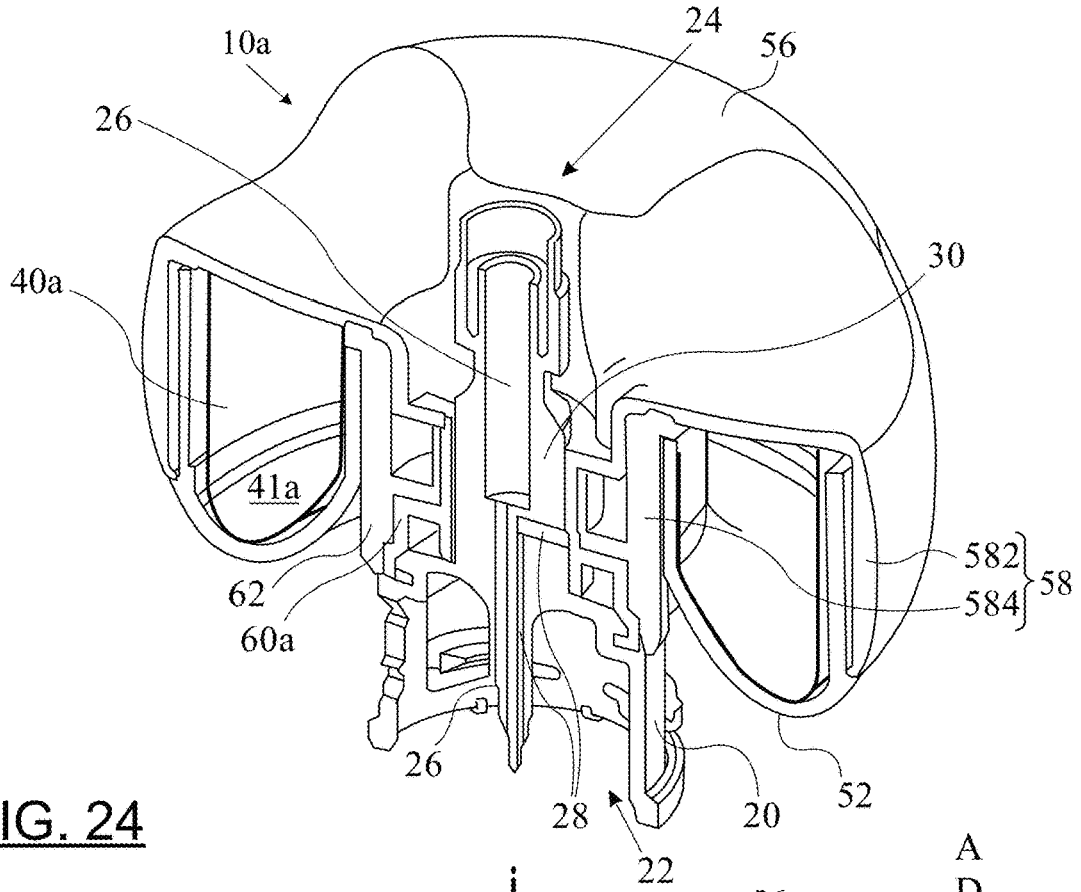

FIG. 24 shows a cross-section of vial adaptor 10*a* with housing 50 in the compacted state and with chamber 40*a* expanded and inside space 41*a* of chamber 40*a* containing the maximal volume of gas allowed by the compacted state of housing 50. On FIG. 3, chamber 40*a* occupies substantially all available inside space 51 of housing 50. Body-portion-coupling member 60*a* differs from body-portion-coupling member 60*b* of vial adaptor 10*b* only in that it comprises no flanges. External wall 584 of housing-coupling member 62 forms the internal wall of the telescopic section 58 of the cover 56. In alternative examples, an internal wall integrally formed with the rest of the cover 56 may play the same role as external wall 584.

Figure 25:
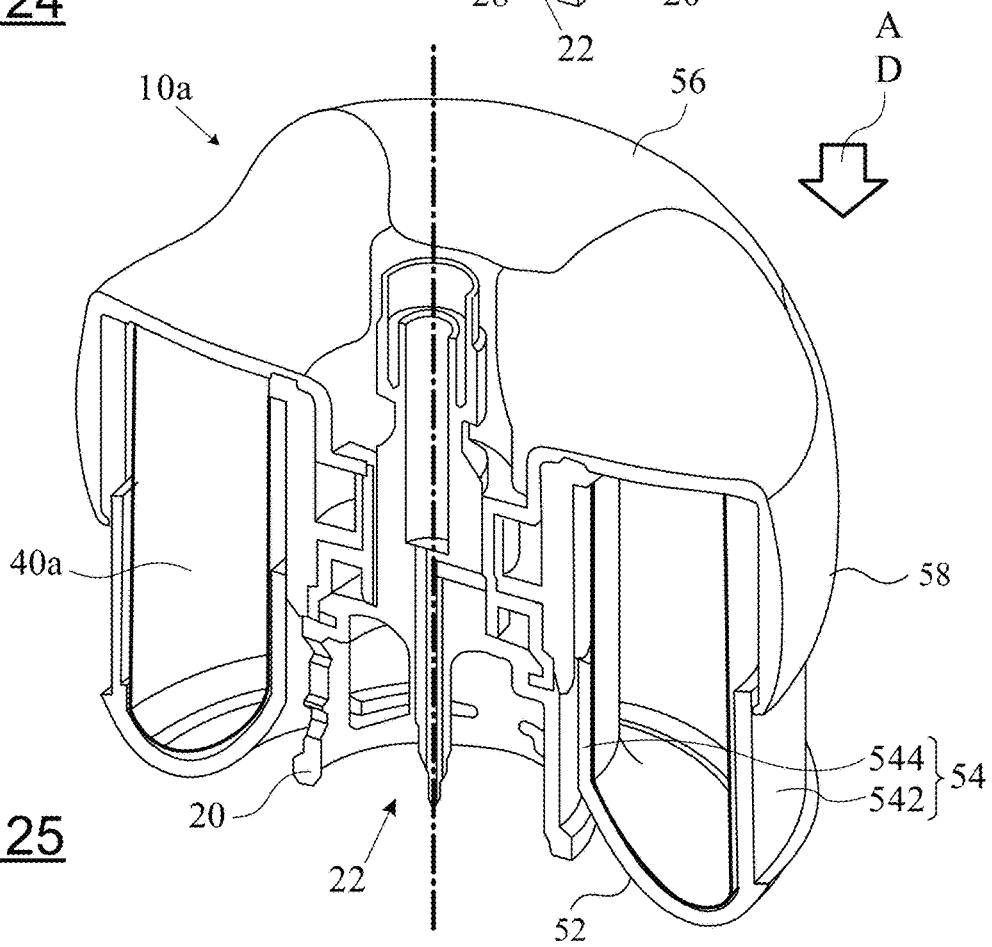

FIG. 25 shows a cross-section of vial adaptor 10*a* with housing 50 in the expanded state and with chamber 40*a* expanded and filled with the maximal volume of gas allowed by the expanded state of housing 50. On FIG. 25, chamber 40*a* again occupies substantially all inside space 51 of housing 50, said available inside space 51 being larger than in the compacted state.

Chamber 40*a* may be configured for imparting expansion to housing 50, such that transition from the situation represented on FIG. 24 to the situation represented on FIG. 25 may be performed automatically upon expansion of chamber 40*a*, for example upon inflating chamber 40*a*. Optionally, expansion of housing 50 may be prevented by a locking system which may need to be deactivated manually for chamber 40*a* to be able to impart expansion to housing 50.

Chamber 40*a* moves inside housing 50 as it expands or contracts/shrinks. Housing 50 comprises a cover 56 fixed relative to body portion 20 and a bowl 52 mobile relative to body portion 20. Bowl 52 includes telescopic section 54 and cover 56 includes telescopic section 58. Telescopic section 54 is configured to slide into (and out of) telescopic section 58, such that housing 50 is telescopic.

Upon chamber 40*a* being expanded and its moving portions reaching and entering into contact with bowl 52, expansion of chamber 42 presses telescopic section 54 out of telescopic section 58 so as to impart the sliding and expansion of housing 50. Telescopic section 54 forms the only boundary between inside space 51 of housing 50 and (e.g. cleaned and/or sterilized) ambient air of the working environment, such that crossing telescopic section 54 starting from inside space 51 would lead directly to ambient air (i.e. not to any other protecting structure and/or vent compartment between inside space 51 of the housing 50 and ambient air). Bowl 52 thus forms a moving boundary always protecting chamber 40*a* from ambient air.

Figure 26:
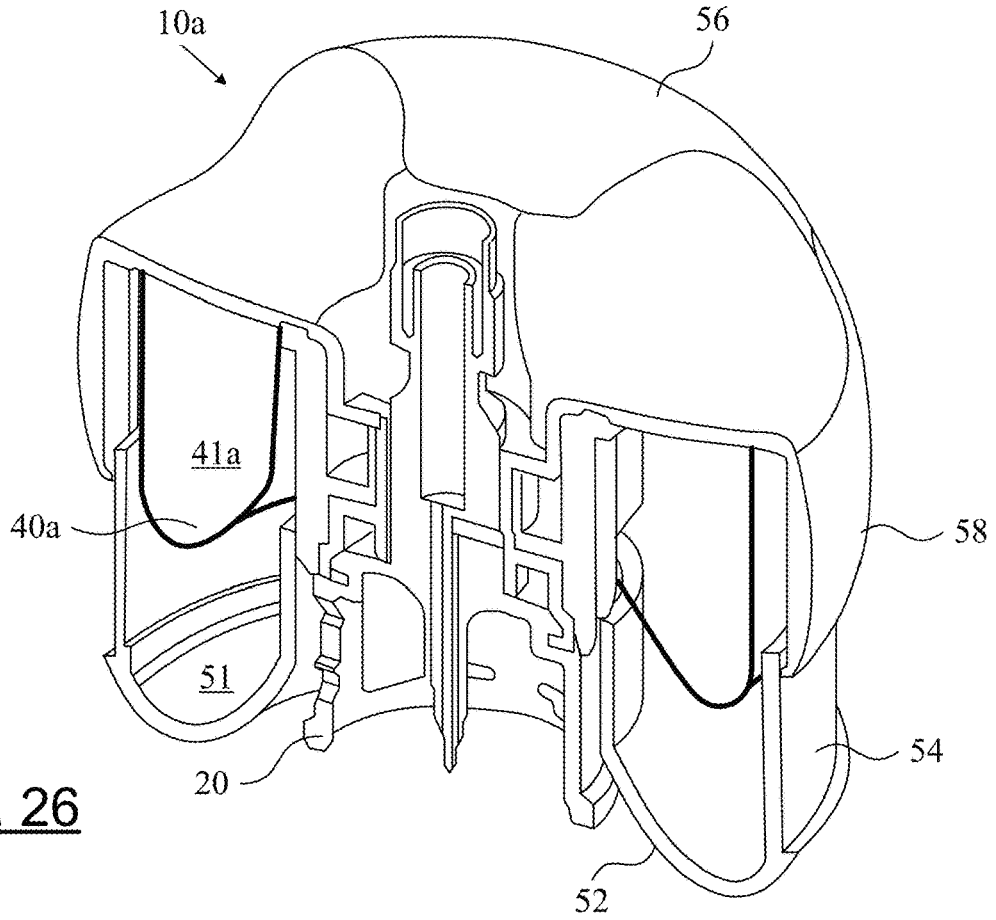
Figure 27:
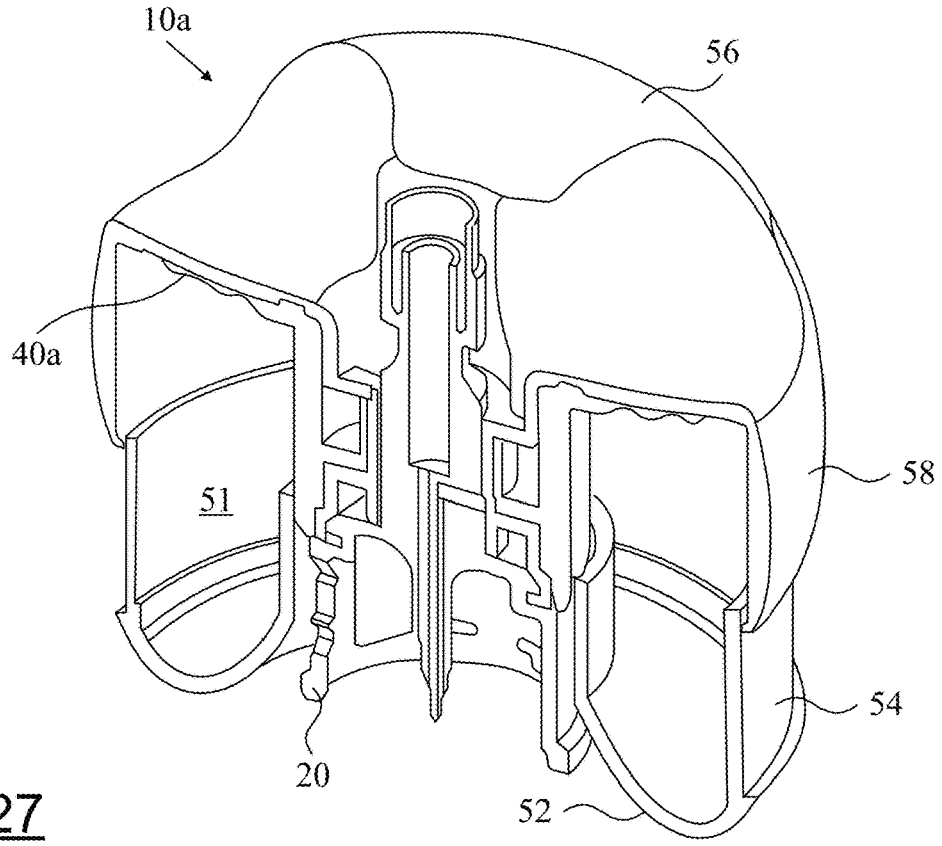

FIGS. 26-27 show cross-sections of vial adaptor 10*a* with housing 50 in the expanded state and with chamber 40*a* not occupying all available inside space 51 of housing 50. On FIG. 26, chamber 40*a* contains the maximal volume of gas allowed by the compacted state of housing 50. Such situation may occur after use of vial adaptor 10*a*. On FIG. 27, chamber 40*a* is shrunken. Such situation may occur during manufacturing of vial adaptor 10*a* or after use of the vial adaptor.

Referring to FIGS. 24-27, inside space 51 of housing 50 and inside space of chamber 40*a* present a substantially toroid shape which substantially always surrounds (i.e. loops around) axis A and central section 30. Housing 50 and chamber 40*a* thereby always present a general symmetry of revolution around axis A (and by extension an axial symmetry with respect to said axis A). Vial adaptor 10*a* presents the general shape of a hollow torus housing 50. The toroid inside space 51 of the hollow torus housing 50 is occupied by hollow torus chamber 40*a*. The longitudinal center hole of the torus is occupied by elongate body portion 20.

Housing 50 and chamber 40*a* achieve volume variation uniformly around axis A, such that vial adaptor 10*a* is always substantially balanced in weight around axis A. Furthermore, housing 50 and chamber 40*a* achieve volume variation longitudinally and along a direction at least substantially parallel to axis A.

Bowl 52 is configured to slide only translationally relative to cover 56. Referring to the situation of FIG. 22, bowl 52 is configured to slide vertically relative to cover 56 such that expansion of housing 50 is constrained to be performed downward (i.e. toward vial 70). Chamber 40*a* occupying substantially always substantially all inside space 51 of housing 50, expansion of chamber is also constrained to be performed downward (i.e. toward vial 70). Vial adaptor 10*a* is thereby particularly compact, well-balanced and ergonomic at all phases of its use.

Referring to FIGS. 24-27, vial adaptor 10*b* may for example be provided in the state shown on FIG. 24. Vial adaptor 10*b* may in examples reach the state shown of FIG. 25 after drug reconstitution is completed. Vial adaptor 10*b* may reach the state shown on FIG. 26 after liquid withdrawal as completed, unless housing 50 goes back to the compacted state, for example upon action of gravity, in which case vial adaptor 10*b* goes back to the state shown on FIG. 24.

FIGS. 28-33 illustrate composition and manufacturing of vial adaptor 10*b*. The following describes steps of assembling components of a vial adaptor according to embodiments of the present disclosure.

Figure 28:
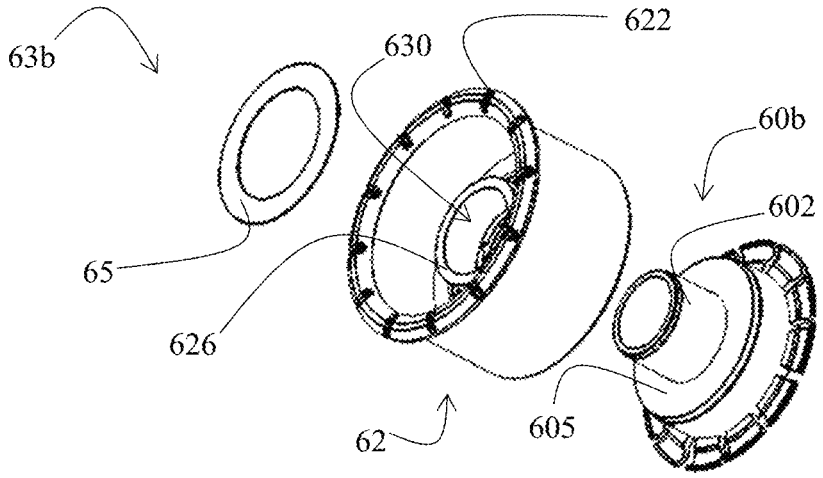
FIGS. 28-38 illustrate examples of manufacturing steps.

Referring to FIG. 28 the assembly of coupling unit 63*b* comprises inserting and fitting sleeve portion 602 of body-portion-coupling member 60*b* in central passage 630 of sleeve portion 631 of housing-coupling member 62. Housing-coupling member 62 may then be welded to body-portion-coupling member 60*b* by welding peripheral edge 632 at peripheral edge 607 (see also FIGS. 12-15). This seals the interstitial space formed between plate 628 and plate 605 on one side.

Figure 29:
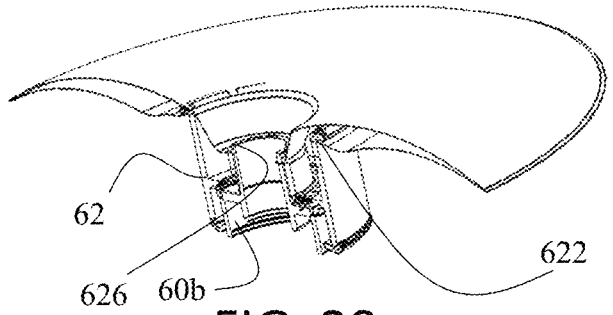

Referring to FIG. 29, sleeve portion 631 defines a rim edge 626 configured for welding thereon chamber 40. Rim edge 626 may be also welded to sleeve portion 602, in particular to rim edge 609 at which sleeve portions ends (see also FIGS. 12-15). This seals the interstitial space formed between plate 628 and plate 605 on the other side, such that regulation port 66 is in airtight fluid communication with orifices 68. Sleeve portion 602 of coupling sleeve member 60*b* comprises a recess 608 at rim edge 609 which facilitates the welding.

The manufacturing may comprise providing chamber 40 comprising two annulus shaped flexible/foldable sheets 42 and 44 having external edges 45 and internal edges 46 and 48. Edges 45, 46 and 48 present ring shapes dimensioned to correspond to respective zones they are to be welded to. External edges 45 present the same dimensions and may be welded together. Internal edge 48 is then be welded to rim edge 626 of sleeve portion 631 of housing-coupling member 62 as earlier-described. Internal edge 46 is welded to rim edge 622 of housing-coupling member 62. The provision of a chamber 40 comprising two sheets 42 and 44 makes manufacturing easy.

Figure 30:
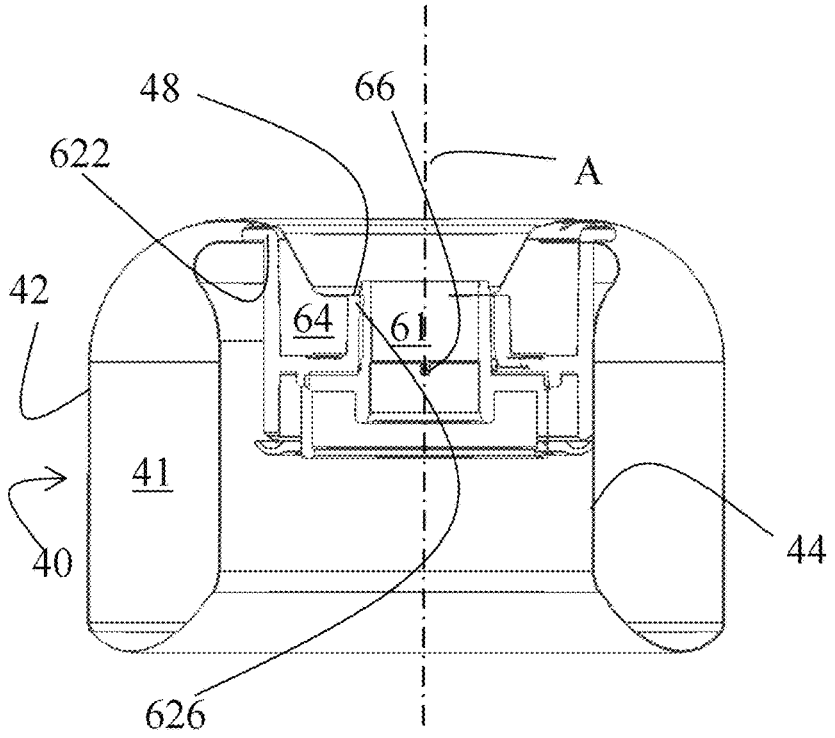

FIG. 30 shows the result after all welding steps. The space between sheets 42 and 44 constitutes inside space 41 of chamber 40. The chamber gate is defined by rim edges 626 and 622. The result allows a relatively uniform inflating/deflating of chamber 40 around central axis A of body portion 20.

Figure 31:
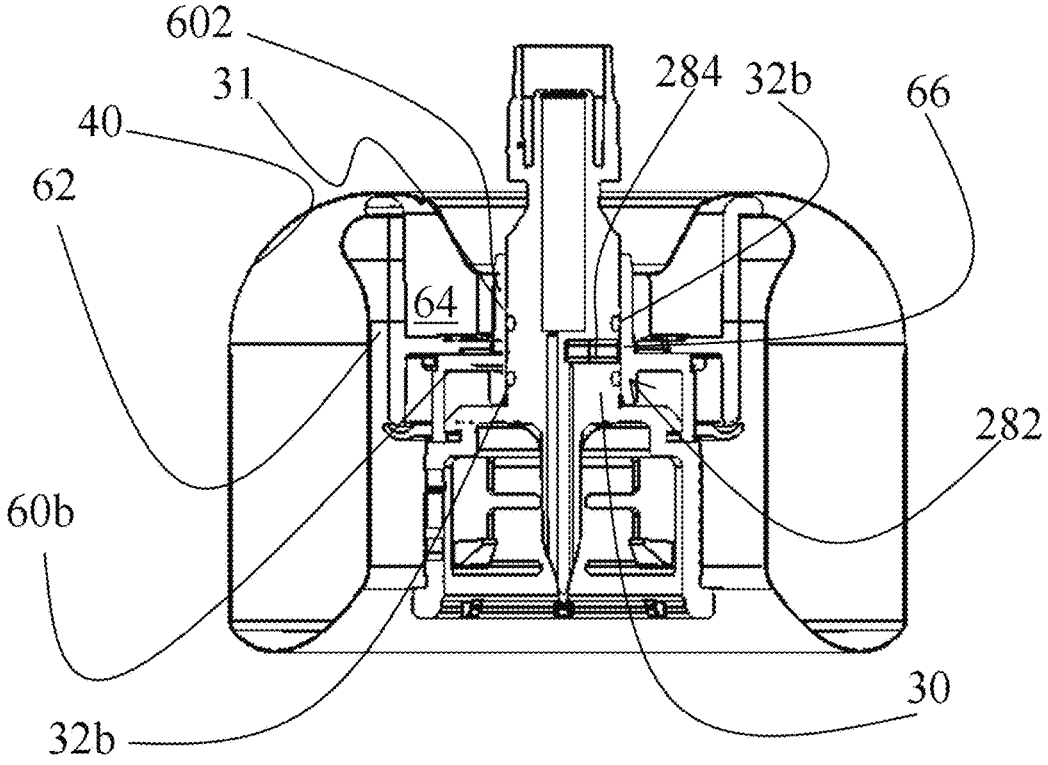
Figure 32:
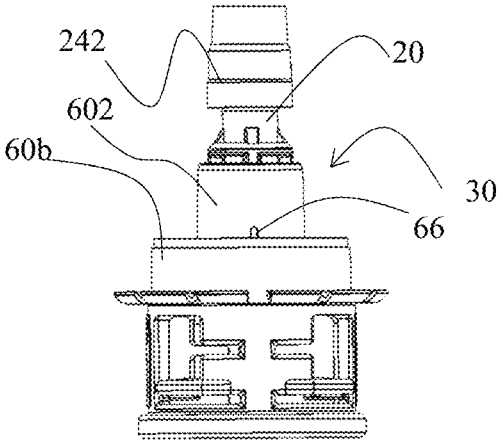

Referring to FIG. 31-32 which illustrate assembly of body portion 20, coupling unit 63*b* forms a central passage 61 of a generally cylindrical shape for central section 30 of body portion 20 of a generally cylindrical shape to be inserted and fitted (e.g. press-fitted and/or snapped) in central passage 61.

Regulation port 66 and regulation passageway opening 282 may be assembled facing each other, as represented on FIG. 31 which shows a cross section of the assembly after body portion 20 is inserted inside sleeve portion 602 of coupling unit 63*b*. Such insertion may occur for example after welding chamber 40 to coupling unit 63*b* as represented on FIG. 55. As can be seen on FIG. 31, chamber 40 surrounds sleeve portion 60 and body portion 20. Regulation port 66 is formed on internal wall of sleeve portion 602 in cooperation with peripheral wall 31 of central section 30 of body portion 20. Regulation passageway opening 282 is formed on peripheral wall 31 and arranged facing regulation port 66.

Wall 31 cooperates with and presents a shape complementary to sleeve portion 602. The O-rings 32*b* are arranged against wall 31 and against sleeve portion 602. As central section 30 of body portion 20 is fitted (e.g. press-fitted) inside sleeve portion 602, O-rings 32*b* are sandwiched (and pressed) between wall 31 and sleeve portion 602. The elastic material of the O-rings 32*b* thereby ensures airtightness in a simple manner in a zone difficult to access. O-rings 32*b* are arranged on body portion 20 on both sides of regulation passageway opening 282 and thereby create an airtight interstitial space between wall 31 and sleeve portion 602 allowing airtight fluid communication between regulation passageway opening 282 and regulation port 66.

Figure 33:
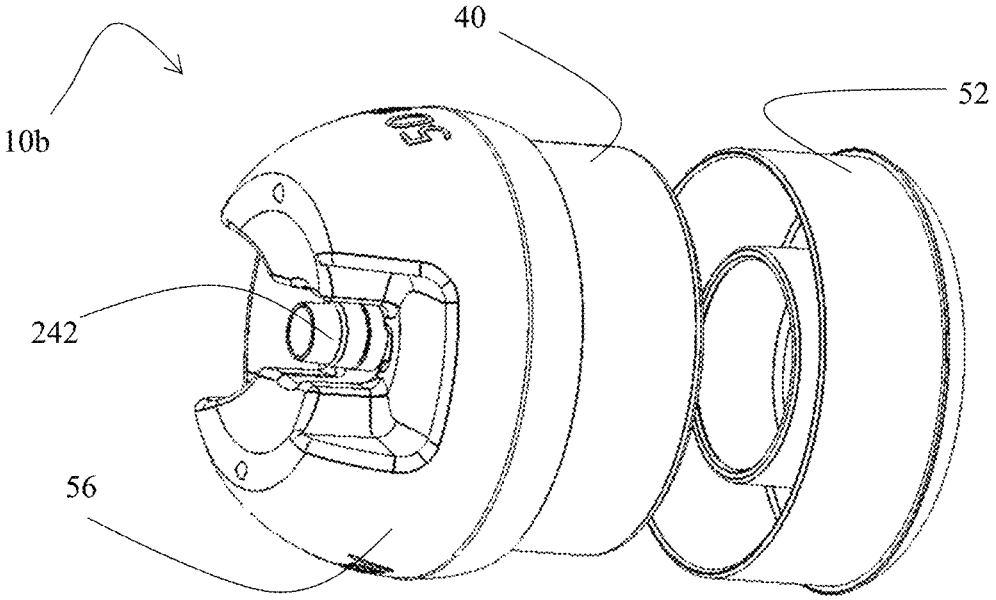

Referring to FIG. 33, tubular portion 242 may first be snapped into central passage 585, and bowl 52 may then be snapped into cover 56 while arranging chamber 40 adequately, for example after shrinking chamber 40 such that it does not obstruct the snapping steps. Chamber may then be inflated to impart the expanded state to housing 50, and then bowl 52 may be pressed to the compacted state, which is accompanied by chamber 40 being partially deflated. The assembly and/or gas may be cleaned and/or sterilized at any time. Detachable cap 59 may be assembled, and this may end the manufacturing process.

Other examples are now discussed with reference to FIGS. 34-38.

Figure 34:
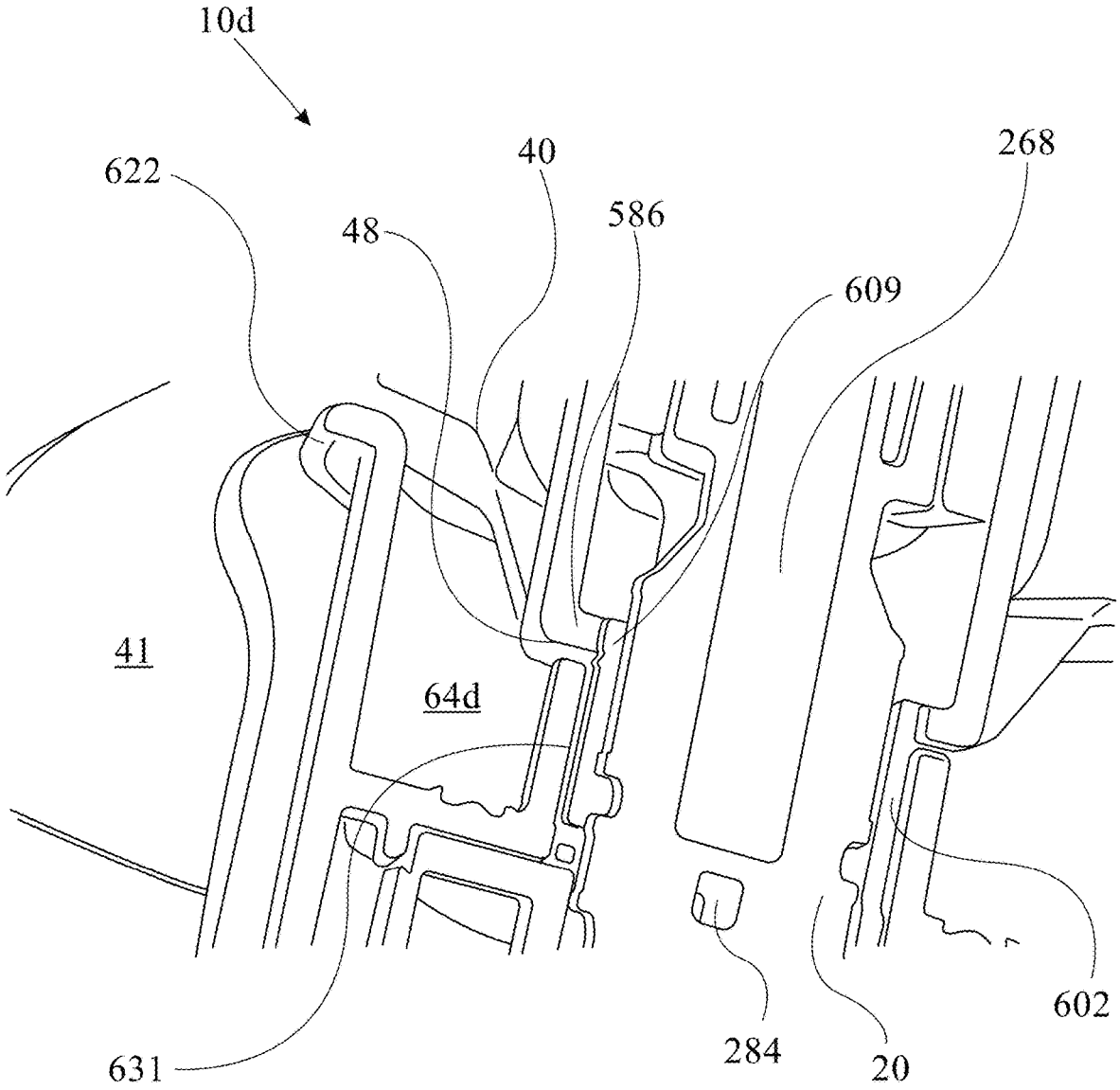
Figure 35:
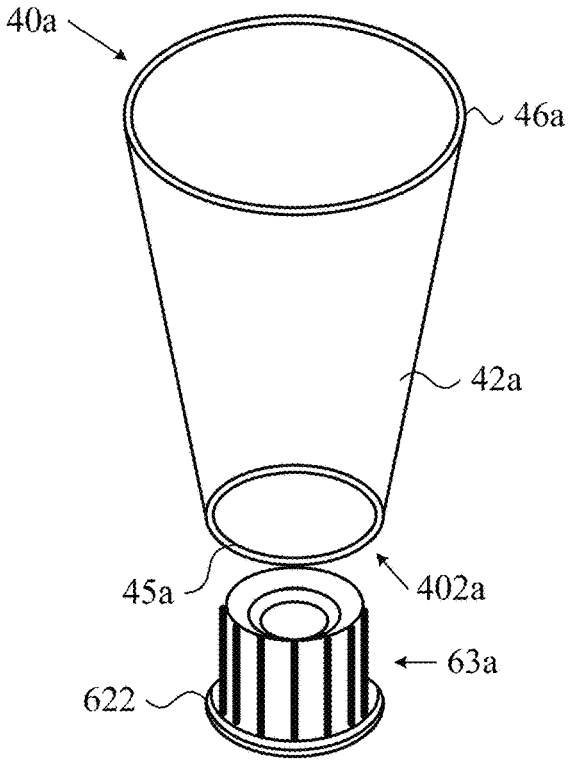
Figure 36:
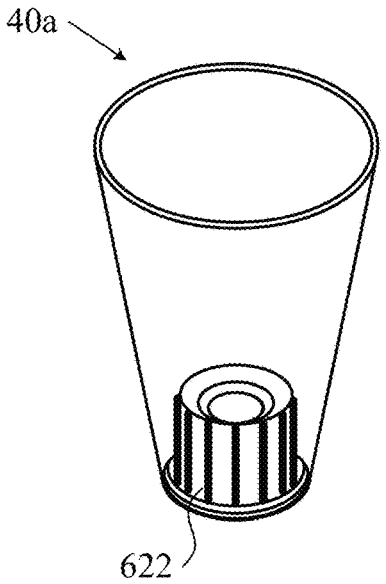
Figure 37:
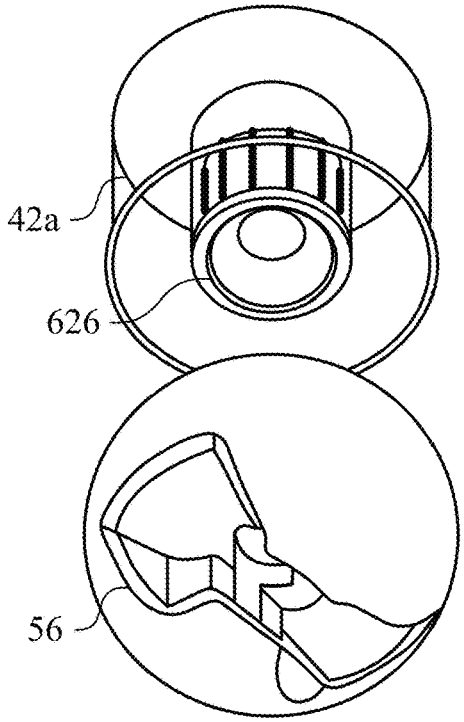
Figure 38:
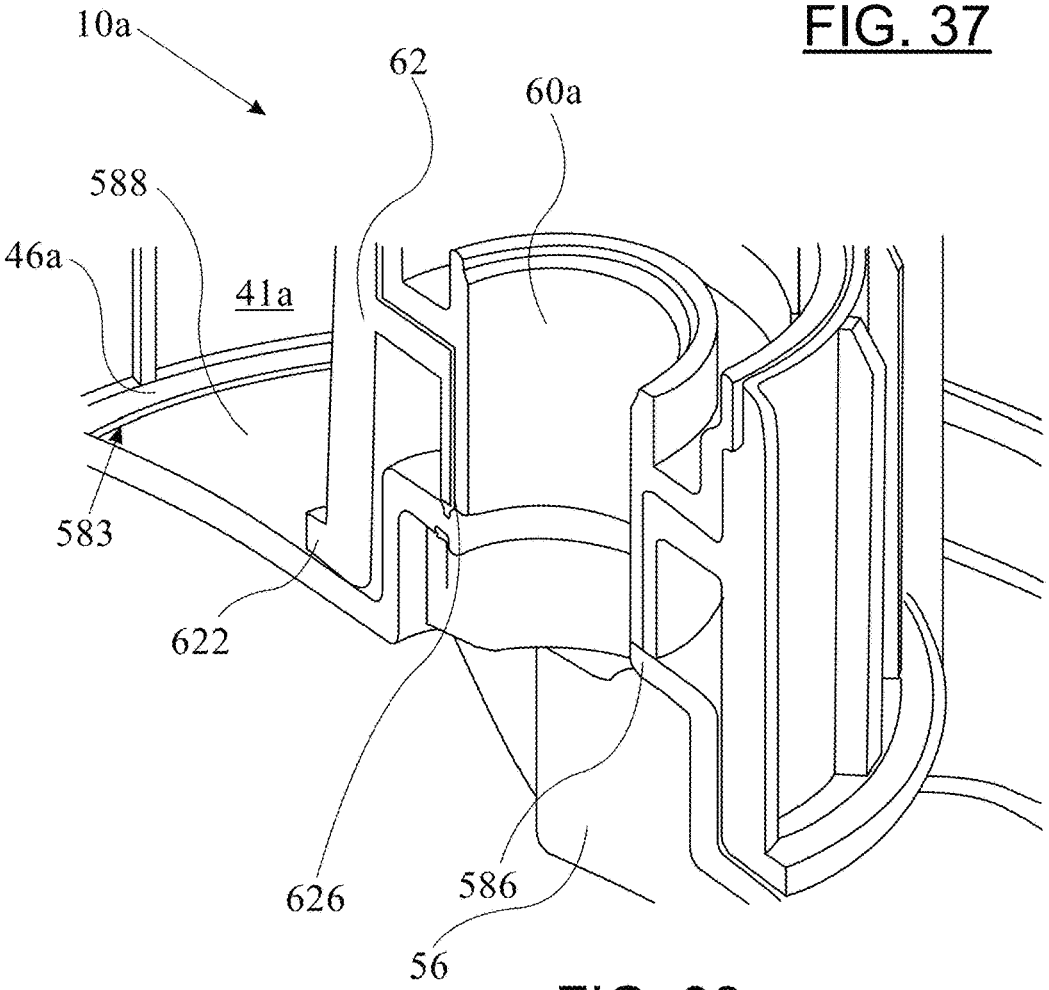

FIG. 34 illustrates a first example by showing a part of a vial adaptor 10*d*. Instead of internal edge 48 of chamber 40 being welded on sleeve portion 631, internal edge 48 of chamber 40 is welded on edge 586 of top section 588. In order to seal regulation compartment 64*d*, edge 586 may also be also welded to sleeve portion 602, for example to rim edge 609. The welding of edge 586 to rim edge 609 may be performed in one single welding step at the time of welding internal edge 48 of chamber 40.

FIGS. 35-38 illustrate another example by showing chamber 40*a* of vial adaptor 10*a* and how it is welded to the assembly.

In this example chamber 40*a* consists of a diaphragm made with one single sheet 42*a*. Sheet 42*a* may be vacuum formed to present a conical section shape. A smaller peripheral edge 45*a* may be welded to external rim edge 622 of coupling unit 63*a*. Chamber 40*a* may then be flipped and after coupling unit 63*a* is positioned with respect to cover 56, other welding steps may be performed. Free larger peripheral edge 46*a* of chamber 40*a* is welded to a peripheral external zone 583 of top section 588 of cover 56. And internal rim edge 626 of housing-coupling member 62 is welded to edge 586 of top section 588. This creates an inside space 41*a* of chamber 40*a* of a toroid shape different from inside space 41 of chamber 40.

FIGS. 39-47 illustrate other vial adaptors 10*c* and 10*e-g* and with different sealing members 32*c* and 32*e-g*.

Figure 39:
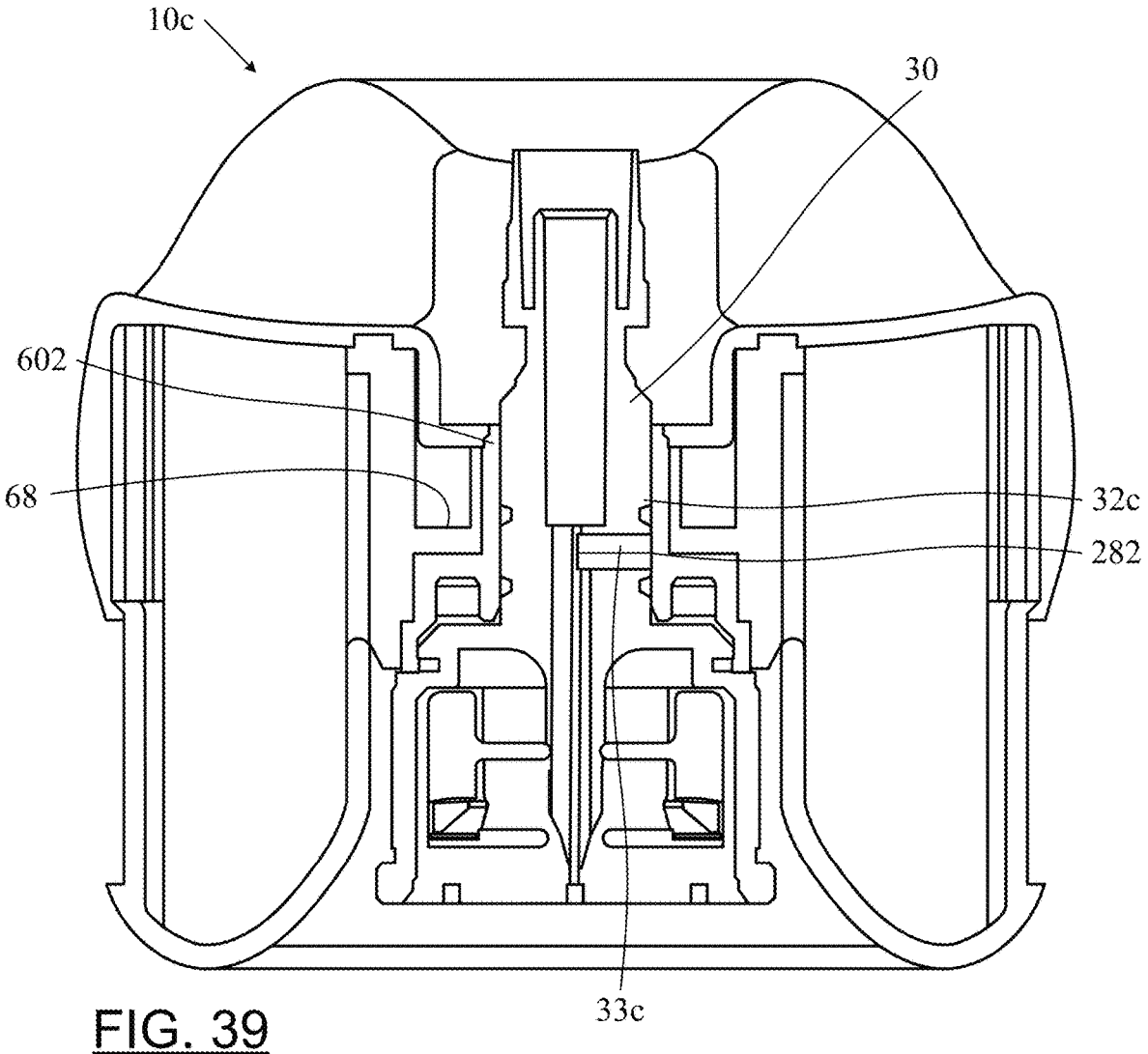
FIGS. 39-67 illustrate other examples of the vial adaptor.

FIG. 39 shows vial adaptor 10*c* similar to vial adaptor 10*a* except for its sealing member. Vial adaptor 10*c* comprises a pair of O-rings 32*c* like O-rings 32*b*. But O-rings 32*c* are over-molded and integrally formed with a duct member 33*c* inserted/plugged inside regulation passageway opening 282, so as to form a single piece 35*c*.

Figure 40:
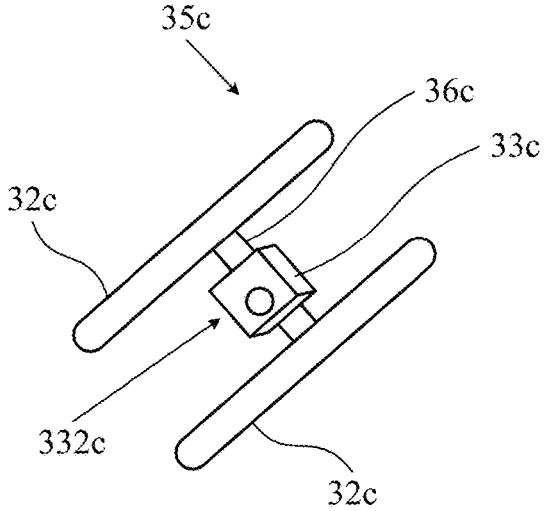

As shown on FIG. 40, single piece 35*c* comprises arms 36*c* connecting O-rings 32*c* on both sides of duct member 33*c*. Duct member 33*c* comprises a hollow insert comprising a hole channel 332*c* the diameter of which reduces the regulation passageway opening 282. Such a piece 35*c* is simple to manufacture, relatively to forming a regulation passageway opening 282 small from scratch.

Figure 41:
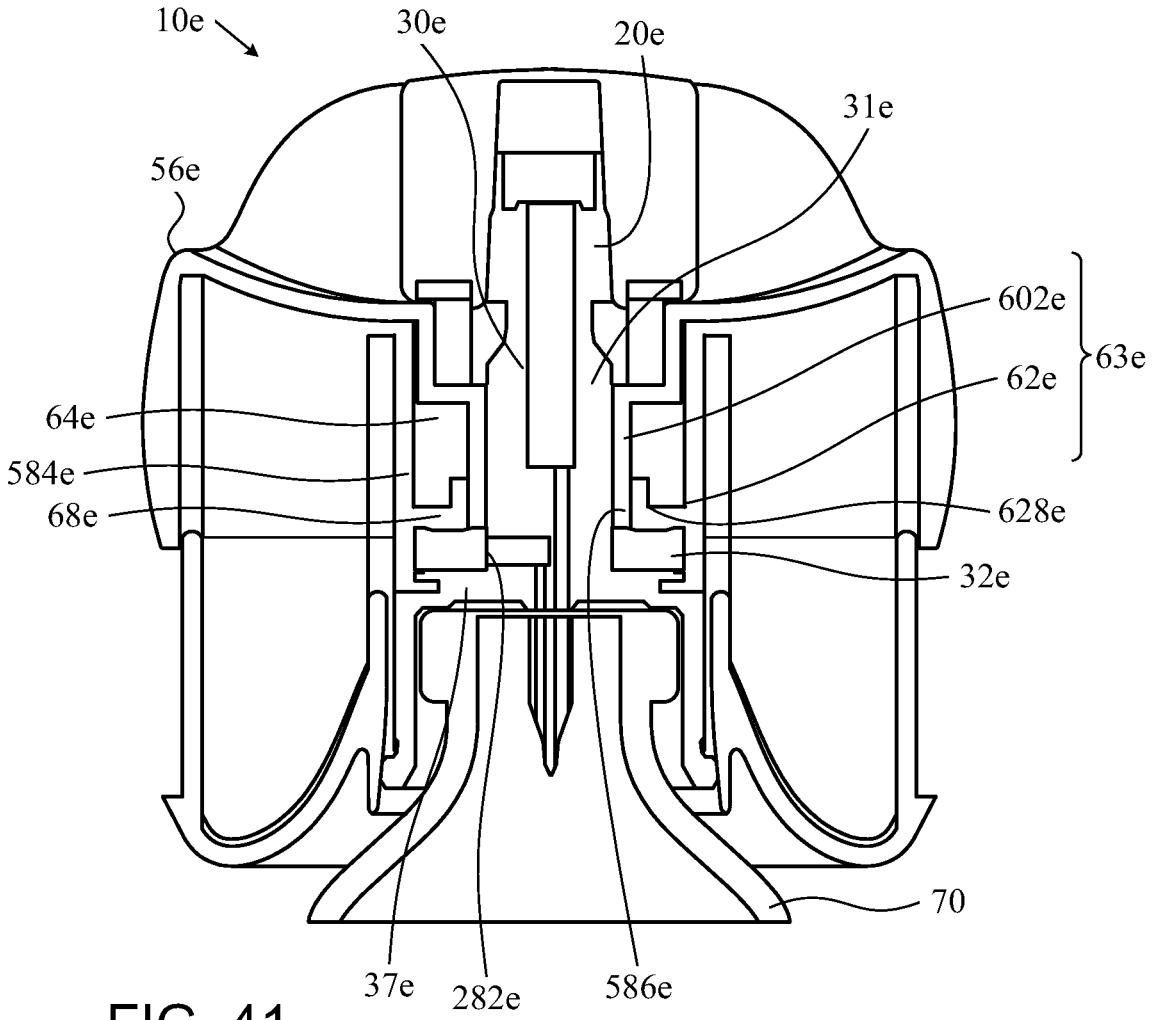

FIG. 41 shows vial adaptor 10*e* which comprises a rubber ring 32*e* sealing member, in which a body portion 20*e* may be inserted such that rubber ring 32*e* surrounds the section of body portion 20*e* where regulation passageway opening 282*e* is formed.

Figure 42:
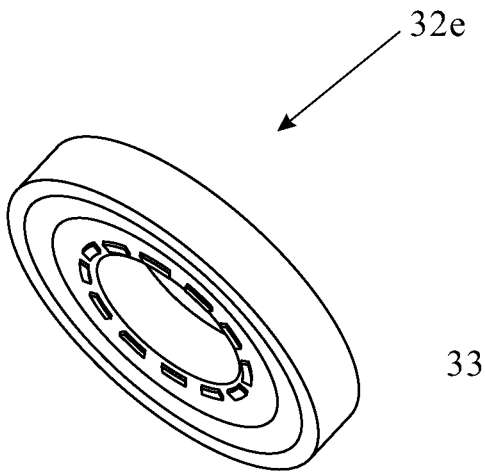
Figure 43:
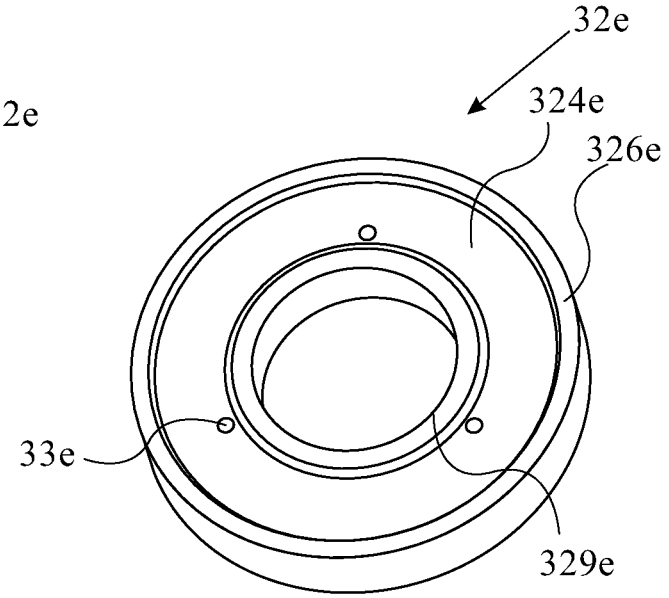

As shown on FIGS. 42-43, rubber ring 32*e* comprises recesses such as a peripheral recess 324*e* formed between peripheral edges 326*e* and 329*e*, and passages 33*e*. Rubber ring 32*e* is pressed by a peripheral wall 31*e* of body portion 20*e* where the regulation passageway opening 282*e* is formed, an edge 586*e* of a sleeve portion 602*e* formed by a cover 56*e* of the housing and constituting coupling portion

63*e* with a housing-coupling member 62*e*, and also by housing-coupling member 62*e* and by a plate section 37*e* of body portion 20*e*. Rubber ring 32*e* is configured upon such pressing to direct fluid from regulation passageway opening 282*e* to a regulation port 68*a* via the recesses (below rubber ring 32*e* with reference to FIG. 60) and the passages 33*e* toward regulation ports 68*e* formed on a plate 628*e* of housing-coupling member 62*e*. Plate 628*e* is arranged between sleeve portion 602*e* and an external wall 584*e* of housing-coupling member 62*e* which forms the internal wall of the telescopic section of cover 56*e*.

Figure 44:
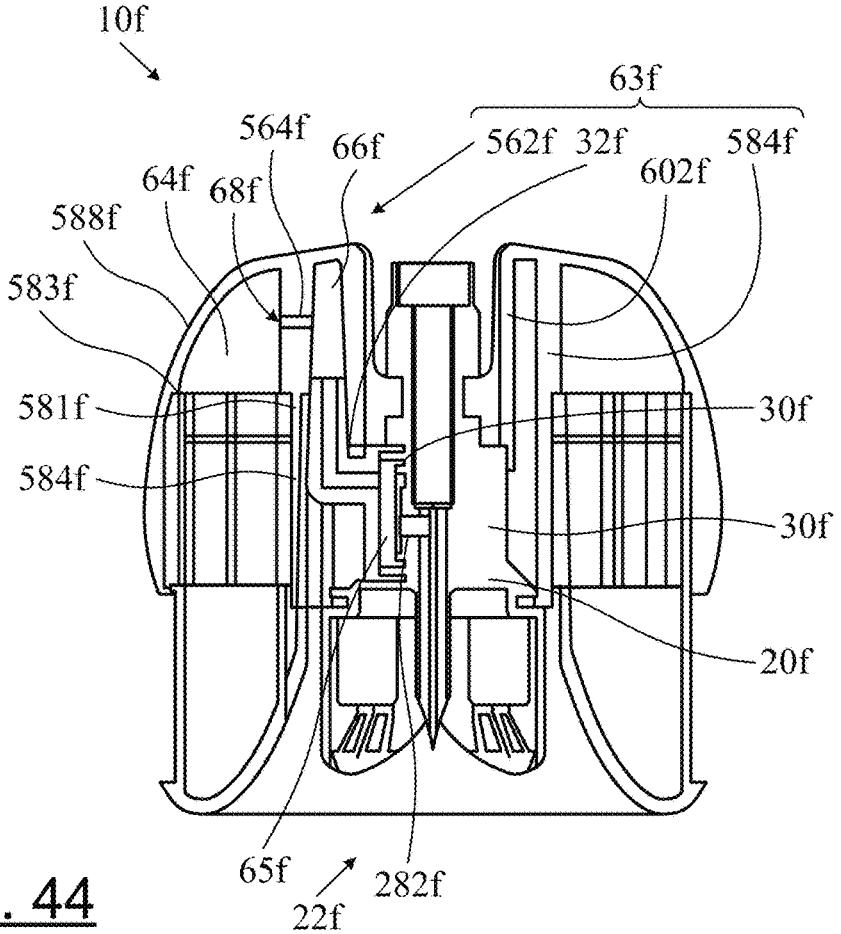
Figure 45:
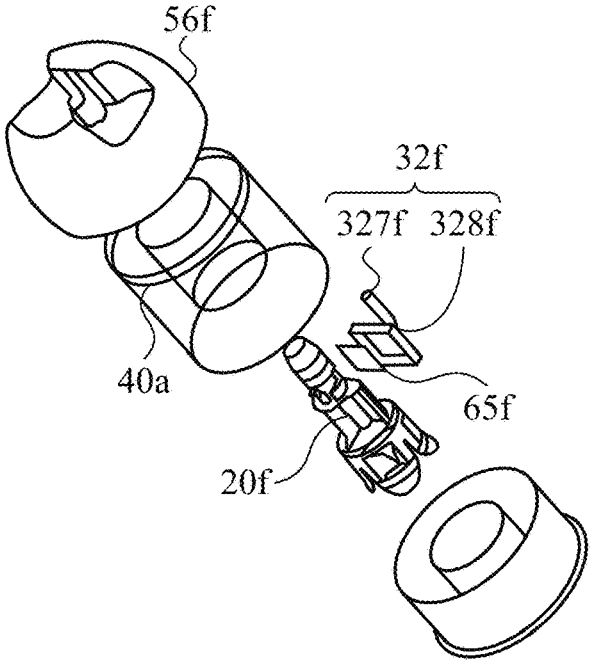

FIGS. 44-45 show vial adaptor 10*f*.

Vial adaptor 10*f* comprises a sealing member 32*f* which includes a filter 327*f* and an adaptor 328*f* with a conical nipple. Adaptor 328*f* is welded to a wall of a central section 30*f* of body portion 20*f* where a regulation passageway opening 282*f* is formed. Sleeve portions 602*f* and 584*f* extending from and formed by cover 56*f* create a central passage in which body portion 20*f* is lodged. Conical nipple of adaptor 328*f* then directs gas coming from vial connection port 22*f* to a regulation port 66*f* formed in a top section 588*f* of a cover 56*f* of the housing. Regulation port 66*f* then transmits the gas via a canal 564*f* having an opening 68*f* to a regulation compartment 64*f* presenting a toroid shape and formed in cover 56*f*. Chamber 40*a* is welded on a peripheral external zone 583*f* of top section 588*f* of cover 56*f* and to the edge of sleeve portion 602*f* to be in fluid communication with regulation compartment 64*f*.

Figure 46:
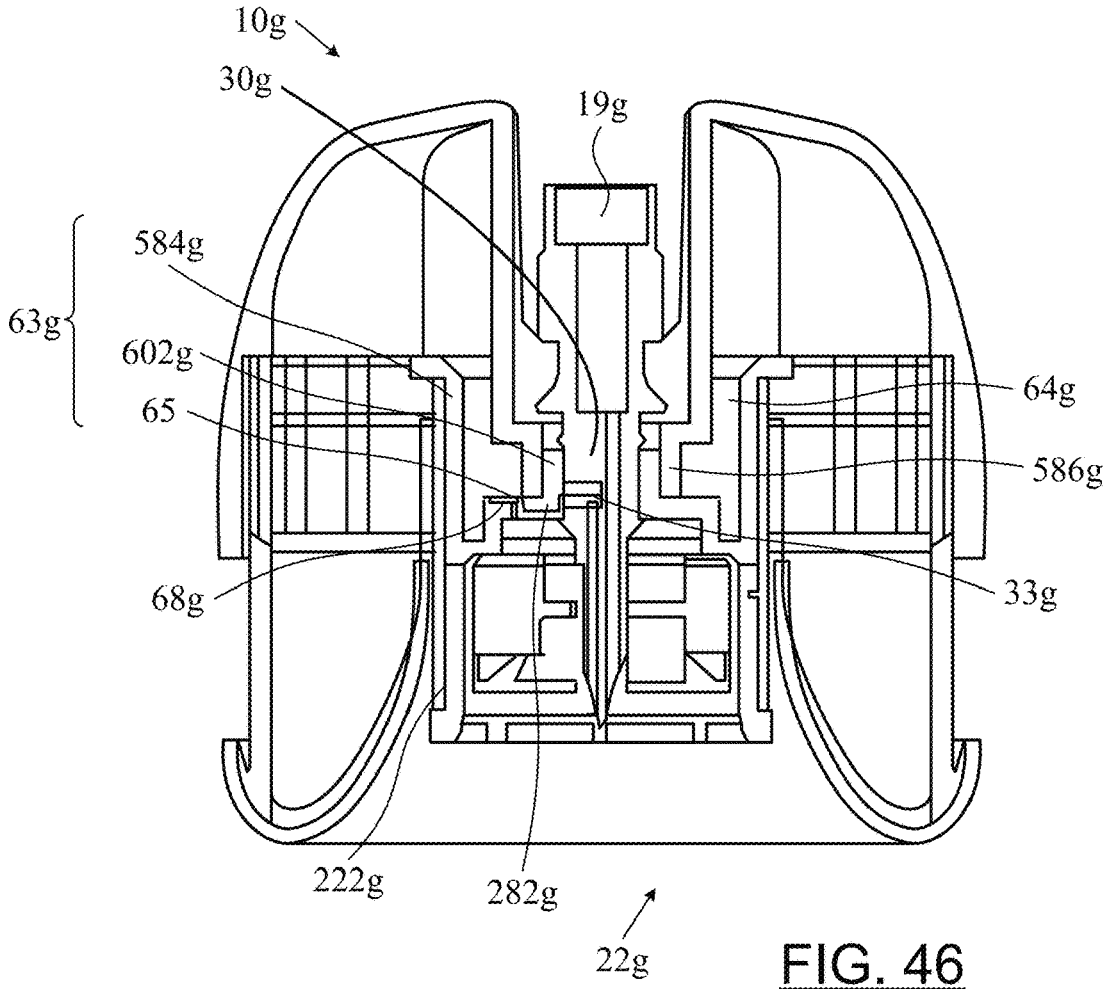
Figure 47:
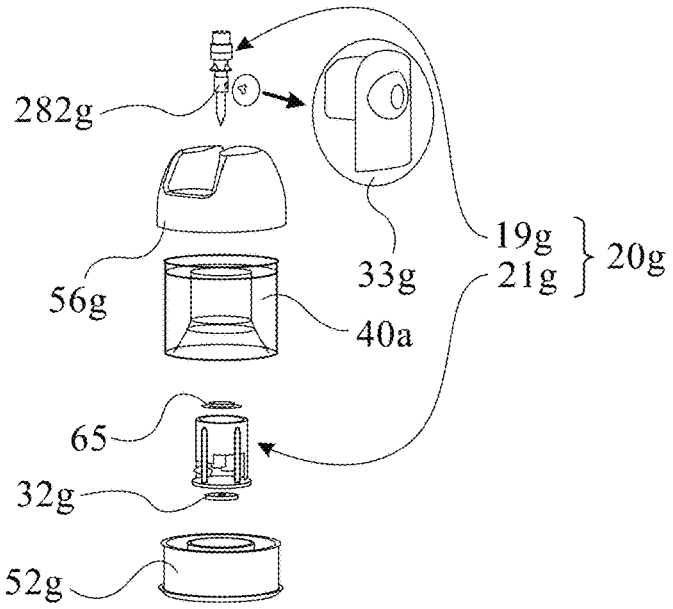

FIGS. 46-47 show vial adaptor 10*g*.

Vial adaptor 10*g* comprises a spike 19*g* comprising lumens forming the access passageway and the regulation passageway and cooperating with a coupling unit 21*g* of a coupling portion 63*g* to form body portion 20*g*. Coupling unit 21*g* comprises a peripheral wall 222*g* forming a vial connection port 22*g*, a sleeve portion 602*g* for inserting a central section 30*g* of spike 19*g* where a regulation passageway opening 282*g* is formed, and an external wall 584*g* forming an internal wall of a telescopic section of a cover 56*g*. A regulation compartment 64*g* of a toroid shape is formed between wall 586*g* extending from and formed by cover 56*g*.

Vial adaptor 10*g* comprises an annulus-shaped sealing element 32*g* providing airtightness to fluid communication between opening 282*g* and regulation port 68*g*. Vial adaptor 10*g* also comprises a separate duct member 33*g* consisting of an over-molded rubber seal plugged inside opening 282*g* and which also achieves sealing.

FIGS. 48-67 illustrate examples of housing expandability different from the examples presented earlier.

FIGS. 48-67 show vial adaptors 110*a-i* mounted on a vial 70 via a body portion 120 extending along the vial connection axis and comprising at least two portions 152*a-i* and 156*a-i* configured for sliding one with respect to the other, with different types of sliding represented by arrows D on the figures.

Figure 48:
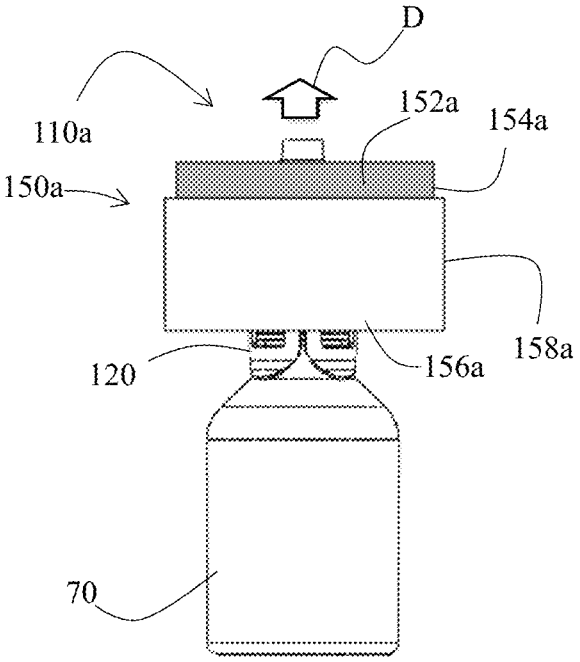
Figure 49:
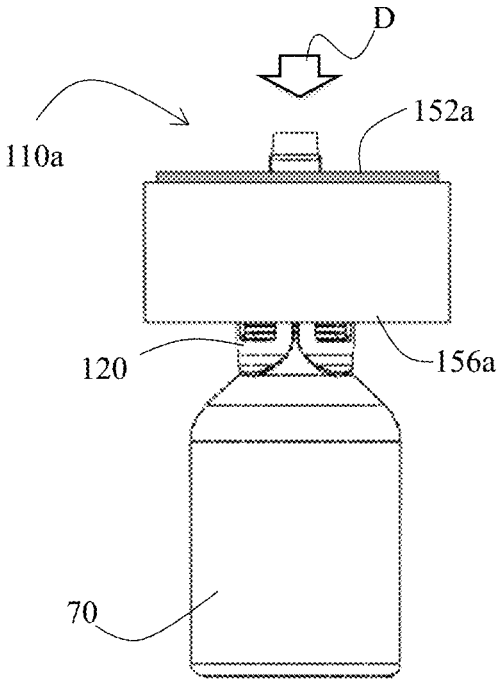
Figure 50:
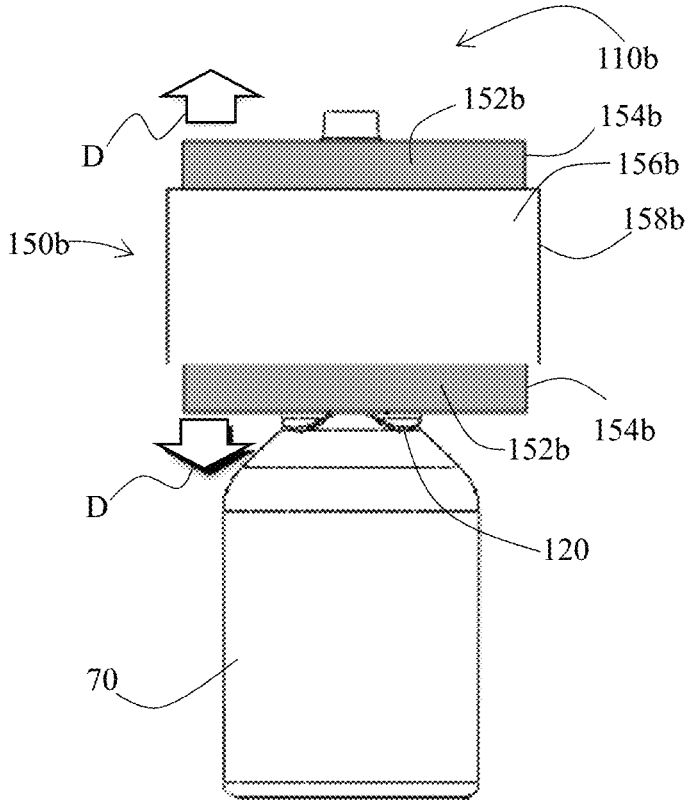
Figure 51:
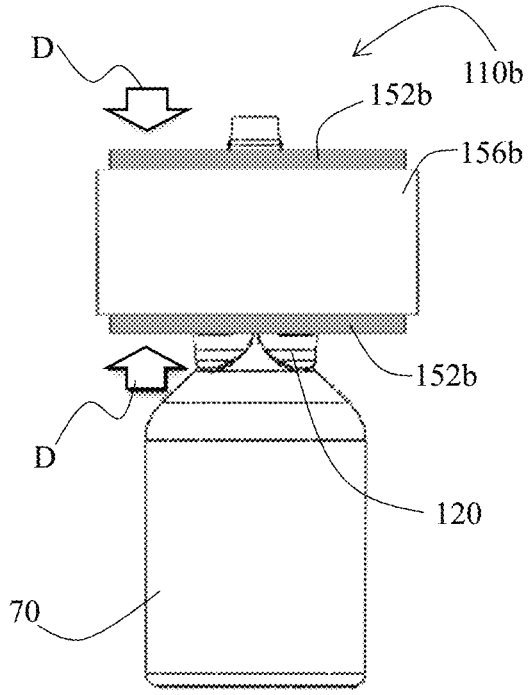

FIGS. 48-49 show a vial adaptor 110*a* comprising a telescopic section 154*a* of a mobile portion 152*a* configured to slide inside a telescopic section 158*a* of a fixed portion 156*a* to form a telescopic assembly. FIGS. 50-51 show a vial adaptor 110*b* comprising two telescopic sections 154*b* each of a respective mobile portion 152*b* configured to slide inside a telescopic section 158*b* of a same central fixed portion 156*b*. In both examples, the housing 150*a-b* consists of a single housing unit. As for vial adaptors 10*a-b*, each sliding is translational and vertical, the housing 150*a-b* surrounds at least a section of body portion 120 and thus the vial connection axis, and the housing 150*a-b* achieves volume variation uniformly around said section and axis. Thus the chamber may also surround said section and axis and achieve volume variation uniformly around said section and axis, and the inside space of the housing and of the chamber may be of toroid shape. Housing 150*b* is further configured for achieving expansion in an orientation D toward vial 70 (via one of the two mobile portions 152*b*), but only partly (i.e. not fully) since the other mobile portion 152*b* slides up during expansion.

Figure 52:
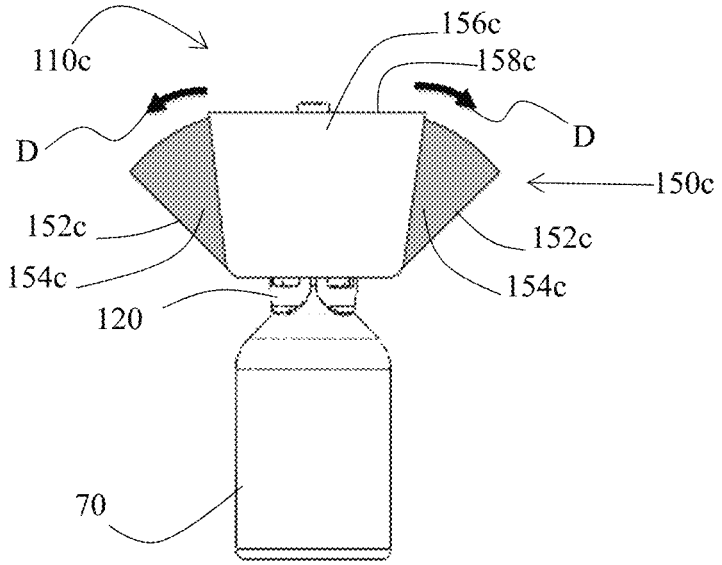
Figure 53:
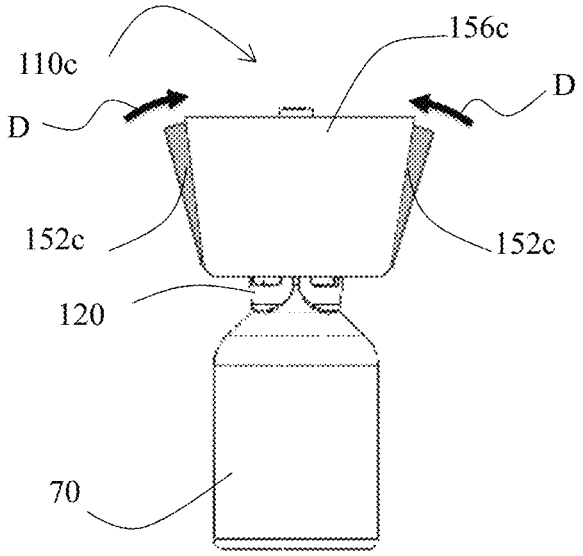
Figure 54:
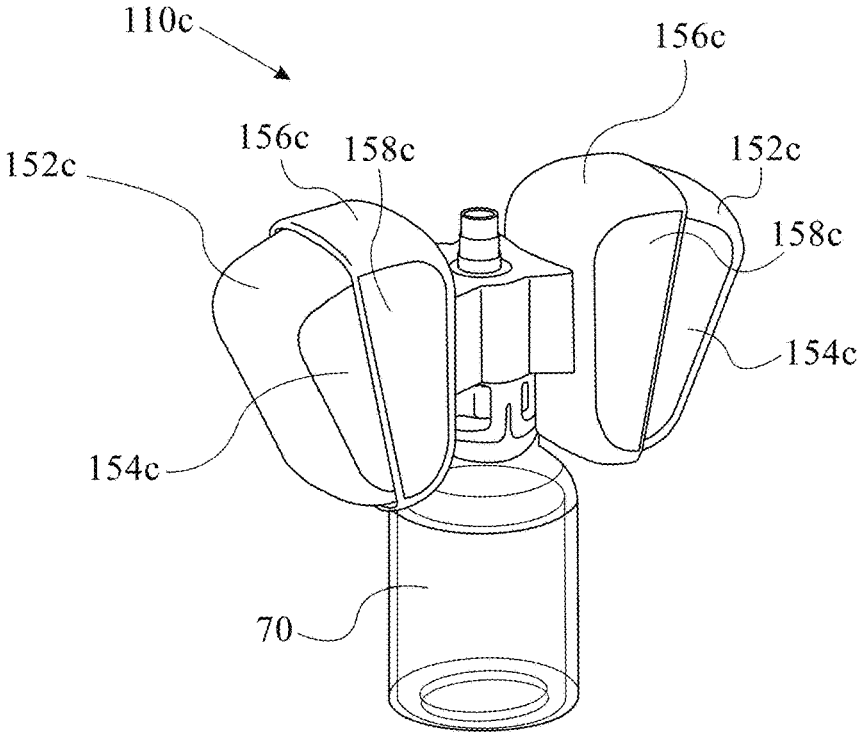
Figure 55:
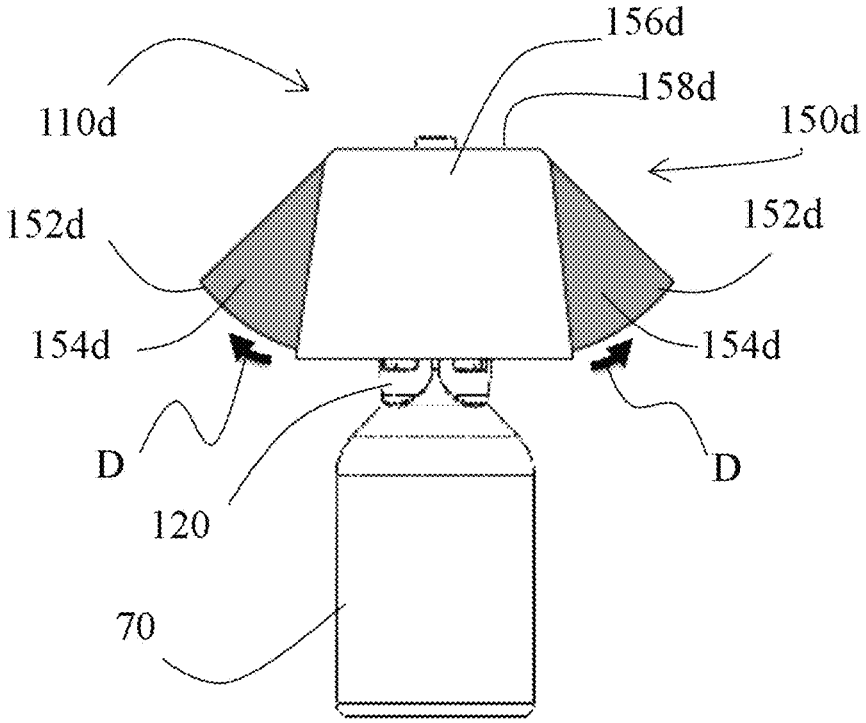
Figure 56:
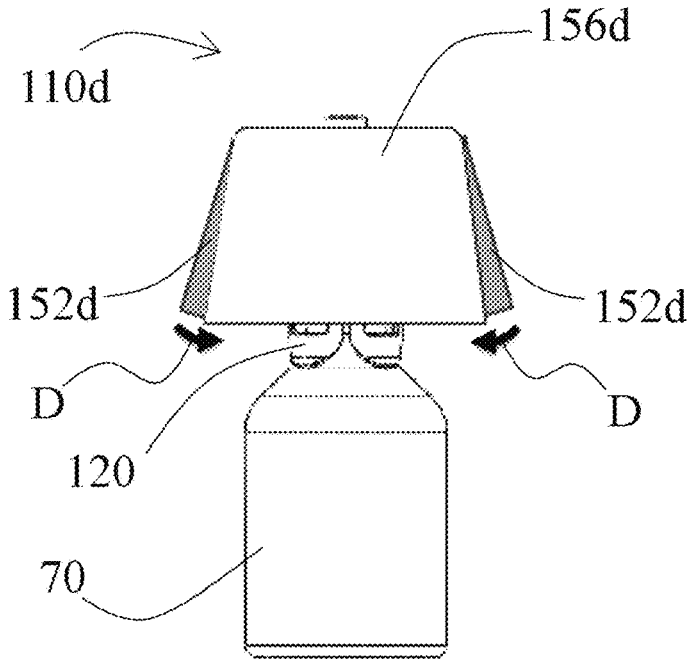
Figure 57:
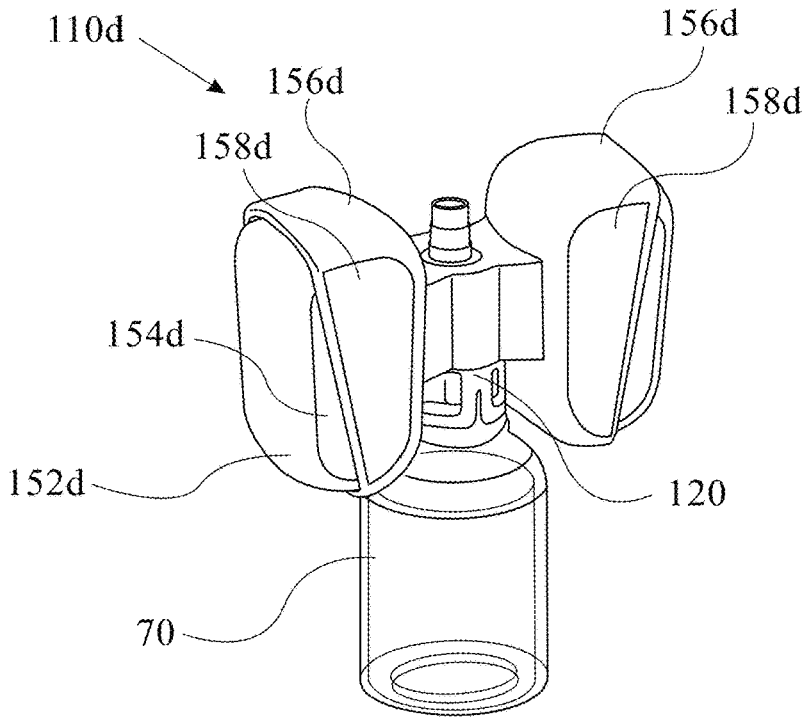

FIGS. 52-54 show a vial adaptor 110*c* comprising two telescopic section 154*c* each of a respective mobile portion 152*c* and configured to slide each inside a telescopic section 158*c* of a respective fixed unit 156*c*. FIGS. 55-57 show a vial adaptor 110*d* also comprising two telescopic section 154*d* each of a respective mobile portion 152*d* and configured to slide each inside a telescopic section 158*d* of a respective fixed unit 156*d*. In both examples, the housing 150*c-d* consists of two housing units, and the sliding is rotational (but with different orientations). Contrary to vial adaptors 10*a-b*, the housing 150*c-d* does not surround the vial connection axis, but the housing 150*c-d* presents an axial symmetry relative to said vial connection axis, such that the assembly is still well-balanced even though the translational sliding is not parallel to the vial connection axis. Vial adaptor 110*c* keeps the assembly relatively compact, as it achieves expansion in a direction D oriented toward vial 70.

Figure 58:
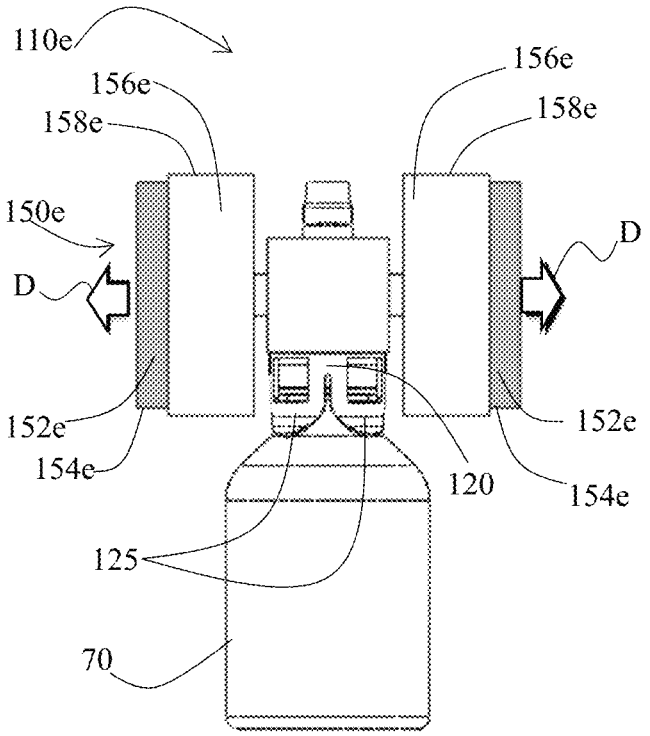
Figure 59:
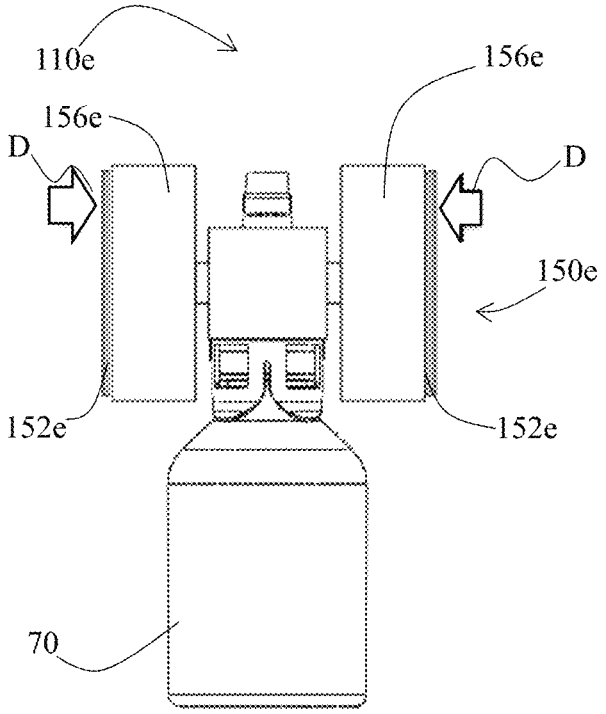

FIGS. 58-59 show a vial adaptor 110*e* comprising two telescopic section 154*e* each of a respective mobile portion 152*e* and configured to slide each inside a telescopic section 158*e* of a respective fixed unit 156*e*. Like vial adaptor 110*c-d*, the housing 150*e* consists of two housing units and the housing 150*e* presents only an axial symmetry relative to the vial connection axis, but the sliding is translational. Unlike vial adaptor 10*a*, the translational sliding is not parallel to the vial connection axis nor with expansion oriented toward vial 70.

Figure 60:
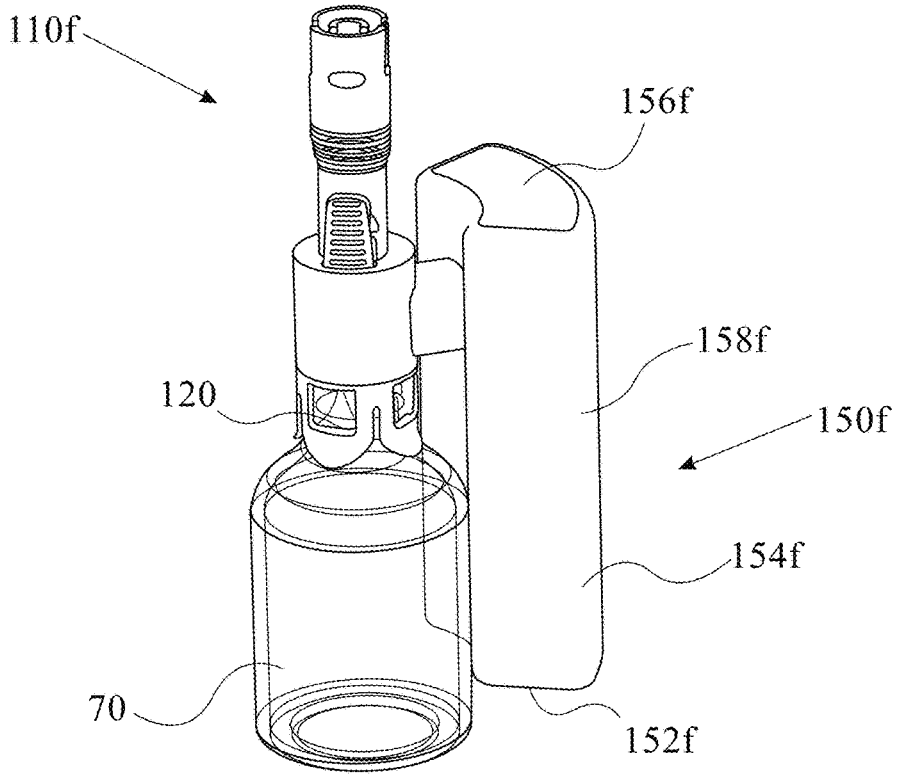
Figure 61:
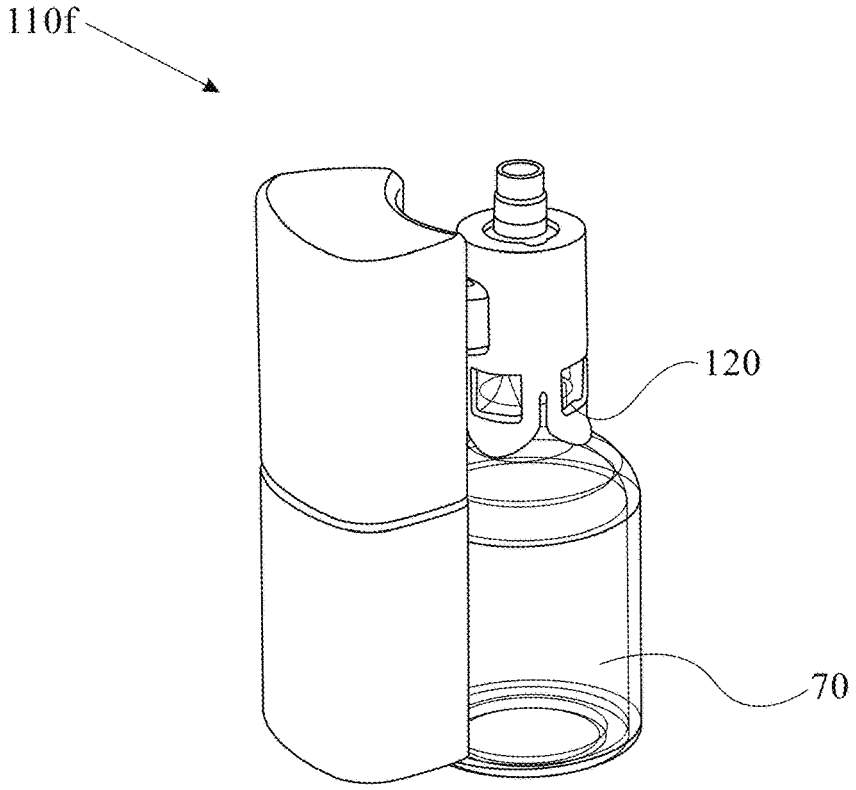
Figure 62:
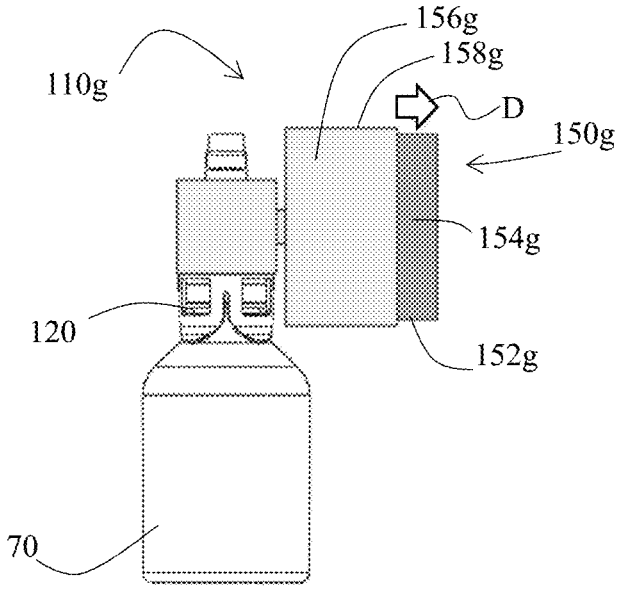
Figure 63:
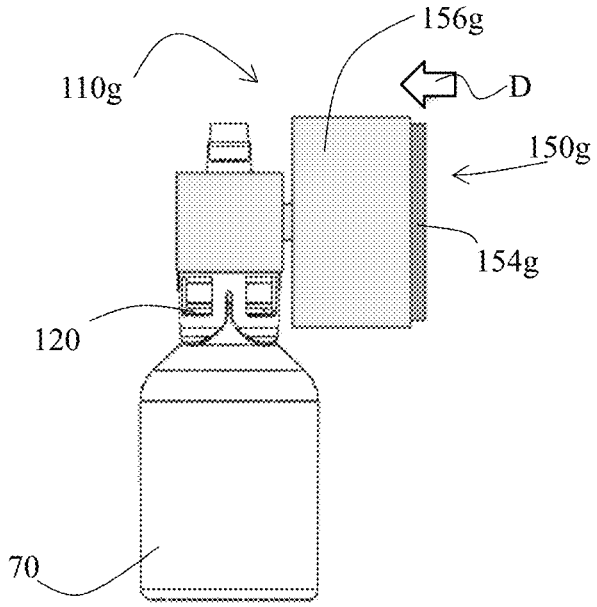
Figure 64:
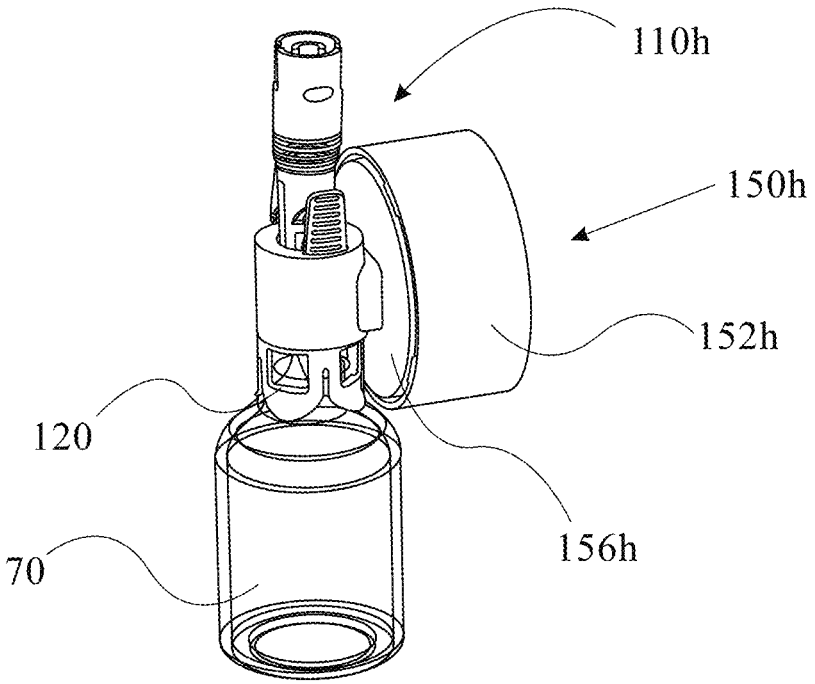
Figure 65:
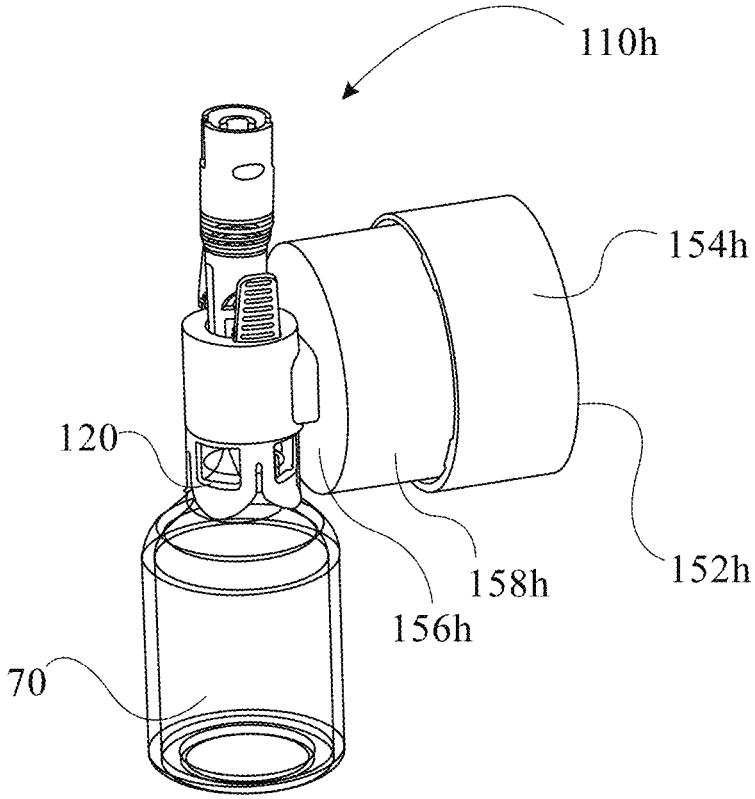
Figure 66:
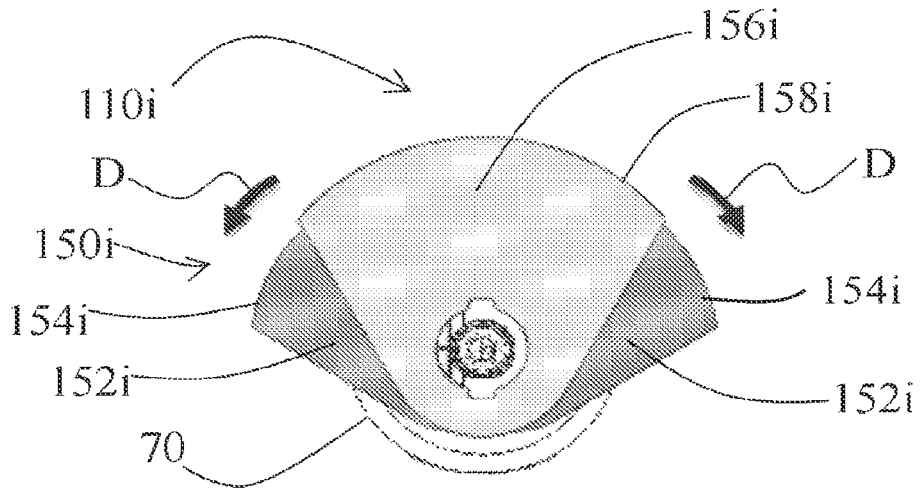

FIGS. 60-61 show a vial adaptor 110*f* comprising a telescopic section 154*f* of a bowl 152*f* and configured to slide with respect to a telescopic section 158*f* of a cover 156*f*. Like vial adaptor 10*a*, the housing 150*f* consists of a single unit and the sliding is translational, parallel to the vial connection axis and with expansion oriented toward vial 70. But unlike vial adaptor 10*a*, the housing 150*f* does not surround nor present any symmetry relative to the vial connection axis.

FIGS. 62-67 show yet other telescopic vial adaptors 110*g-i* comprising telescopic sections 154*g-i* and 158*g-i* of sliding portions 152*g-i* and 156*g-i*. Unlike vial adaptor 10*a*, the housing does not surround nor present any symmetry relative to the vial connection axis, nor is the sliding parallel to the vial connection axis or with expansion oriented toward vial 70.

The first aspect of the vial adaptor has been described. It will however be appreciated that the above discussion applies to other aspects of the vial adaptor as well. In particular, all discussed examples may be adapted to work without a housing enveloping the chamber, or with a housing of fixed volume and enveloping the chamber (the volume of the housing being in such a case sufficient for the chamber to achieve any contemplated volume variation). Furthermore, any sub-assembly described above may be contemplated.

The invention claimed is:

1. A vial adaptor (10*a-e*, 110*a-i*, 1010) comprising:

a body portion (20, 20*d-h*, 120, 1020) including:

a vial connection port (22, 22*f-g*, 1022), a syringe connection port (24, 1024), an access passageway (26, 1026) between the vial connection port and the syringe connection port, and a regulation passageway (28, 1028);

an expandable and/or contractible chamber (40, 40*a*, 1040) impermeable to gas and/or liquid and configured to be cased within an expandable rigid housing (50, 50*d-g*, 150*a-i*, 1050), wherein the regulation passageway are configured to connect between the vial connection port and the chamber; wherein the expandable rigid housing comprises at least two portions (52, 56) configured for telescopically sliding one with respect to the other when the housing expands or retracts, wherein the expandable housing provides an adaptable space optimization to the vial adaptor and further provides a telescopic and rigid visual indicator of the levels of stored gas and/or liquid, and Wherein the expandable and/or contractible chamber and the expandable housing provide a constant and completely sealed double-layered receptacle stretched along the entire inner surface of the expandable and/or contractible chamber and along the entire inner surface of the expandable/contractible housing even when the expandable housing experience expending followed by contraction and vice versa, such that, in any given state, the gas and/or liquid designated to be stored within are always separated by at least one resilient layer and at least one rigid layer.

2. The vial adaptor of claim 1, wherein the expandable and/or contractible chamber is configured for imparting expansion to the housing.

3. The vial adaptor of claim 1, wherein the housing has a contracted state and an expanded state, the housing being less voluminous in the contracted state than in the expanded state, the housing casing the chamber both in the contracted state and in the expanded state.

4. The vial adaptor of claim 1, wherein the housing is further contractible.

5. The vial adaptor of claim 1, wherein the chamber (40, 40*a*) comprises at least a flexible and/or elastic portion, the flexible and/or elastic portion optionally comprising at least one sheet (42, 44, 42*a*), the flexible and/or elastic portion optionally comprising two sheets (42, 44) welded together, the two sheets (42, 44) optionally each having an annulus shape, the two sheets being optionally welded together at respective external edges (45).

6. The vial adaptor of claim 1, wherein the vial connection port defines a vial connection axis (A), the housing and/or the chamber surrounding the vial connection axis.

7. The vial adaptor of claim 1, wherein the housing and/or the chamber surrounds at least a section (30, 30*e-g*) of the body portion, and optionally wherein the vial connection port defines a vial connection axis (A), the section (30, 30*e-g*) of the body portion that the housing and/or the chamber surrounds extending along the vial connection axis.

8. The vial adaptor of claim 6, wherein the housing (50) defines a toroid inside space (51) and/or the chamber (40, 40*a*) defines a toroid inside space (41, 41*a*).

9. The vial adaptor of claim 6, wherein the vial adaptor is configured for the housing to expand and/or contract uniformly around the vial connection axis (A), and/or for the chamber to expand and/or contract uniformly around the vial connection axis (A).

10. The vial adaptor of claim 1, wherein the vial connection port defines a vial connection axis (A), wherein the vial adaptor is being-configured for the housing (50, 50*d-g*, 150*a-b*, 150*f*) to expand and/or contract along a direction at least substantially parallel to the vial connection axis (A), and wherein the vial adaptor is configured and/or for the chamber (40, 40*a*) to expand and/or contract along a direction at least substantially parallel to the vial connection axis (A).

11. The vial adaptor of claim 1, wherein the vial adaptor is configured, when connected to a vial, for the housing (50, 50*d-g*, 150*b-c*, 150*f*) to expand in an orientation (D) toward the vial, and/or for the chamber (40, 40*a*) to expand in an orientation (D) toward the vial.

12. The vial adaptor of claim 1, wherein the vial adaptor further comprises a coupling portion (63*a-b*, 63*e-g*) comprising a regulation port (66, 68*e*, 66*f*, 68*g*), the vial adaptor comprising a fluid path between the regulation port and an extremity of the regulation passageway (282, 282*e-g*), the vial adaptor comprising another fluid path between the regulation port and the chamber, and optionally wherein the coupling portion (63*a-b*, 63*e-g*) forms a passage (61), the central section of the body portion being inserted in the passage.

13. The vial adaptor of claim 12, wherein the coupling portion (63*a-b*, 63*e*, 63*g*, 63*f*) comprises a sleeve portion (602, 602*e*, 602*g*, 584*f*) which forms the passage (61), the vial connection port (22, 22*g*) being arranged at one end of the sleeve portion and the syringe connection port (24) being arranged at the other end of the sleeve portion.

* * * * *